US005359344A

United States Patent [19]

Inoue et al.

[11] Patent Number: 5,359,344

[45] Date of Patent: Oct. 25, 1994

[54] DATA PROCESSING SYSTEM AND APPARATUS

[75] Inventors: Hiroshi Inoue, Yokohama; Atsushi Mizutome, Fujisawa; Aiko Enomoto, Zama, all of Japan

[73] Assignee: Canon Kabushiki Kaisha, Tokyo, Japan

[21] Appl. No.: 11,241

[22] Filed: Jan. 29, 1993

Related U.S. Application Data

[62] Division of Ser. No. 410,731, Sep. 21, 1989.

[30] Foreign Application Priority Data

| | | | |
|---|---|---|---|
| Sep. 29, 1988 | [JP] | Japan | 63-246089 |
| Sep. 30, 1988 | [JP] | Japan | 63-246307 |
| Sep. 30, 1988 | [JP] | Japan | 63-246308 |
| Oct. 6, 1988 | [JP] | Japan | 63-252992 |
| Oct. 11, 1988 | [JP] | Japan | 63-256324 |
| Oct. 12, 1988 | [JP] | Japan | 63-258185 |

[51] Int. Cl.[5] ..... G09G 3/36

[52] U.S. Cl. ..... 345/100; 345/98

[58] Field of Search ..... 340/784, 799, 798, 721; 345/98, 100

[56] References Cited

U.S. PATENT DOCUMENTS

| | | |
|---|---|---|
| 4,655,561 | 4/1987 | Kanbe et al. . |
| 4,691,200 | 9/1987 | Stephany . |
| 4,693,563 | 9/1987 | Harada et al. . |
| 4,922,241 | 5/1990 | Inoue et al. . |

FOREIGN PATENT DOCUMENTS

| | | |
|---|---|---|
| 0150453 | 8/1985 | European Pat. Off. . |
| 0167398 | 1/1986 | European Pat. Off. . |
| 0172312 | 2/1986 | European Pat. Off. . |
| 0229659 | 7/1987 | European Pat. Off. . |
| 0235947 | 9/1987 | European Pat. Off. . |
| 0247827 | 12/1987 | European Pat. Off. . |
| 0256879 | 2/1988 | European Pat. Off. . |
| 0288168 | 10/1988 | European Pat. Off. . |
| 0308987 | 2/1989 | European Pat. Off. . |
| 2186470 | 8/1987 | United Kingdom . |

OTHER PUBLICATIONS

"Scan Line Scrolling Partitioned Display", IBM Technical Disclosure Bulletin, vol. 30, No. 10, pp. 455–458 (Mar. 1988).

*Primary Examiner*—Jeffery Brier

*Attorney, Agent, or Firm*—Fitzpatrick, Cella, Harper & Scinto

[57] ABSTRACT

A data processing apparatus includes: receiver for receiving image data having a plurality of graphic events; a controller for controlling an image data storage memory so that the received image data is stored in the memory in the order of from a higher display priority level of the graphic events based on prescribed display priority levels of the graphic events and a controller for controlling the image data storage memory so that the stored image data is transferred in the order of from a higher priority level of the graphic events to a drive control.

11 Claims, 38 Drawing Sheets

| FIG. 9B-1 | FIG. 9B-2 |
|---|---|

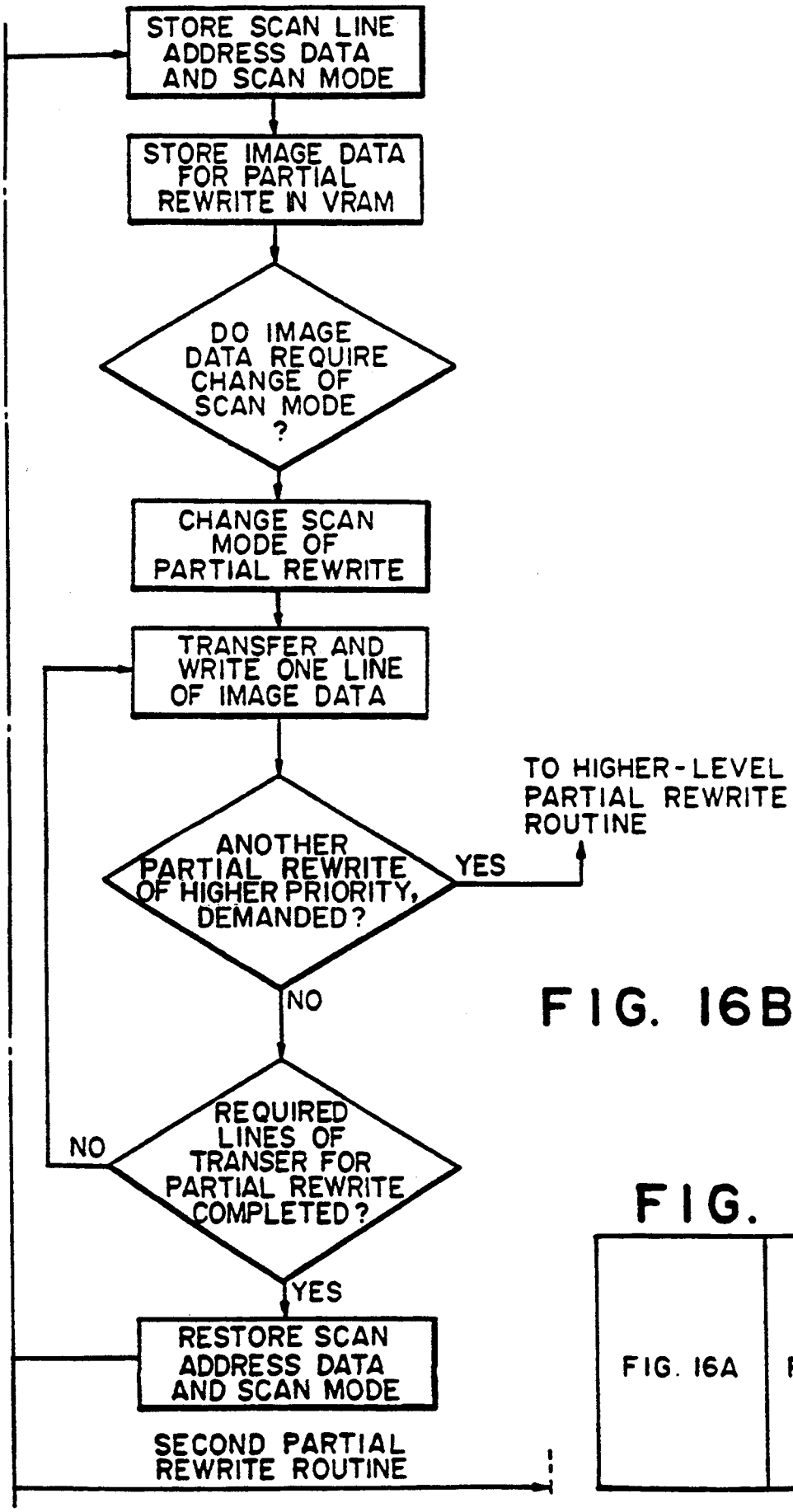
FIG. 16B
FIG. 16
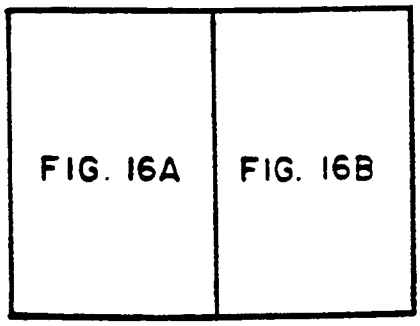

DATA PROCESSING SYSTEM AND APPARATUS

This application is a division of application Ser. No. 07/410,731 filed Sep. 21, 1989.

FIELD OF THE INVENTION AND RELATED ART

The present invention relates to a data processing system and apparatus, particularly a display data processing system and apparatus using a ferroelectric liquid crystal having a memory characteristic and suitable for moving a display using a pointing device such as a cursor or mouse.

Heretofore, as computer terminal display apparatus, a refresh scan-type CRT has been generally used, and a vector scan-type CRT having a memory characteristic is partly used as a large size, high resolution display for CAD. On the vector scan-type CRT, a once-displayed image is not refreshed until a subsequent screen refresh is performed. For this reason, it is not suited as a display apparatus for a real-time man-machine interfacial display, such as a moving cursor display, a moving icon display as by a pointing device such as a mouse and an editorial display (insertion, deletion, moving, copying, etc.) of characters or sentences. On the other hand, the refresh scan-type CRT requires a refresh cycle with a frame frequency to 60 Hz or more for the purpose of preventing a flicker on the screen, a non-interlaced scanning scheme is adopted in order to provide a good observability of a moving display of data in a picture, e.g., a moving display of an icon. (Incidentally, a TV set adopts an interlaced scanning scheme with a field frequency of 60 Hz and a frame frequency of 30 Hz in view of a motion picture display and convenience for the drive control system.) Accordingly, the higher the display resolution is, the larger the display apparatus becomes, thus requiring a higher power, a larger size drive controller unit and a higher cost.

Such a large-size, high power CRT provides inconveniences based on which a flat display panel has been developed in recent years.

At present, there are various systems of flat display panels, such as a highly multiplexed drive system using a twisted nematic liquid crystal (STN), a system comprising a modification thereof for a white-and-black display and a plasma display system, all of which adopt the same image data transfer scheme like that of the CRT system and a non-interlaced scanning scheme with a frame frequency of 60 Hz or higher for their picture or screen refreshing, so that they use a number of total scanning lines on the order of 400–480 lines for constituting one picture and have not provided a large size flat display panel having 1000 or more scanning lines. This is because these display panels do not have a memory characteristic based on their drive principle so that they require a refresh cycle with a frame frequency of 60 Hz or higher for preventing flicker. Further, this leads to a short one horizontal scanning time of 10–50 μsec or shorter, thus resulting in failure of a good contrast.

A ferroelectric liquid crystal apparatus is capable of providing a large-sized, high-resolution display which remarkably surpasses the above-described display apparatus, but because of its low-frame frequency drive, it necessitates a partial rewriting scanning scheme (with scanning of scanning lines constituting only a rewriting region) utilizing a memory characteristic in order to provide a man-machine interfacial display apparatus. The partial rewriting scanning scheme has been disclosed, e.g., in U.S. Pat. No. 4,655,561 to Kanbe, et al.

The partial rewriting scanning scheme is particularly suited for a moving display as by a cursor or a mouse and a scrolling display in a ferroelectric liquid crystal display apparatus. As it is impossible to simultaneously effect partial rewriting scanning of two different regions, however, it is impossible to effect a moving display of a mouse or a cursor during scroll display of a multi-window in case of a system wherein the partial rewriting scanning is performed by designation of start address and a finish address for the partial rewrite scanning. For example, if an operation is considered when a scroll display of a window and a display of a pointing device are concerned, first a partial rewrite scanning of a window scroll display is demanded to enter the partial rewrite scanning on a display panel, and thereafter, even if a pointing device is moved, the rewrite scanning for the pointing device cannot be started until the scanning for the window operation is completed up to the final scanning line address therefor. As a result, the movement of the pointing device on the display becomes non-continuous and awkward depending on the size of a window (the number of partially rewritten scanning lines).

Now, we slightly turn beck to the operation performance of a ferroelectric liquid crystal display panel per se.

For a CRT (cathode ray tube) wherein an image is formed by utilizing persistence on a fluorescent screen and a TN-type LCD (twisted nematic-type liquid crystal device) wherein an image is formed by utilizing a transmittance change depending on an effective value of driving voltage, it is necessary to use a sufficiently high frame frequency which is a frequency required for forming one picture based on their display principle. The required frame frequency is generally considered to be 30 Hz or higher. The frame frequency is expressed as the reciprocal of the product of a number of scanning lines and a horizontal scanning time for scanning each scanning line. The scanning processes or modes known at present include the interlaced scanning process (with skipping of one or more lines apart) and the non-interlaced scanning process (with no skipping). Other practical scanning processes may include the pairing process and a process comprising simultaneous and parallel scanning of divided portions of a picture screen, while the latter process is restricted to an LCD. The NTSC standard system has adopted an interlaced scanning process comprising 2 fields/frame and a frame frequency of 30 Hz, wherein the horizontal scanning time is about 63.5 μsec and the number of scanning lines is about 480 (for constituting effective display area). The TN-type LCD has generally adopted a non-interlaced system including 200–400 scanning lines and a frame frequency of 30 Hz or higher. Further, for CRT, there has been also adopted a non-interlaced scanning system using a frame frequency of 40–60 Hz and 200–1000 scanning lines.

Now, it is assumed to drive a CRT or TN-type LCD comprising 1920 (number of scanning lines)×2560 pixels. In the case of an interlaced system using a frame frequency of 30 Hz, the horizontal scanning time is about 17.5 μsec and the horizontal dot clock frequency is about 147 MHz (without consideration of horizontal flyback for CRT). In the case of CRT, the horizontal dot clock frequency of 147 MHz leads to a very high beam scanning speed which exceeds by far the maximum electron beam modulation frequency of a beam gun used in picture tubes available at present, so that accurate image formation cannot be effected even by scanning at 17.5 μsec. In the case of TN-type LCD, driving of 1920 scanning lines corresponds to a duty factor of 1/1920 which is much lower than the minimum duty factor of about 1/400 available at present, so that displaying fails. On the other hand, if driving at a practical horizontal scanning time is considered, the frame frequency becomes lower than 30 Hz so that the scanning state is visually observed and flickering is caused to remarkably impair the display quality. In this way, the enlargement and densification of a picture for CRT and TN-type LCD has been restricted so far because the number of scanning lines cannot be sufficiently increased because of restriction by the display principles and driving elements.

On the other hand, in recent years, Clark and Lagerwall have proposed a ferroelectric liquid crystal device having both a high-speed responsive characteristic and a memory characteristic (bistability).

The ferroelectric liquid crystal device shows a chiral smectic C phase (SmC*) or H phase (SmH*) in a specific temperature range, and in this state, shows a bistability, i.e., property of assuming either a first optically stable state or a second optically stable state depending on an applied electric field and retaining the resultant state in the absence of an electric field applied thereto. Further, the ferroelectric liquid crystal device shows a quick response to a change in electric field and is therefore expected to be widely used as a display device of a high speed and memory-type.

However, it is generally difficult for such a ferroelectric liquid crystal device to show an ideal bistability as proposed by Clark et al but it is liable to show a monostability. Clark et al used an alignment control method, such as application of a shearing force by relative movement or application of a magnetic field in order to realize a permanent bistability. From the viewpoint of production technique, however, it is advantageous to apply uniaxial orientation treatment, such as rubbing or oblique vapor deposition to a substrate. Such a uniaxial orientation treatment applied to a substrate for alignment control has sometimes failed to provide a permanent bistability. In the resultant alignment state failing to provide a permanent bistability, i.e., a so-called monostable alignment state, a biaxial orientation state formed under application of electric fields tends to be transformed into a uniaxial orientation state under no electric field in a period ranging from several milliseconds to several hours. For this reason, a display apparatus using such a ferroelectric liquid crystal device showing monostability has involved a problem that an image formed under application of electric fields is lost in accordance with the removal of the electric fields. Particularly in a multiplexing drive, there has been observed a problem that written states in pixels on non-addressed scanning lines are gradually lost.

In order to solve such a problem, there has been proposed a driving scheme (refreshing drive scheme) wherein pixels on a selected scanning line are selectively supplied with a voltage for providing "black" or a voltage for providing "white", the scanning lines are sequentially selected in a cycle of one frame or one field, and the cycle is repeated for writing. Such a refreshing drive scheme provides very little fluctuation in transmittance and has obviated difficulties, such as visual recognition of a writing scanning line (where a higher luminance than the other lines can be easily recognized) and occurrence of flickering under a frame frequency lower than 30 Hz. According to our study, a similar effect has been confirmed even under a low frequency as low as about 5 Hz.

The above facts can be effectively utilized to solve altogether the problems against enlargement and densification of picture arising from the above-mentioned essential requirement of CRT and TN-type LCD that a frame frequency of 30 Hz or higher is required for driving.

However, such a low-frequency refreshing drive as described above is too slow for so-called motion picture display, such as smooth scrolling or cursor movement in character compiling or on a graphic display, thus resulting in deterioration of display performances. In recent years, there have been remarkable developments in computers, peripheral circuits thereof and softwares therefor. For example, for a large picture and high density display, there has been spread a display scheme called a multi-window display scheme, wherein a plurality of pictures are displayed in superposition in a display area. A display apparatus incorporating a ferroelectric liquid crystal device is one which can afford to provide enlargement and densification of a picture area which exceeds by far those realized by a conventional display apparatus, such as a CRT and a TN-type LCD. In accordance with such enlargement and densification, there arise problems that the frame frequency is lowered, and the velocity of smooth scrolling and cursor movement is lowered even further.

As described above, a ferroelectric liquid crystal display apparatus is required to provide a smoothness in change (switching) of image data on a display. In respect of smoothness in switching of display pictures, the non-interlaced scanning is preferred, and in the ordinary CRT system, etc., the whole display area or screen is scanned by the non-interlaced scheme while a high frame frequency is adopted so as to prevent flicker.

However, because a low-frame frequency drive is adopted in the ferroelectric liquid crystal display apparatus as described above, it is not desirable to rewrite the whole picture always by the non-interlaced scanning scheme in view of maintenance of image quality (prevention of flicker).

Particularly, in the ferroelectric liquid crystal display apparatus, the above-mentioned partial rewrite scanning scheme is suited for a moving display of a mouse or cursor, or a scroll display of multi-windows. It is required to effect a smooth display of such a moving display and a scroll display, but no satisfactory system has been developed providing a good image quality by preventing a lowering in image quality and also providing an improved smoothness in moving display and scroll display.

SUMMARY OF THE INVENTION

An object of the present invention is to provide a data processing system and apparatus suitable for an image display maintaining a real-time operability as a man-machine interface of a ferroelectric liquid crystal display apparatus.

Another object of the present invention is to provide a data processing system and apparatus using a ferroelectric liquid crystal display apparatus capable of a smooth high-speed display movement of a display font from a pointing device in a scroll display window in a display picture.

Another object of the present invention is to provide a data processing system and apparatus capable of a high-speed cursor movement and mouse movement under scanning drive at a frame frequency as low as 30 Hz or below.

According to a principal aspect of the present invention, there is provided a data processing apparatus, comprising: (a) means for receiving image data having a plurality of graphic events; (b) means for controlling an image data storage memory so that the received image data is stored in the memory in the order of from a higher display priority level of the graphic events based on prescribed display priority levels of the graphic events; and (c) means for controlling the image data storage memory so that the stored image data is transferred in the order of from a higher priority level of the graphic events to drive control means.

According to another aspect of the present invention, there is provided a data processing apparatus, comprising: (a) means for controlling an image data storage memory so that received image data is stored in the image data storage memory; (b) means for serially receiving from the image data storage memory and transferring to drive control means scanning line address data for selecting a scanning line and display data for controlling display data signals applied to data lines associated with the selected scanning line; and (c) means for memorizing the scanning line address data.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

A. Signal Transfer Scheme

Figure 1:
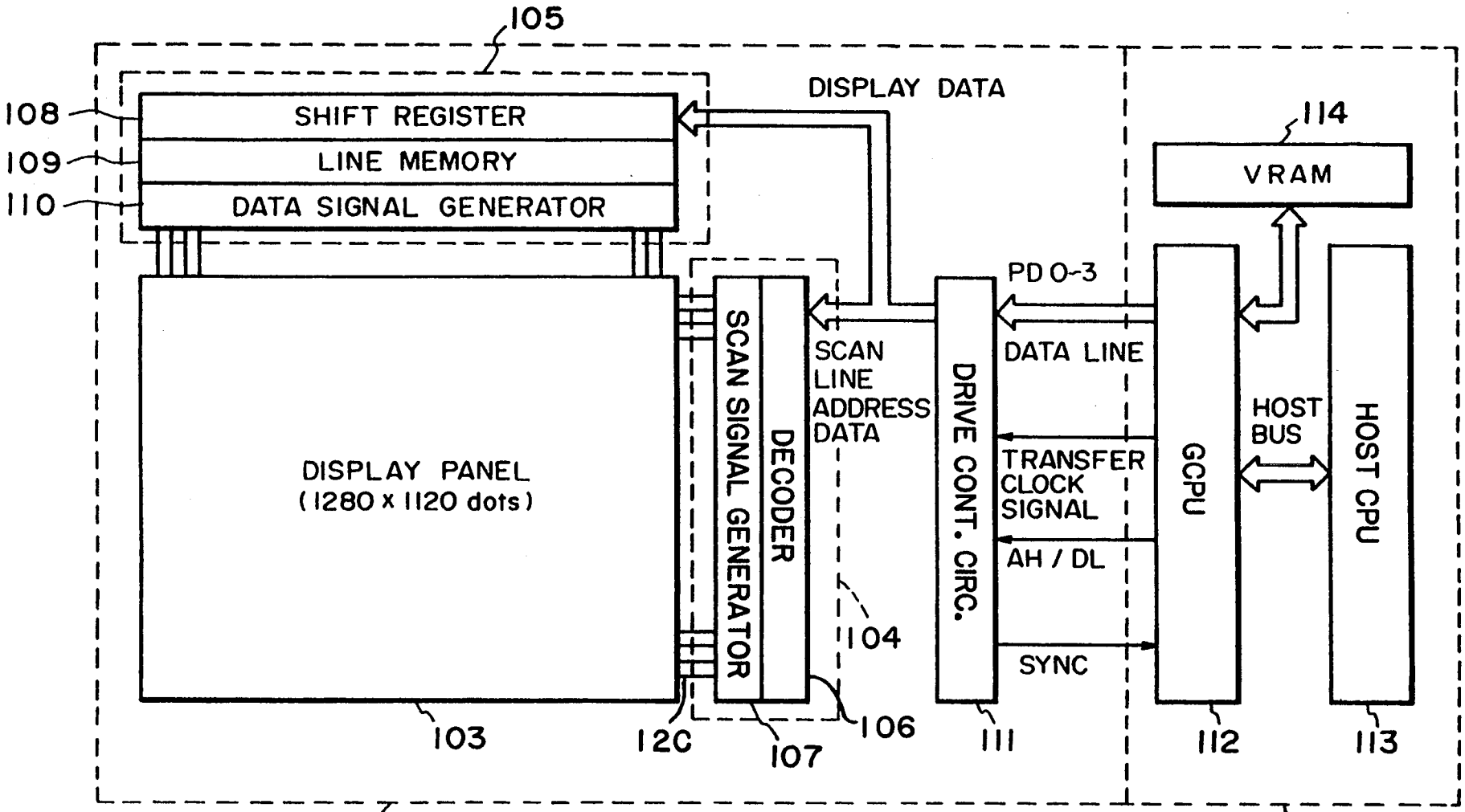
FIG. 1 is a block diagram of a liquid crystal display apparatus and a graphic controller.
Figure 2:
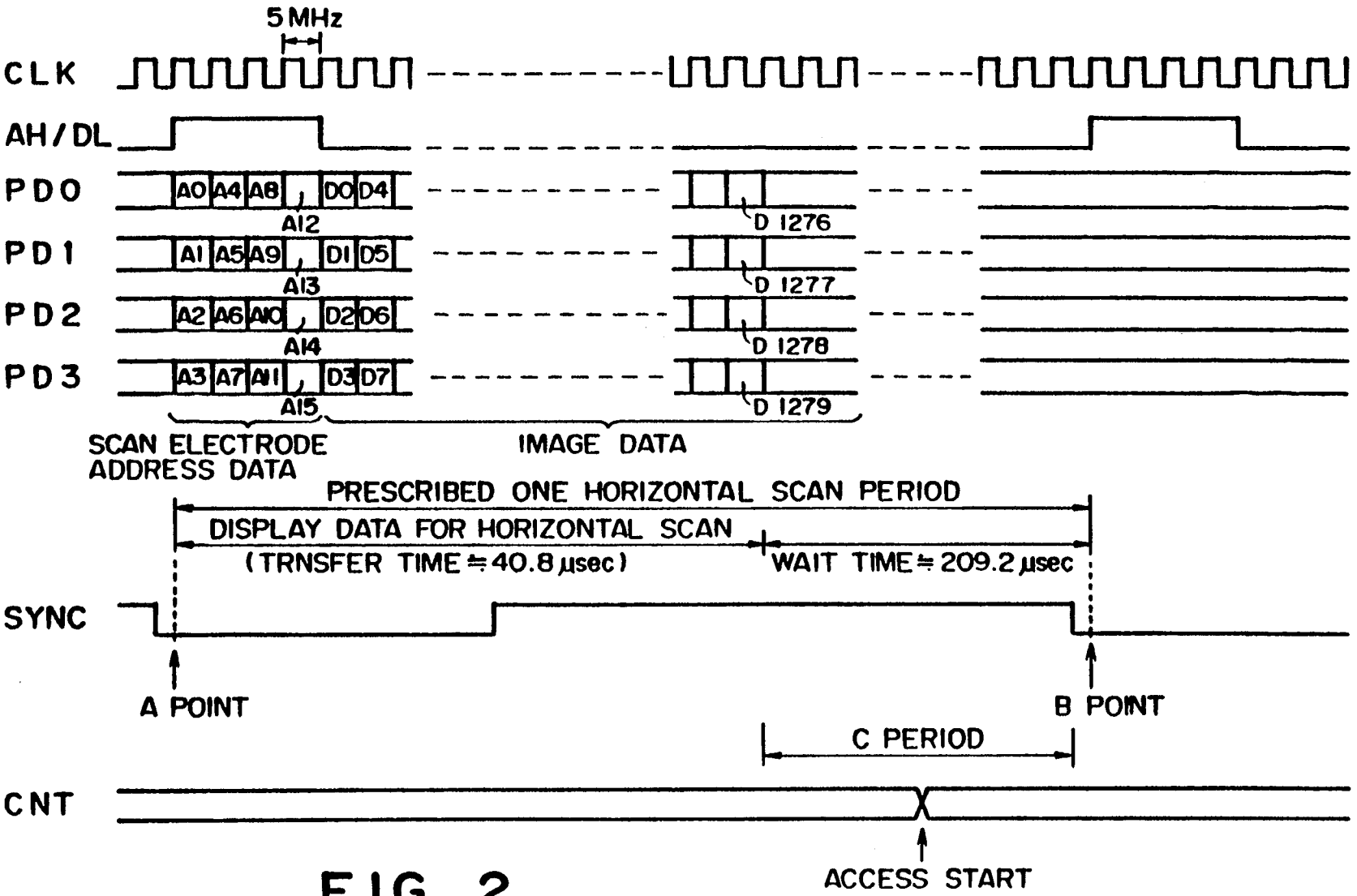
FIG. 2 is a time chart showing time correlation for image data communication between the liquid crystal display apparatus and the graphic controller.

FIG. 1 is a block diagram showing an arrangement of a ferroelectric liquid crystal display apparatus 101 and a graphic controller 102 provided in an apparatus body of, e.g., a personal computer as a source of supplying display data. FIG. 2 is a time chart for communication of image data.

A display panel 103 comprises a matrix electrode structure composed of 1120 scanning electrodes and 1280 data electrodes respectively disposed on a pair of glass plates and subjected to an aligning treatment, and a ferroelectric liquid crystal disposed between the glass substrates. The scanning electrodes (lines) and data electrodes (lines) are connected to a scanning line drive circuit 104 and a data line drive circuit 105, respectively.

Hereinbelow, the operation will be explained with reference to the figures. The graphic controller 102 supplies scanning line address data for designating a scanning line and image data (PD0–PD3) on the scanning line designated by the address data to a display drive circuit 104/105 (composed of a scanning line drive circuit 104 and a data line drive circuit 105) of the liquid crystal display apparatus 101. In this embodiment, the image data comprising the scanning line address data and the display data are transferred through the same transmission line, so that it is necessary to differentiate the above-mentioned two types of data. For the differentiation, a signal AH/DL is used. The AH/DL signal at a high level means scanning line address data, and the AH/DL signal at a low level means display data.

In the liquid crystal display apparatus 101, the scanning line address data are extracted from transferred image data PD0–PD3 by a drive control circuit 111 and then supplied to the scanning line drive circuit 104 in synchronism with a time for driving a designated scanning line. The scanning line address data are inputted to a decoder 106 in the scanning line drive circuit 104, and a designated scanning line in the display panel 103 is driven by a scanning signal generating circuit 107 with the aid of the decoder 106. On the other hand, the display data are introduced to a shift register 108 in the data line drive circuit 105 and shifted by a unit of 4 pixel data based on a transfer clock signal. When the shift of display data for one horizontal scanning line is completed by the shift register 108, the display data for 1280 pixels are transferred to a line memory disposed in parallel, memorized for a period of one horizontal scanning and are supplied to the respective data lines as display data signals through a data signal generating circuit 110.

Further, in this embodiment, the drive of the display panel 103 in the liquid crystal display apparatus 101 is not synchronized with the generation of the scanning line address data and display data in the graphic controller 102, so that it is necessary to synchronize the apparatus 101 and 102 at the time of image data transfer. A signal SYNC is in charge of the synchronization and is generated in the drive control circuit 111 in the liquid crystal display apparatus 101 at each one horizontal scanning period. The graphic controller 102 always monitors the SYNC signal, and transfers image data when the SYNC signal is at a low level and does not effect transfer after completing transfer of image data for one horizontal scanning line when the SYNC signal is at a high level. More specifically, referring to FIG. 2, the graphic controller 102 immediately sets the AH/DL signal at the high level and starts transfer of image data for one horizontal scanning line when it detects that the SYNC signal is at a low level. The drive control circuit 111 in the liquid crystal display apparatus 101 set to the SYNC signal at the high level during the image data transfer period. When the writing in the display panel 103 is completed after a prescribed one horizontal scanning period, the drive controller circuit (FLCD controller) 111 returns the SYNC signal to the low level so that it can receive image data for a subsequent scanning line.

More specifically, scanning electrode address data for addressing scanning electrodes and image data are supplied from the graphic controller 102 to the control circuit 111 through four signal lines PD0, PD1, PD2 and PD3. In this embodiment, scanning electrode address data (A0, A1, A2, . . . , A11) and image data (D0, D1, D2, D3, . . . , D1278, D1279) are transferred respectively through the same transmission signal lines PD0–PD4, so that it is necessary to differentiate the scanning electrode address data and the image data. In this embodiment, a discriminating signal AH/DL is used. The AH/DL signal at a high level means scanning electrode address data, and the AH/DL signal at a low level means image data. The AH/DL signal also contains a meaning of a transfer-initiation signal for transfer of display data.

When scanning electrode address data are supplied to the scanning electrode drive circuit 104 and image data are supplied to the data electrode drive circuit 105, the scanning electrode address data A0–A11 and the image data D0–D1279 are serially supplied through the signal lines PD0–PD3. It is necessary to provide a circuit for distributing the scanning electrode address data A0–A11 and the image data D0–D1279 or extracting the scanning electrode address data A0–A11. This operation is performed by the control circuit 111. The control circuit 111 extracts the scanning electrode address data A0–A11 supplied through the signal lines PD0–PD3, temporarily stores the data and supplies the data to the scanning electrode drive circuit 104 in a horizontal scanning period for driving a designated scanning electrode. The scanning electrode address data A0–A11 are supplied to the decoder 106 in the scanning electrode drive circuit 104 and select a scanning electrode 12C through the decoder 106.

On the other hand, the image data D0–D1279 are supplied to the shift register 108 in the data electrode drive circuit 105 and separated into image data D0–D1279 for pixels corresponding to the data electrodes (1280 lines) while being shifted for 4 pixels each by transfer clock signals CLK. When a shifting operation of the data for one horizontal scanning line is completed by the shift register 108, 1280 bits of the image data D0–D1279 in the shift register 108 are transferred to the line memory 109 and memorized therein in a horizontal scanning period. Further, in this embodiment, the drive of the display panel 103 and the generation of the scanning electrode address data A0–A11 and image data D0–D1279 in the graphic controller 102 are not synchronized, so that it is necessary to synchronize the control circuit 111 and the graphic controller 102 at the time of display data transfer. For this purpose, the synchronizing signal SYNC is generated in the control circuit for each horizontal scanning.

The signal SYNC is associated with the signal AH/DL. The graphic controller 102 always watches the signal SYNC to transfer display data when the signal SYNC is LOW and does not effect transfer after transfer of data for one horizontal scanning when the signal SYNC is HIGH. More specifically, referring to FIG. 2, at an instant when the signal SYNC is turned LOW, the AH/DL signal is turned HIGH at a point A and then the control circuit 111 returns the SYNC signal to HIGH during the display data transfer period. Then, at a point B which is one horizontal scanning period counted from the point A, the SYNC signal is returned to LOW. If the graphic controller 102 successively transfers display data at the point B, i.e., if a subsequent scanning electrode is driven, the AH/DL signal is again turned HIGH to start the transfer. Whole area refresh drive or whole display picture (area) scanning drive is performed in this embodiment, so that the drive is continuously effected line-sequentially.

The above-mentioned one horizontal scanning period (corresponding to one scanning selection period) is prescribed depending on the characteristic of the ferroelectric liquid crystal and the driving method in consideration also of optimum driving conditions. In this embodiment, the one horizontal scanning period was set to about 250 μsec at room temperature so that the frame frequency was about 10 Hz. Further, the transfer clock CLK frequency was 5 MHz, and the transfer time of the scanning electrode address data and image data was about 40.8 μsec, and the waiting time shown in FIG. 2 was 209.2 μsec. The control signal CNT is a control signal for generating a desired driving waveform. This is supplied from the control circuit 111 to the respective drive circuits 104 and 105. The time for outputting CNT is the same as the time for outputting the scanning electrode address data A0–A11 from the control circuit 111 to the scanning electrode drive circuit 104 and also the same as the time for transferring the image data in the shift register 108 to the line memory 109.

The time for outputting the CNT signal is switched at a point which is after the completion of the transfer time (40.8 μsec) from the low level-starting point (A point) of the SYNC signal and one horizontal scanning period counted from the access starting point for the previous line. In this embodiment, a C period set between the termination of the transfer time and the point (B) of a subsequent signal turning low is determined at constant.

The above communication is effected between the drive circuits 104 and 105, and also between the graphic controller 102 and the control circuit 111, and the display panel is driven according to the above time-sequence.

B. Display data Processing

Figure 3:
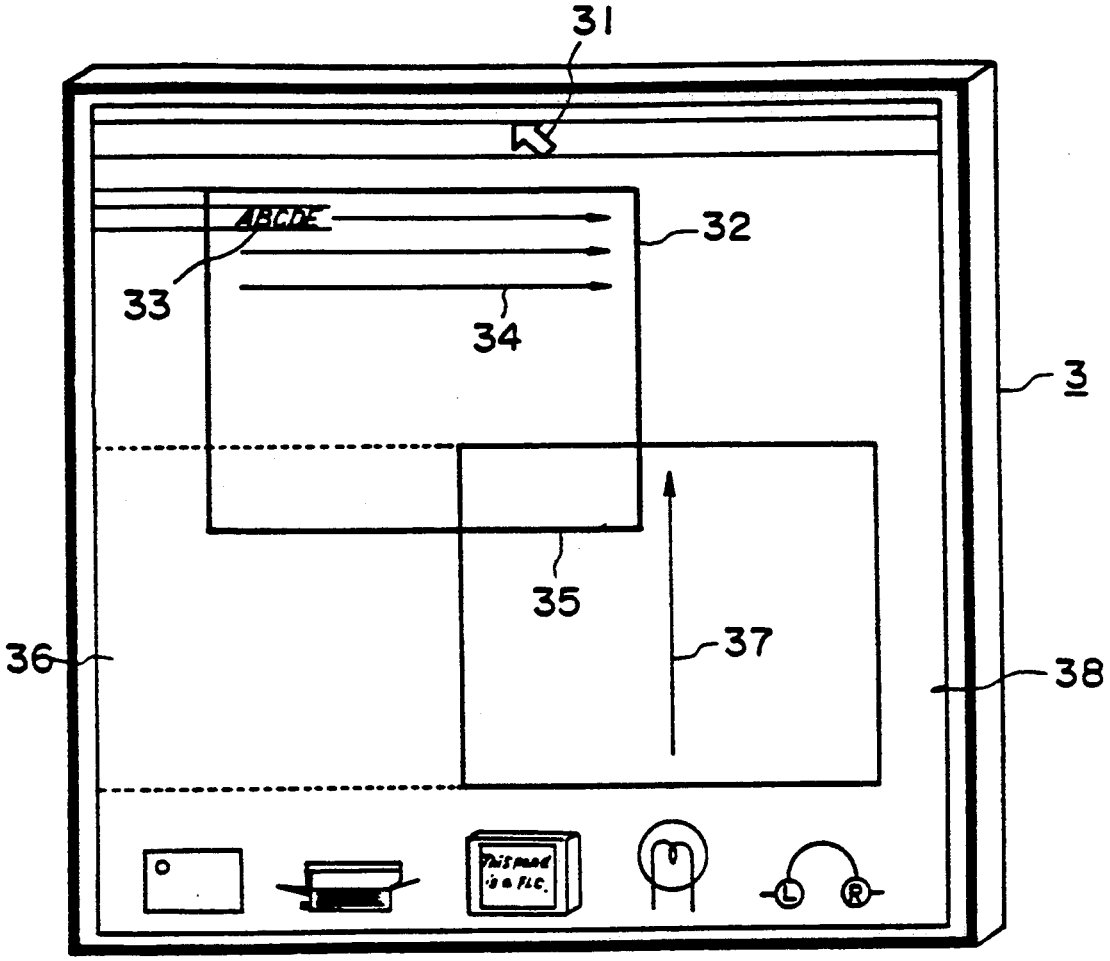
FIG. 3 is an illustrative view of a display picture schematically showing a plurality of graphic events.

FIG. 3 shows a display picture 3 when it is faced to a plurality of display demands caused for displaying display data according to multi-windows and a multi-task system.

Display demand 31: To move a mouse font or cursor smoothly in an oblique direction.

Display demand 32: To select a window as an active picture area and display it so as to overlap an already displayed window in front of the latter.

Display demand 33: To insert characters based on inputs from a key board.

Display demand 34: To move an already displayed character in the direction of an arrow.

Display demand 35: To change a display of an overlapping area.

Display demand 36: To display a non-active window.

Display demand 37: To effect a scroll display of the non-active window.

Display demand 38: To effect a whole area scanning display (or refresh).

The following Table 1 shows the priority levels of displaying graphic events corresponding to the above-mentioned display demands 31–38.

TABLE 1

| Graphic event | Drive mode | Display priority level | Write operation |
|---|---|---|---|
| 31 Mouse moving display | Partial rewriting | Highest level | |
| 32 Active window area ON | | | Logical access area |
| 33 Insertion display of characters | Partial rewriting | Second level | |
| 34 Moving display of characters | Partial rewriting | Third level | |
| 35 Overlapping area display change | | | Logical VRAM operation |
| 36 Non-active window area ON | | | Logical access area |
| 37 Non-active window area scroll display | Partial rewriting | Fourth level | |
| 38 Whole area scanning display | Multi-field refresh | Lowest level | |

In the above Table, "Partial rewriting" refers to a drive scheme wherein only the scanning lines in a partial rewriting region is scanned; "Multi-field refresh" refers to a one-frame scanning scheme wherein one frame is scanned according to a multi-interlaced scanning mode using N fields ($N=2, 4, 8, \ldots 2^N$) (described in U.S. patent application Ser. No. 271,240 and European Patent Appln. No. 88118766.0). "Display priority levels" are prescribed in advance so as to put a greater weight on the operation performance of a man-machine interface in this embodiment. Accordingly, the graphic even 31 (mouse moving display) is placed at the highest priority level, and then the graphic events 33, 34, 37 and 38 are placed at priority levels descending in that order. Further, "Write operation" refers to an internal write operation in the graphic processor.

The reason why the mouse moving display is allotted the highest display priority level is that a pointing device like a mouse is expected to reflect the operator's intention most quickly (on a real-time basis) in the computer. The next important graphic event is an input of characters from the key bard. This is generally buffered so that its priority is lower than the mouse while it still requires a high real-time characteristic. The refresh of a picture in a window as a result of the input from the key board is not necessarily required to be performed strictly simultaneously as the key-in and a higher priority is allotted to the key-in row. Relative display of scrolling in another window and an overlapping area are changed by a particular system setting and are naturally encountered in a multi-task operation. In this embodiment, the scrolling is set to be performed so as to slip under the active window.

Figure 4:
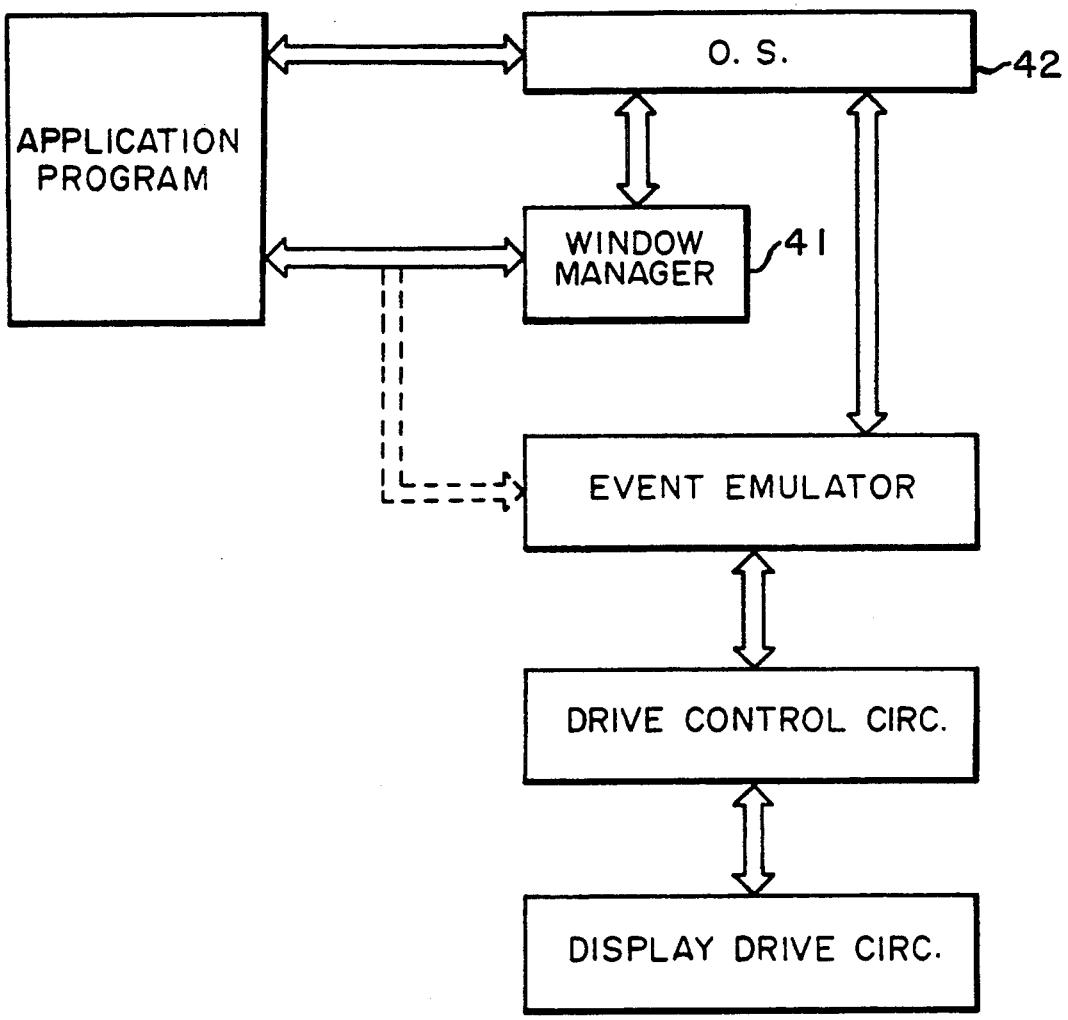
FIG. 4 is a block diagram showing a display control program used in the invention.

In the present invention, a picture display control program as shown in FIG. 4 deals with the display demands 31–38 received from the exterior through a communication sequence as shown and controls the transfer of image data to the ferroelectric liquid crystal display apparatus (FLCD) 101 shown in FIG. 1. The picture display control program, when at least one demand of rewriting an already displayed image occurs, judges the rewriting region and writing in VRAM (storage memory for image data) required for the rewriting based on the priority level thereof, and selectively transfers image data to the display apparatus 101 while taking a synchronization with the display apparatus 101.

In the communication sequence shown in FIG. 4, a window manager 41 and an operating system (OS) 42 are used. The operating system 42 may be "MS-DOS" (trade name; available from Microsoft, U.S.A.), "XENIX" (do), "UNIX" (trade name, available from AT&T, U.S.A.), or "OS/2" (trade name, available from Microsoft, U.S.A.). The window manager 41 my be "MS-Windows" ver. 1.03 or ver. 2.0 (trade name, available from Microsoft, U.S.A. ), "OS/2 Presentation Manager" (trade name, Microsoft, U.S.A.), "X-Window" in the public domain, or "DEC-Window" (trade name, available from Digital Equipment, U.S.A.). The event emulator 43 also shown in the figure may be a set of "MS-DOS & MS-Windows" or "UNIX & X-Window".

According to the partial rewriting scheme or mode used in the present invention, only the scanning lines in a partial rewriting region are scanned, a high-speed partial rewriting can be effected because of a memory characteristic of FLCD. Further, in the present invention, it is assumed that not so many display data in a whole picture are required to be rewritten instantaneously and at high speeds by a computer system. For example, a rate of 30 Hz or less is sufficient for displaying data from a pointing device such as a mouse, and a higher speed cannot be followed by human eyes. Similarly, smooth scrolling (scrolling of each line) requiring the highest speed display cannot be followed either if it is too fast. Scrolling is rather performed not for each line but for each character or each integrated block. In a computer system, scrolling is frequently used at the time of programming or sentence edition or revision, and the object thereof is to effect a moving display from one row to another rather than a strictly smooth scroll, so that a moving speed of about 10 rows/sec is practically of no problem.

In case where a mouse font is composed of 32×32 dots and the partial rewriting scan thereof is effected by the non-interlaced mode in an FLC, a simple calculation would provide a response speed as follows:

$$32 \text{ lines} \times 100\ \mu\text{sec/line} = 3.2 \text{ msec} \rightarrow 312 \text{ Ha.} \quad \text{[Eq. 1]}$$

On the other hand, a row scrolling at a rate of 10 rows/sec corresponds to a refresh speed at a frequency of 10 Hz according to the non-interlaced mode. A frequency of 10 Hz is considered to provide a noticeable flicker in a strict sense, but it practically provides no problem because the entire picture moves with a row as a unit and display data more appeals to eyes than flicker. As a result, the number of scanning lines which can be driven according to the non-interlaced mode in case of a row-unit basis scrolling is given by the following equation.

$$(1/10 \text{ Hz})/100\ \mu\text{sec} = 1000 \text{ lines} \quad \text{[Eq. 2]}$$

Based on the arrangement and data format comprising image data accompanied with scanning line address data and by adopting communication synchronization using a SYNC signal as shown in FIGS. 1 and 2, the present invention realizes a liquid crystal display apparatus driven based on a partial rewriting scanning algorithm as described below.

Image data are generated in the graphic controller 102 in an apparatus body and transferred to the display panel 103 by signal transfer means shown in FIGS. 1 and 2. The graphic controller 102 principally comprises a CPU (central processing unit, hereinafter referred to as "GCPU") 112 and a VRAM (video-RAM, image data storage memory) 114 and is in charge of management and communication of image data between a host CPU 113 and the liquid crystal display apparatus (FLCD) 101. The control method according to the present invention is principally realized in the graphic controller 102.

Figures 1, 9A:
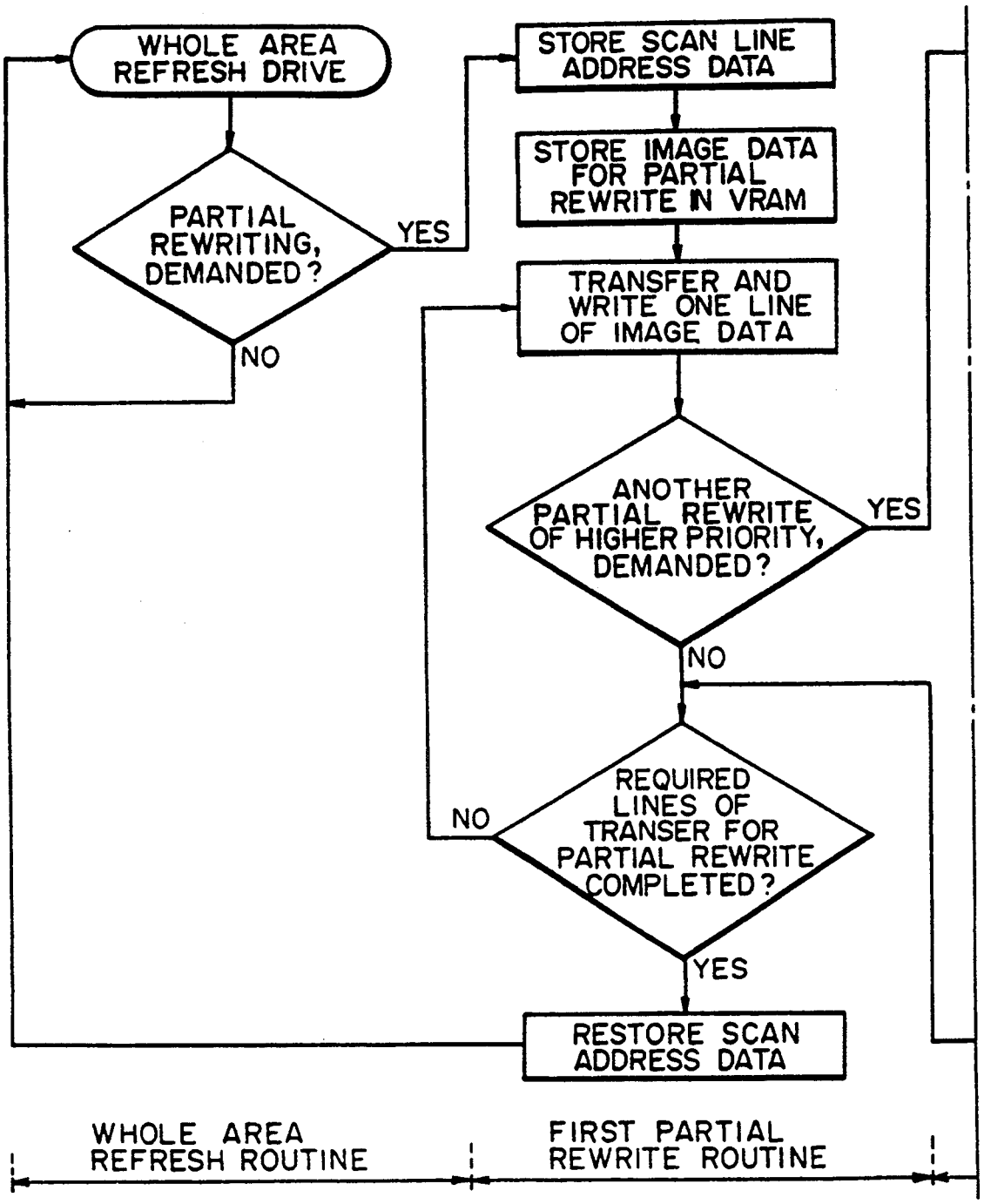
FIGS. 9A–9E, 9J and 16 are sequence diagrams showing an algorithm for partial rewriting used in the invention.
Figure 9A:
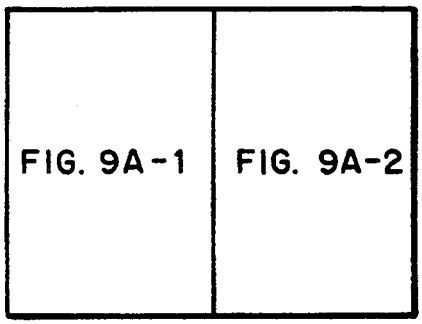
Figures 2, 9A:
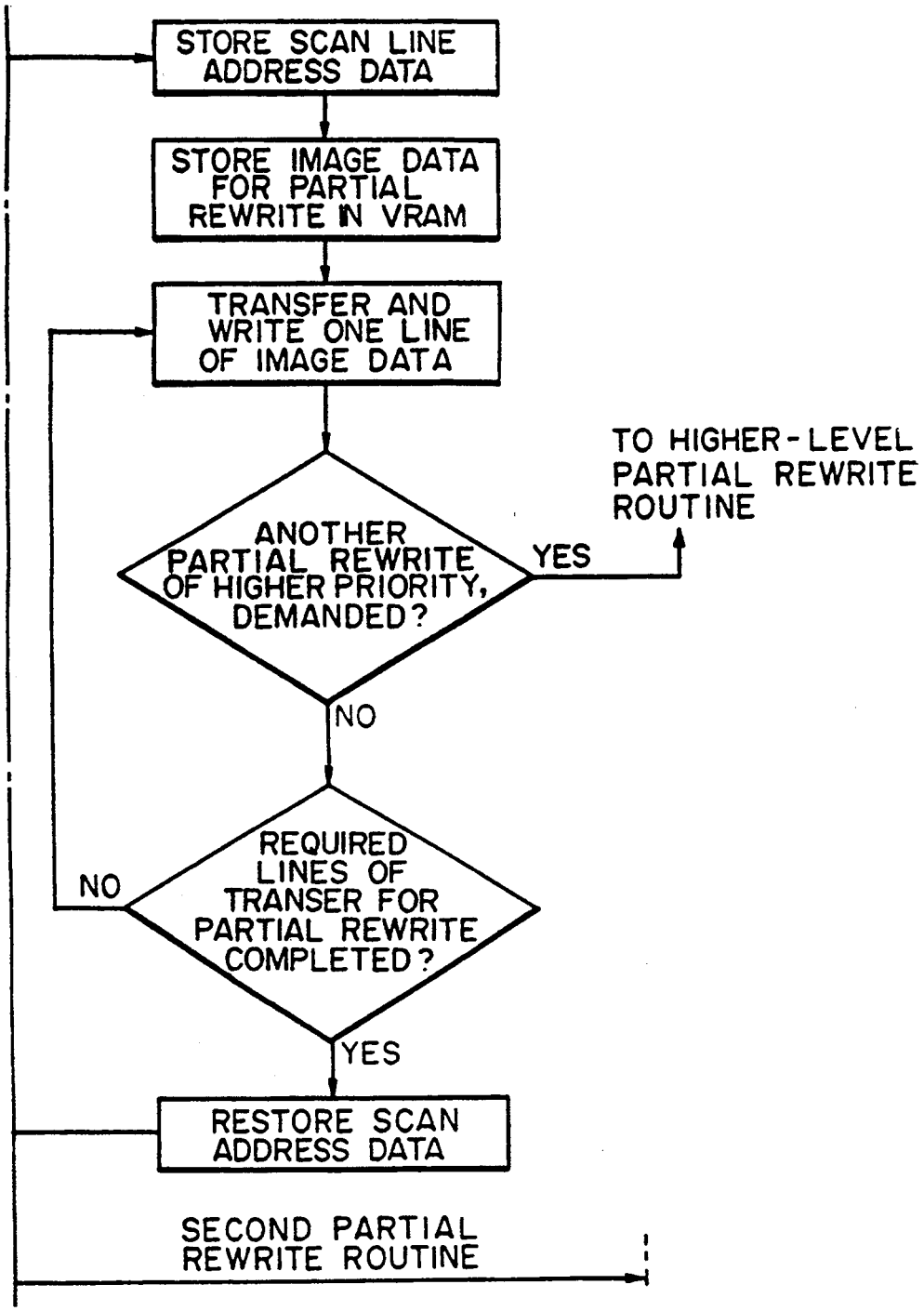

FIG. 9A shows a partial rewriting algorithm according to the present invention. Display data (as from a pointing device or pop-up menu) requiring partial rewriting on the FLCD 101 are registered in advance in the GCPU 112, and if partial rewriting is Judged to be necessary with respect to data from the host CPU 113, a partial rewriting routine is started. In the partial rewriting routine, scanning line address data and the number of scanning lines immediately before the branching are first sheltered (stored) in a register preliminarily provided in GCPU 112. When the image data necessary for rewriting from the host CPU 113 are stored in VRAM 114 in the graphic controller 102, GCPU 112 manages the storage starting address and storage region, and the image data are transferred to the liquid crystal display apparatus 101 according to the signal transfer scheme shown in FIGS. 1 and 2 for the partial rewriting operation.

Figure 10:
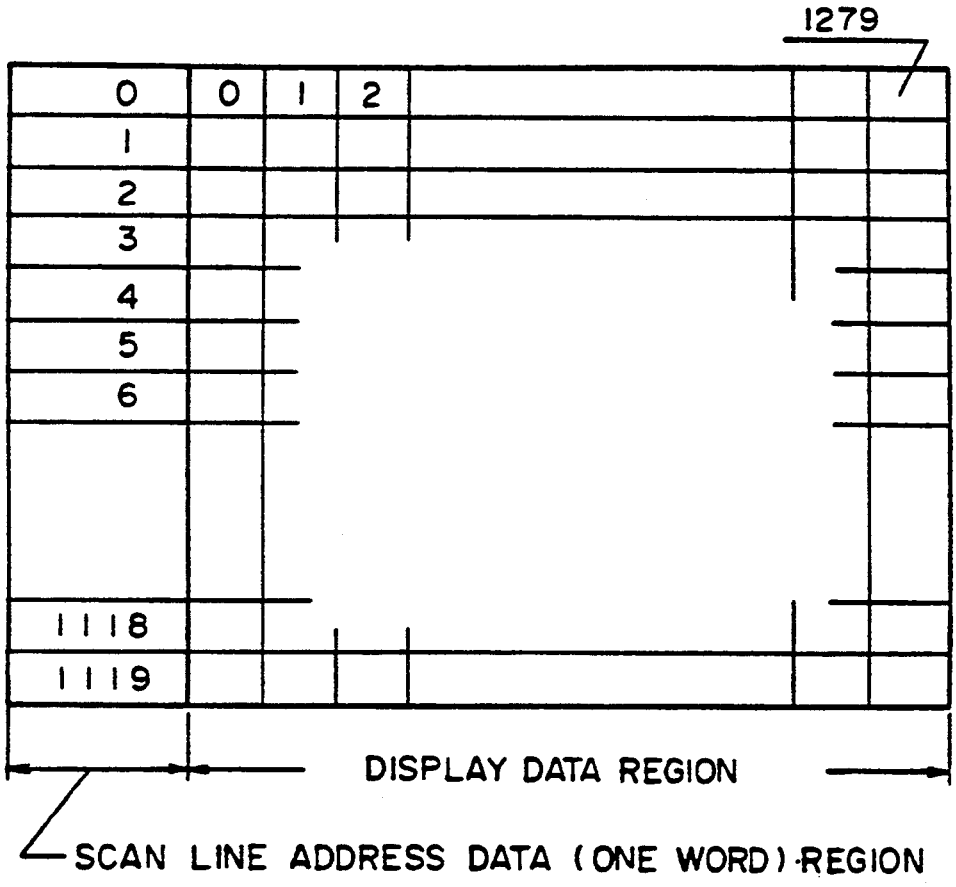
FIG. 10 is a schematic data map showing scanning address data and display data in VRAM used in the invention.

In order to formulate a data format comprising image data accompanied with scanning line address data, the scanning line address data is disposed in VRAM 114 as shown in FIG. 10. VRAM 114 is divided into two regions, one of which is allocated as a scanning line address data region and the other of which is allocated as a display data region. The image data is disposed laterally for one line and the scanning line address data is disposed in advance at the leading head (left side) of the image data for one line, so that the data bits on the VRAM 114 correspond to the pixels on the display panel 103 one-to-one. GCPU 112 reads out the data from the left side of VRAM 114 for each line as a unit and supplies the same to the liquid crystal display apparatus 101 and so formulates a data format comprising image data led by the scanning line address data.

The transfer to the liquid crystal display apparatus 101 is performed for each line as a unit under the continual management by GCPU 112 of the scanning line address data and the number of transferred scanning lines mapped on the VRAM 114. After each transfer of one line, it is judged whether another partial rewriting demand has occurred. If a second partial rewriting has been demanded at that time and the image data demanded for partial rewriting have a lower display priority level than that of rewriting data under processing, the transfer for a subsequent scanning line is performed as it is. If the new image data has a higher priority level, the data transfer of the first rewriting data under way is interrupted and branched into a second partial rewriting routine. In the second partial rewriting routine, similarly as in the first partial rewriting routine, scanning line address data and the number of scanning lines immediately before the branching are first sheltered in a register provided in advance in GCPU 112. Thereafter, the second partial rewriting data is stored on VRAM 114 and is supplied to the display apparatus 101 for one line each as a unit. After the transfer for each line, it is checked whether another partial rewriting of a higher display priority has been demanded or not. If not demanded, the image data for the whole area for the second partial rewriting is continually transferred, and thereafter, the first rewriting routine is resumed based on the scanning line address data and the number of scanning lines which have been sheltered at the time of branching into the second partial rewriting routine. In the first rewriting routine, the transfer of the remaining image data is continued while it is checked for each line of transfer whether another rewriting of a higher priority level has been demanded or not. After the completion of the transfer of the total image data, the scanning line address data and the number of scanning lines sheltered at the outset are restored, and an ordinary refresh routine is resumed.

Figures 1, 9B:
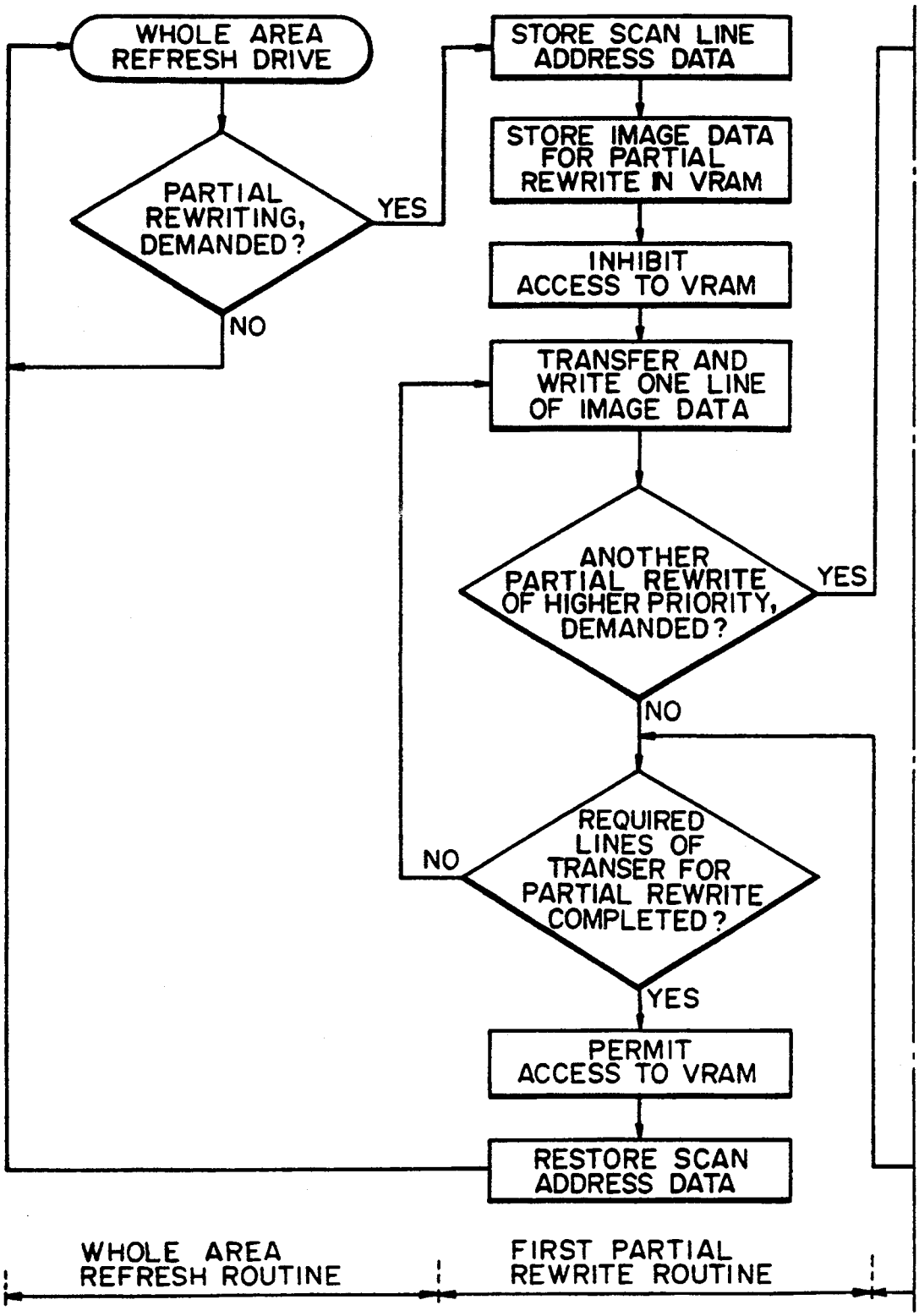
Figures 2, 9B:
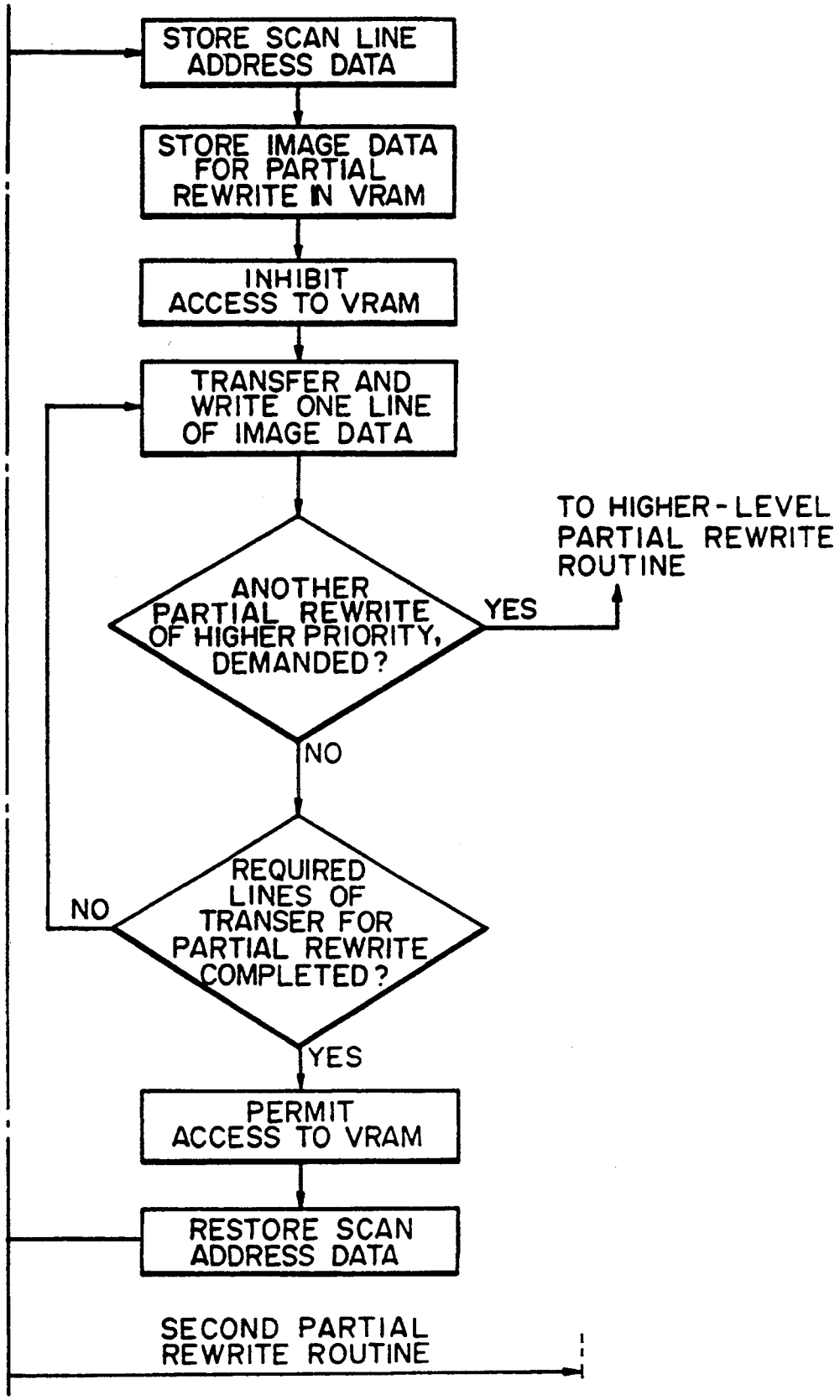

FIG. 9B shows a data processing routine comprising: (a) a step of controlling an image data storage memory so that received image data is stored in the image data storage memory, and (b) a step of controlling the image data storage memory so that the memory is inhibited to store image data during a period for partial rewriting scanning of a display panel; and particularly a data processing routine comprising: (a) a step of receiving image data having a plurality of graphic events including a first and a second graphic event; (b) a step of controlling an image data storage memory so that the received image data is stored in the memory in the order of from a higher display priority level of the graphic events based on prescribed display priority levels of the graphic events allocating a higher display priority level to the first graphic event than to the second graphic event; and (c) a step of controlling the image data storage memory so that image data having the second graphic event stored in the memory is outputted from the memory in a period until image data having the first graphic event is started to be stored in the memory.

In other view, FIG. 9B also shows a data processing routine comprising: (a) a step of receiving image data having a first and a second graphic event; (b) a step of controlling an image data storage memory so that the memory stores the image data in the order of from the first graphic event to the second graphic event based on prescribed display priority levels of the graphic events allocating a higher display priority level to the first graphic event than to the second graphic event, and (c) a step of controlling the image data storage memory so that the storage of image data having the second graphic event is inhibited during a period when image data having the first graphic event is outputted from the memory.

According to the algorithm shown in FIG. 9B, display data (as from a pointing device or pop-up menu) requiring partial rewriting on FLCD 101 is registered in advance in GCPU 112, and if the image data is judged to require partial rewriting with respect to data from the host CPU 113, a partial rewriting routine is started. In the partial rewriting routine, scanning line address data and the number of scanning lines immediately before the branching are first sheltered in a register preliminarily provided in GCPU 112 in order to provide data for resuming an ordinary refresh routine after completion of the partial rewriting routine. Then, image data accompanying the partial rewriting is stored in VRAM 114. In this regard, the host CPU 113 is allowed to access VRAM 114 only through CPU 112, so that GCPU 112 manages the starting address and region of storage of image data concerning the partial rewriting in VRAM 114.

After completion of the storage of image data in VRAM 114, the access to VRAM 114 is immediately inhibited, and the transfer of the image data to the liquid crystal display apparatus 101 is started. The transfer to the liquid crystal display apparatus 101 is performed for each line as a unit according to a signal transfer scheme similar to that shown in FIGS. 1 and 2 while GCPU 112 always watches the scanning line address data mapped on VRAM 114. GCPU 112 does not permit VRAM 114 to store new image data in VRAM 114 until the transfer of all the image data concerning one partial rewriting is completed. In this instance, an application program (software) in the host CPU 113 is not conscious of the inhibition of storage in VRAM 114 but is allowed to issue a rewriting demand to GCPU 112. Accordingly, no status signal line for inhibiting the action of the host CPU 113 from GCPU 112 is provided. Thus, GCPU 112 is always passive as viewed from the host CPU 113, and a series of algorithm of "taking a synchronization between the partial rewriting scanning of the display panel and the storage of image data in VRAM 114" is all processed in GCPU 112.

After each transfer of one line, it is checked whether another partial rewriting demand having a display priority level higher than that of the partial rewriting under processing has occurred, and only when a partial rewriting demand of image data with a higher priority level occurs, VRAM 114 is allowed to store the image data. In other words, in case where a partial rewriting of a higher priority level occurs during the process of a partial rewriting scanning, the expansion in VRAM 114 is inhibited only during a period in which the partial rewriting under way is processing image data with the highest display priority level at that time.

Figure 9C:
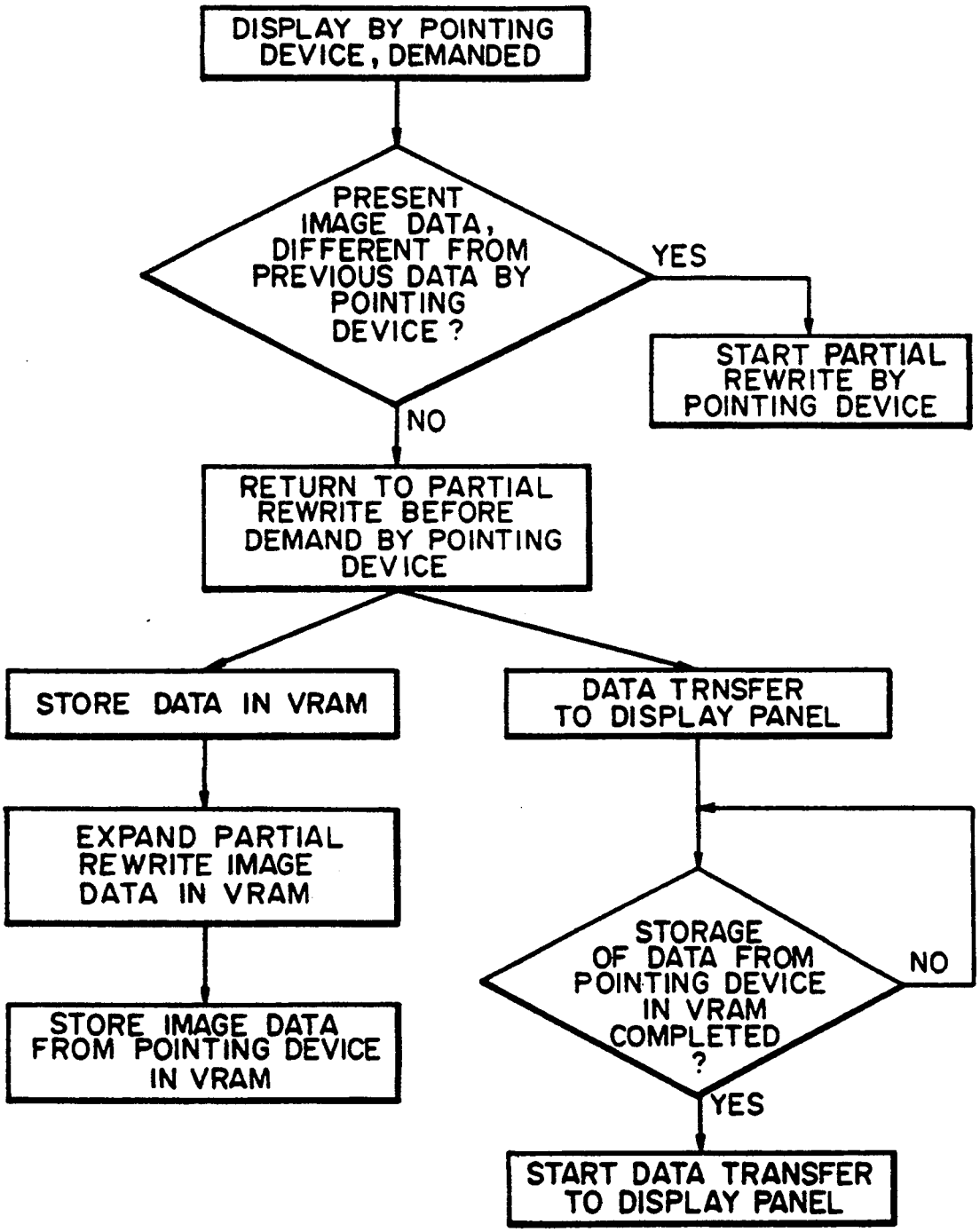
Figure 9D:
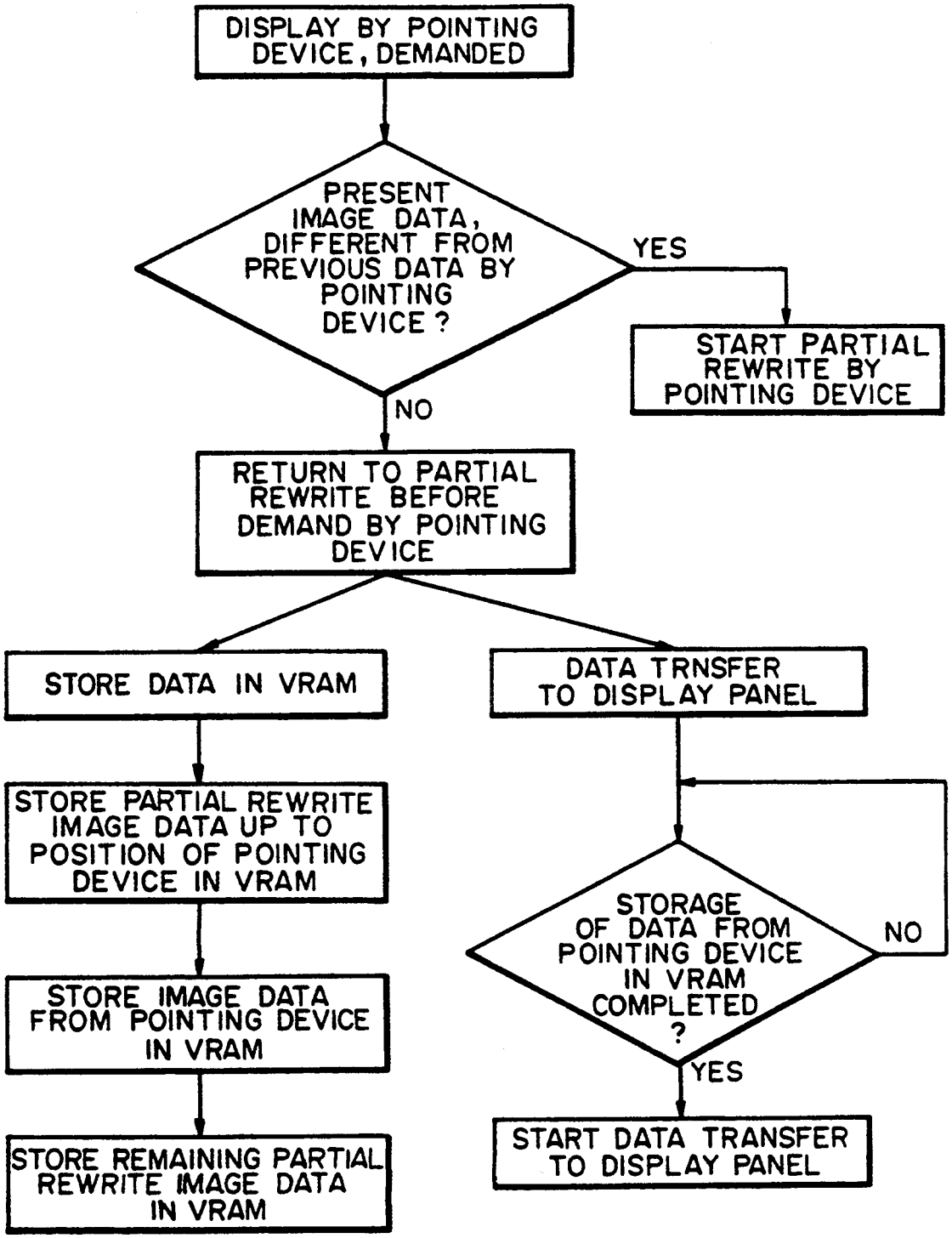

FIGS. 9C and 9D show a data processing routine using an image data storage memory for storing first graphic event data and second graphic event data having different frequencies of rewriting from each other, and including a step of controlling the image data storage memory so that the second graphic data having a lower frequency of rewriting is started to be transferred within a prescribed period; and particularly a data processing routine using an image data storage memory for storing image including periodically supplied first graphic event data and second graphic event data, and including a step of controlling the image data storage memory so that the memory stores the first graphic event data preferentially while inhibiting the storage of the second graphic event data based on prescribed display priority levels allocating a higher display priority to the first graphic event than the second graphic event, the inhibition of the storage of the second graphic event data is released when the first graphic event data causes no change in content, and the second graphic event data is started to be transferred in a prescribed period.

FIG. 9C shows a process flow chart by which, when a demand from a pointing device at a certain cycle (e.g., writing of font data supplied at a cycle of 30 Hz) occurs in the course of a partial rewriting (e.g., scroll display writing in a window on a display panel, the commencement of the transfer of the scroll display data in the window is delayed. In case where a display demand at a certain cycle from a pointing device occurs in the course of partial writing, GCPU 112 compares the previous font data and the current font data, and if no difference is present, the partial writing scheme prior to the font display demand by the pointing device is resumed, and the data storage in VRAM 114 and the data transfer to the display panel are simultaneously started. As for the data storage in VRAM 114, partial writing scroll image data is continually stored in VRAM 114, and if the font of the pointing device stops in the region, the display font is erased. For this reason, the image data of the pointing device is further stored in VRAM 114. On the other hand, as for the data transfer to the display panel, GCPU 112 watches the storage of the image data of the pointing device in VRAM 114, and if the storage is completed, the data transfer to the display panel is started.

FIG. 9D shows a process flow chart by which, when a demand from a pointing device at a certain cycle occurs in the course of scroll image partial writing, the data transfer commencement is delayed depending on the position of the pointing device. In case where a display demand at a certain cycle from a pointing device occurs in the course of partial writing, when GCPU 112 judges no change in image data, the scroll image partial writing before the display demand by the pointing device is resumed, and the data storage in VRAM 114 and the data transfer to the display panel 114 are simultaneously started. As for the data storage in VRAM 114, the storage of the partial writing image data in VRAM 114 is continued up to the position where the pointing device stops, and if the font of the pointing device stops in the region, the display font is erased. In order to avoid this, the image data of the pointing device is further stored in VRAM 114. Then, the remaining data for the partial rewriting are stored in VRAM 114. On the other hand, as for the data transfer to the display panel, GCPU 112 watches the storage of the image data of the pointing device, and if the storage is completed, the data transfer to the display panel is started.

If GCPU 112 having the above function is used for partial writing on a ferroelectric liquid crystal display apparatus 101 under a low-frame frequency refresh drive in the present invention and if image sent from the apparatus body at a certain cycle like those from a pointing device are partially written at every occasion of the demand, another partial writing is caused to take a long time. More specifically, in case of a CRT, storage in VRAM and display are performed non-synchronously, so that no problem arises even if image data is supplied at a certain cycle. In case of a ferroelectric liquid crystal display apparatus however wherein a region of varied image data is partially written while taking a synchronization between the storage of image data and the data transfer, another display time is affected to result in a lower display speed if image data is supplied at a certain cycle. Accordingly, in case where image data is supplied at a constant cycle like, e.g., font data supplied at a cycle of 30 Hz, the previous data is stored in a memory and compared with the current data by GCPU 112, and if they are not different, the partial writing of the data is omitted. For example, when a display demand of a pointing device occurs at a constant cycle, GCPU 112 is caused to watch the previous image data and the current image data, and if no change is observed, the partial writing of the pointing device is omitted. Then, the partial writing process before the display demand of the pointing device is resumed, and the storage of the partial writing image data in VRAM 114 is continued. In the ferroelectric liquid crystal display apparatus 101, however, the data storage in VRAM 114 and the data transfer are synchronized and started simultaneously, so that if the pointing device data is stored in VRAM 114 after the partial writing image data is stored in VRAM 114, it is possible that the data of the pointing device before the storage is already transferred to the display panel 103 depending on the position where the pointing device stops. This problem has been solved by delaying the data transfer by GCPU 112 until the completion of the data storage of the pointing device.

Figure 9E:
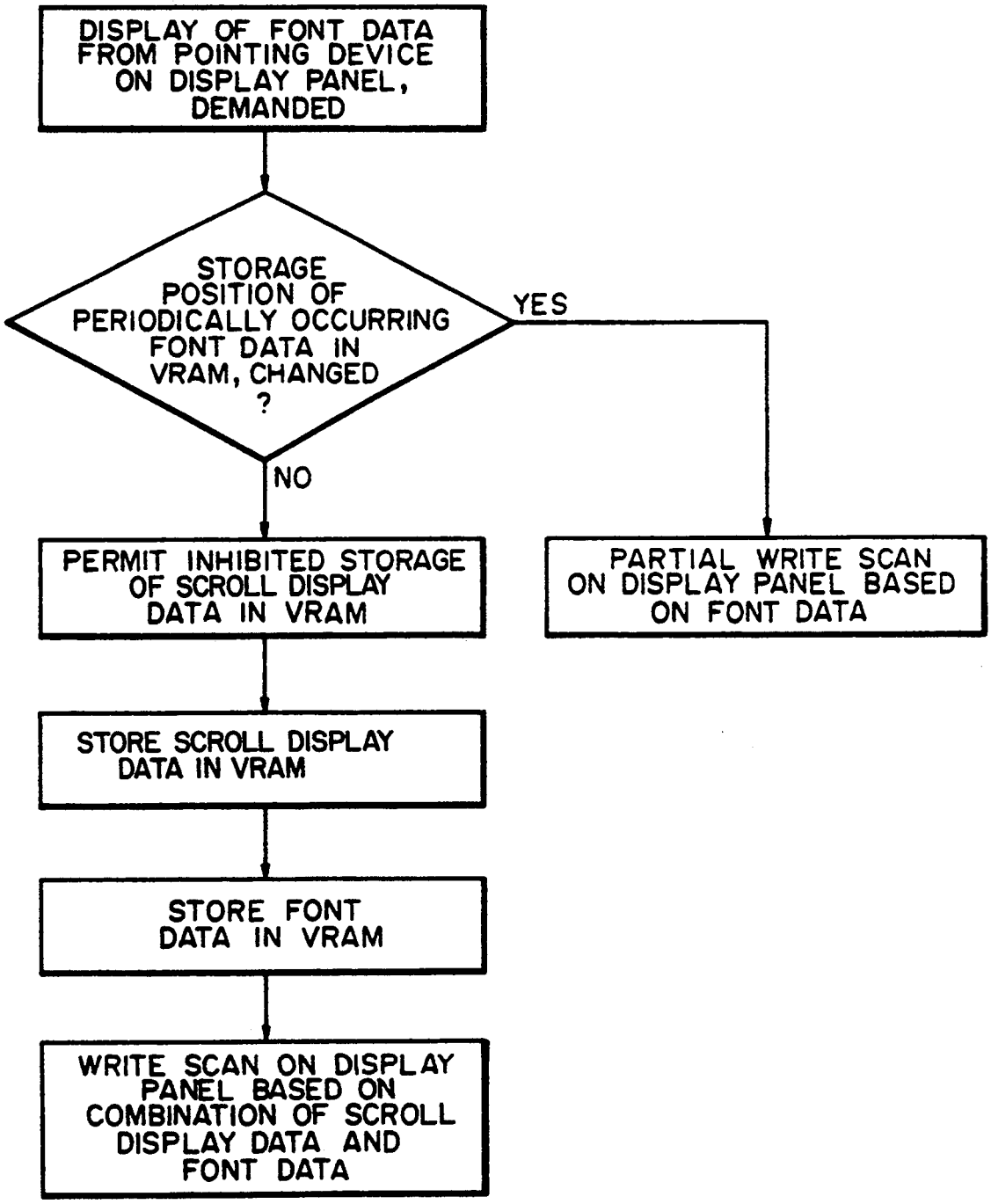

FIG. 9E shows a data processing routine using an image data storage memory for storing image data including periodically supplied image data having a first graphic event and image data having a second graphic event, and including a step of controlling the image data storage memory so that the memory stores image data having the first graphic event preferentially while inhibiting the storage of image data having the second graphic event based on prescribed display priority levels allocating a higher display priority to the first graphic event than to the second graphic event and that the inhibition of the storage of image data having the second graphic event is released when the image data having the first graphic event causes no change in content.

In other words, FIG. 9E shows an algorithm to be followed when font data is supplied at a cycle of 30 Hz from a pointing device while scroll display data are stored in VRAM and the font data cause no change in storage position thereof in VRAM. In case where the font data from the pointing device has caused a change in storage position in VRAM, the partial scanning writing in the display panel is performed according to the algorithm shown in FIG. 9B.

In case where the font data from the pointing device cause no change in storage position in VRAM, the inhibition of the access to (i.e., storage in) VRAM with respect to scroll display data is released, and the scroll data is stored in VRAM. At this time, font data from the pointing device is periodically stored in VRAM so that the display panel is written by scanning based on combined data of the scroll display data and the font data. In this instance, when the scroll display data is for a display in a window, a partial writing in the window is performed.

Figure 9H:
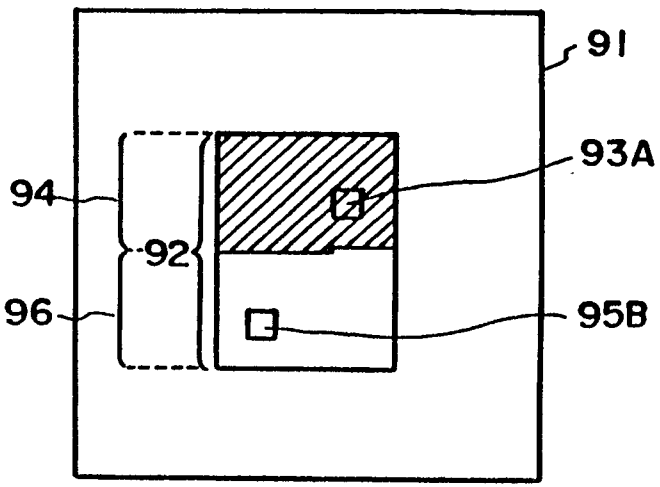
FIGS. 9F–9I are schematic views showing relative positions between previous and new font data positions in VRAM.
Figure 9I:
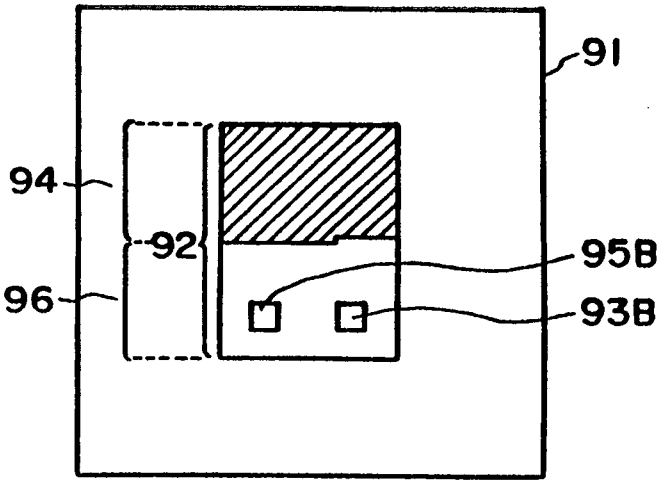
Figure 9F:
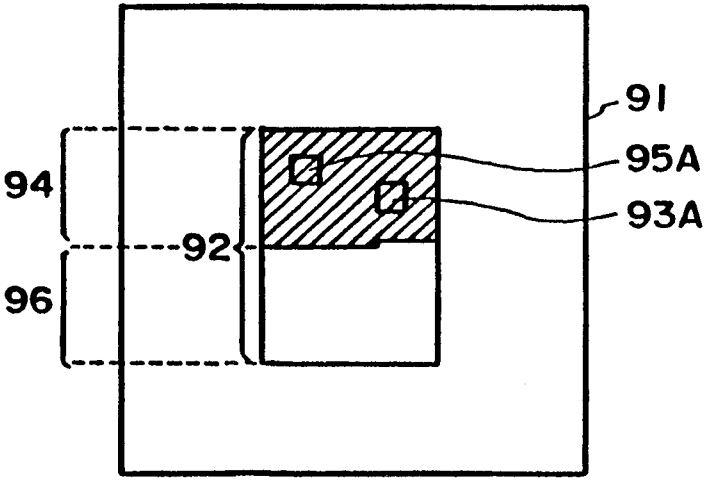
Figure 9G:
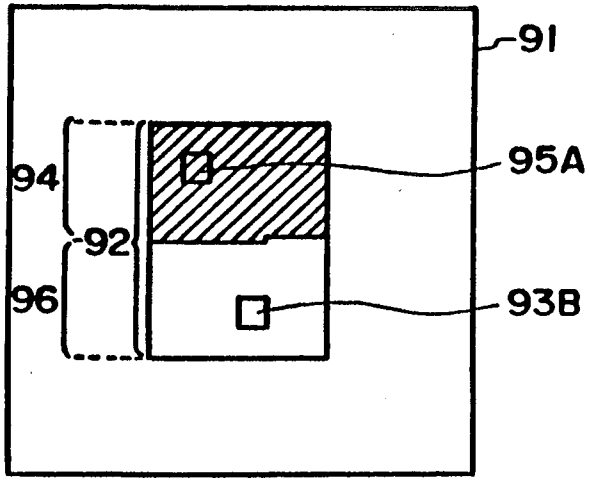
Figures 1, 9J:
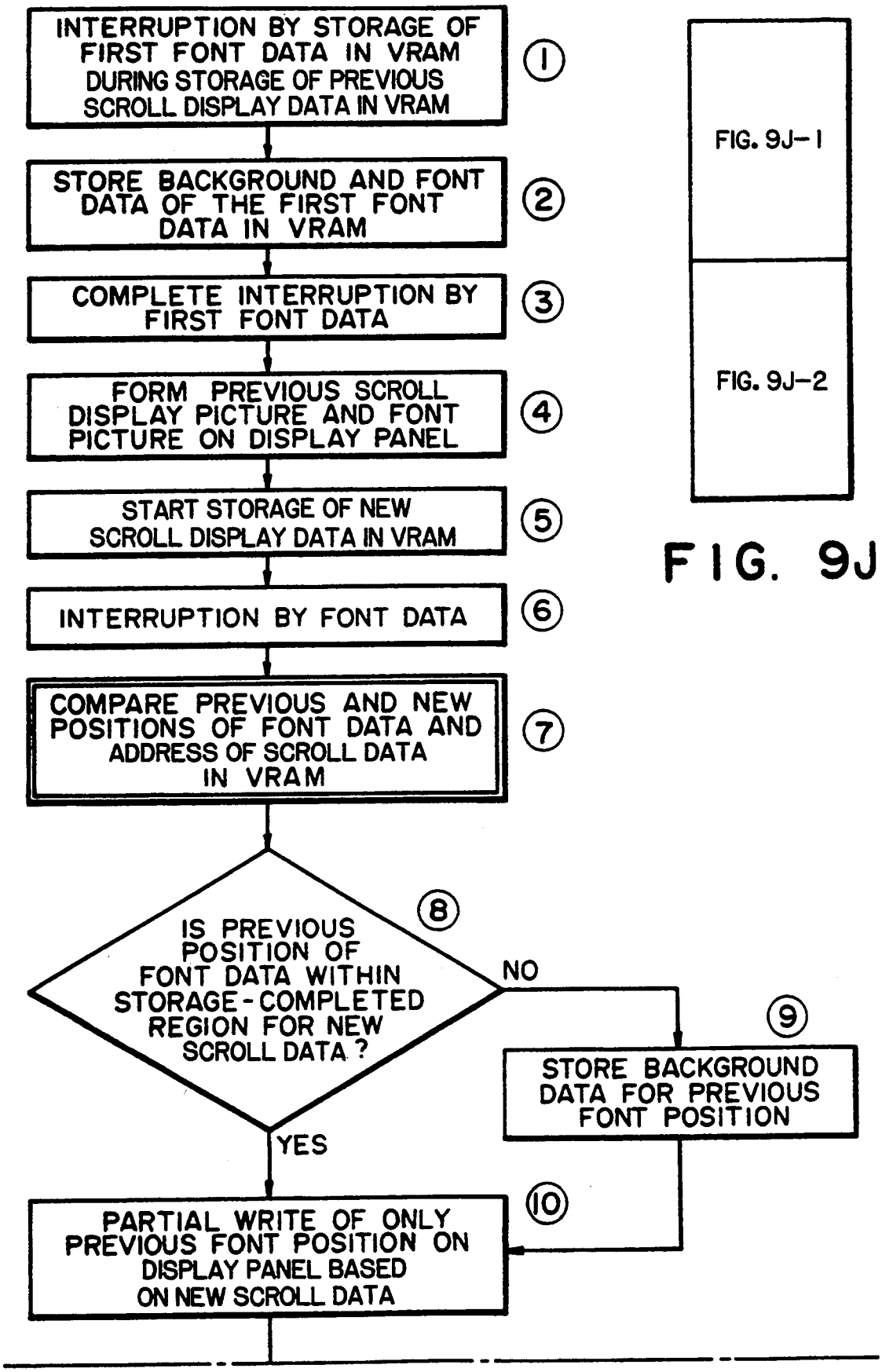
Figures 2, 9J:
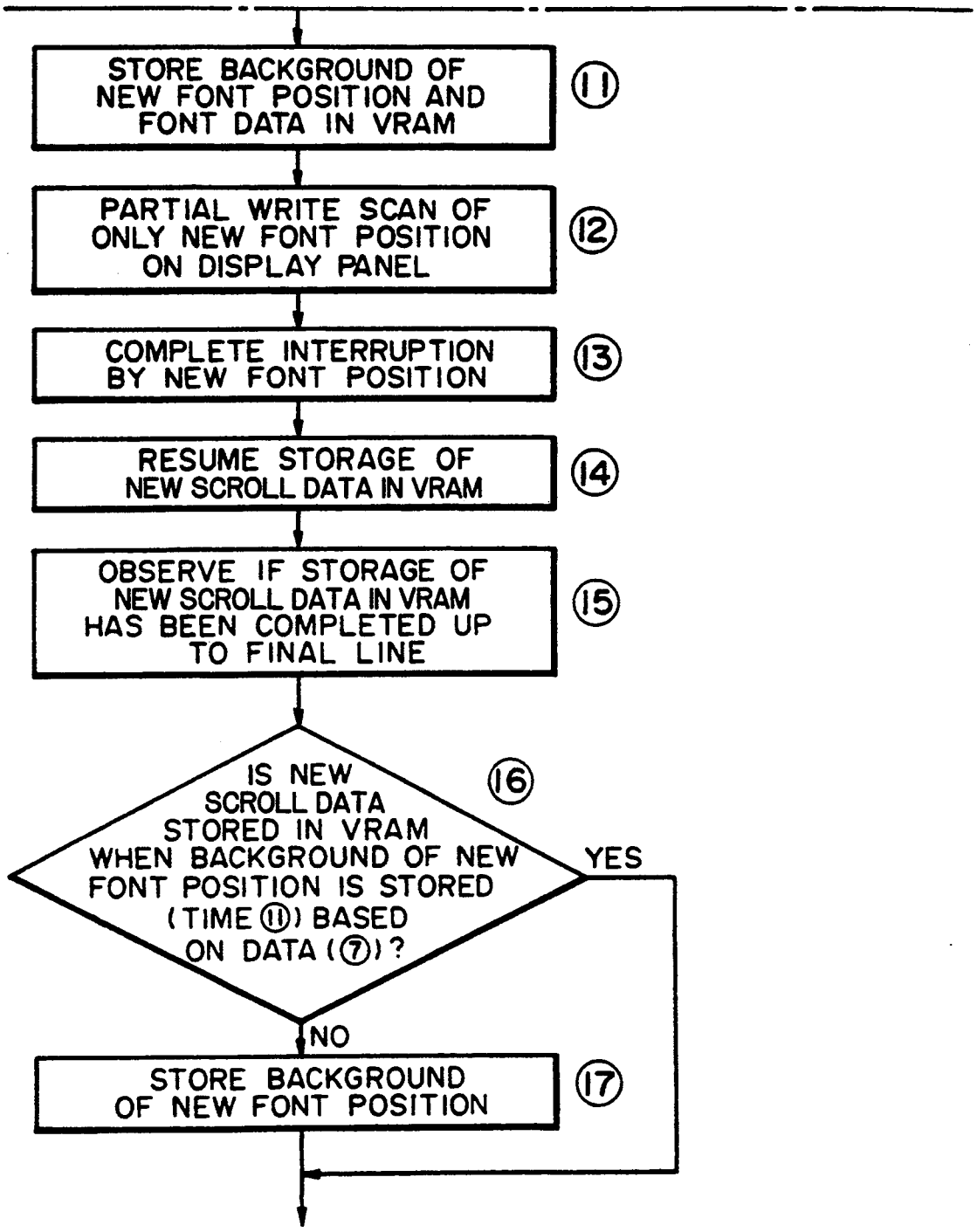

FIG. 9J shows a data processing routine using an image data storage memory for storing image data including scroll display data and moving or movable display data, and including a step of Judging the position of the font display data when, during storage of the scroll display data in the memory, a demand occurs for interrupting the storage of the scroll display data to store the font display data, as to whether or not the font display data position at the time of the interruption is within a region in the image data storage memory where the storage of the scroll display data has been completed; and more specifically a data processing routine using an image data storage memory for storing image data including scroll display data and moving font display data, and including a step of Judging the position of the font display data when, during storage of the scroll display data, a demand occurs for interrupting the storage of the scroll display data to store the font display data and the font display data has already been stored at another position, as to whether said another font display position is within a region in the image data storage memory where the storage of the scroll display data has been completed.

FIG. 9F–9I schematically illustrate states of data storage in VRAM. A region 91 in VRAM is a region corresponding to an entire area of a display panel, and a region 92 corresponds to a window for scroll display in the display panel. The steps ① - ⑩ in FIG. 9J refer to an algorithm to be followed depending on whether a previous font data position is present in a region 94 where the storage of scroll display data has been completed or in a region 96 where the storage of scroll display data is not yet performed. A previous font data position 93A is Judged by comparison as to whether it is within the scroll data storage completed region 94 (hatched region in the figure). In case where the position 93A is within the region 94 (FIG. 9F or 9H), if the background data (or shadow data, i.e., scroll display data replaced by the font data concerned) at the previous font data position 93A is restored, only the position is occupied by the old data to provide a disordered image. Therefore, in this case, the background data at the previous font position is not stored. In case where a previous font position 93B is within the scroll non-completed region 96 (FIG. 9G or 9I), the position is rewritten by the background data stored outside the region 91, and the display panel is subjected to partial rewriting based on the background data. Then, new font data is stored in VRAM. In this instance, if the font data is stored in VRAM, the font data is treated as partial rewriting data of a high display priority level, and the storage of scroll display data in VRAM is inhibited. The algorithm to be followed at this time has been explained with reference to FIG. 9B hereinbefore.

Steps ⑪ - ⑰ of FIG. 9J refer to an algorithm to be followed depending on a new font data position is present within a scroll data storage-completed region or non-completed region. In case where the new font data position 95B is within a scroll data storage non-completed region 96 as shown in FIG. 9H or 9I, the new font position 95B is prior to rewriting in VRAM by new scroll data, and the already stored background data is an old one before rewriting. Accordingly, after the storage of new scroll display data is completed up to the final line, the background data at the new font position is again stored based on the new scroll data (operation according the branching of "NO" in response to the judgment at the step ⑯ in FIG. 9J). On the other hand, in case where the new font data position 95A is within the scroll data storage completed region 94 as shown in FIG. 9F and 9G, the stored background data is already a new one. Accordingly, no additional storage of the background data at the new font position is performed (branching "YES" at step ⑯ in FIG. 9J).

The algorithm shown in FIG. 9J is controlled by GCPU 112 in FIG. 1 and programmed in a register or memory in GCPU 112.

Figure 16A:
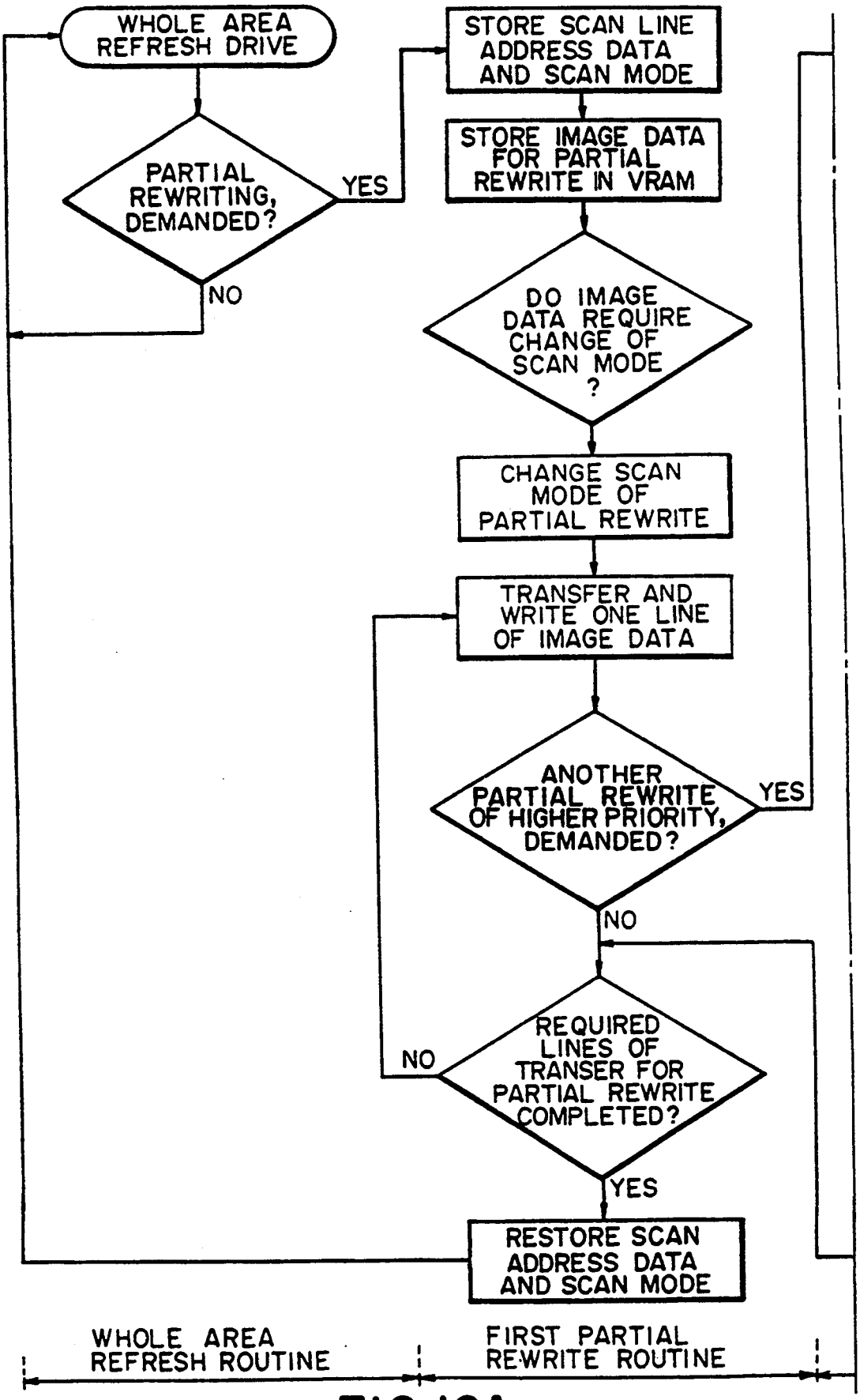

FIG. 16 shows a data processing routine using a system comprising display means comprising scanning lines and data lines and provided with drive means comprising scanning line drive means connected to the scanning lines and data line drive means connected to the data lines; and control means for controlling the drive means so that the display means is driven by a first writing scanning mode and a second writing scanning mode wherein the scanning lines are selected in a different order from that in the first writing scanning mode.

According to the algorithm shown in FIG. 16, the whole display area is scanned by a multi-interlaced scanning mode (whole area refresh drive) when no demand for partial rewriting is present. Similarly as in the algorithm explained above, display data requiring partial rewriting on FLCD 101 is registered in advance in GCPU 112, and a partial rewriting routine is started by branching depending on data from the host CPU 113. In the partial rewriting routine, scanning line address data, the number of scanning lines immediately before the branching, the scanning mode (the non-interlaced scanning mode or multi-interlaced scanning mode and the number of fields for forming one picture in case of the multi-interlaced scanning mode), are first sheltered in a register preliminarily provided in GCPU 112 in order to provide data for resuming an ordinary refresh routine after completion of the partial rewriting routine. Then, image data accompanying the partial rewriting routine is stored in VRAM 114. The host CPU 113 is allowed to access VRAM 114 only through GCPU 112, so that GCPU 112 manages the starting address and region of storage of image data concerning the partial rewriting in VRAM 114.

After completion of the storage of image data in VRAM 114, the transfer of image data to the liquid crystal display apparatus 101 is started, while GCPU 112 switches the scanning mode from the multi-interlaced scanning mode to the non-interlaced scanning mode. The switching of the scanning mode may be performed only by changing the order of reading out the image data accompanied with the scanning line address data in VRAM 114. In a multi-interlaced scanning mode in which one picture (one frame) is formed by 8 fields, for example, the image data in VRAM 114 is read out every 8-th line, while in the non-interlaced scanning mode, the image data is read out line-by-line sequentially. The transfer to the liquid crystal display apparatus 101 is performed for each line as a unit according to a signal transfer scheme similar to that shown in FIGS. 1 and 2 while GCPU 112 always watches the scanning line address data mapped on VRAM 114. During the period of image data transfer accompanying one partial rewriting, the scanning mode is not changed.

Further, in consideration of a case where another partial rewriting demand occurs during the process of one partial rewriting, it is checked after each transfer of one line whether a second partial rewriting demand having a display priority level higher than that of the partial rewriting under processing has occurred. If such a second partial rewriting demand has occurred at that time, the data transfer for the first partial rewriting is interrupted, and a second partial rewriting routine is started by branching. In the second partial rewriting routine, the scanning line address data and the scanning mode data for the first partial rewriting are first stored, and the scanning mode is changed depending on image data requiring the partial rewriting. Then, a similar process as in the first partial rewriting routine is followed for completing the second partial rewriting routine, and then the scanning mode data, etc., for the first partial rewriting routine are restored to resume the first partial rewriting routine. In the first partial rewriting routine, the transfer of the remaining image data is continued while it is further checked whether another partial rewriting demand having a higher display priority level has occurred, to thereby complete the transfer of the whole image data. Thereafter, an ordinary whole-area refresh routine is resumed based on the preliminarily stored data concerning the scanning line address, number of scanning lines and scanning mode.

The following Table 2 explains the order of selection of respective scanning electrodes identified by their numbers (denoted as 1°, 2°, 3°, . . . N° numbered from the uppermost end to the lowermost end of the whole display area) depending on various scanning modes.

TABLE 2

| Scanning electrode No. | 1° | 2° | 3° | 4° | 5° | 6° | 7° | 8° | 9° | 10° | 11° | 12° | ... | N° | Scanning mode |
|---|---|---|---|---|---|---|---|---|---|---|---|---|---|---|---|
| Order of selection for respective scanning electrodes | 1 | 2 | 3 | 4 | 5 | 6 | 7 | 8 | 9 | 10 | 11 | 12 | ... | N | Whole area non-interlaced scanning |
| | 1 | $1+\frac{N}{2}$ | 2 | $2+\frac{N}{2}$ | 3 | $3+\frac{N}{2}$ | 4 | $4+\frac{N}{2}$ | 5 | $5+\frac{N}{2}$ | 6 | $6+\frac{N}{2}$ | ... | N | Whole area-interlaced scanning in 2 fields (every other line selection) |
| | 1 | $1+\frac{N}{3}$ | $1+\frac{2N}{3}$ | 2 | $2+\frac{N}{3}$ | $2+\frac{2N}{3}$ | 3 | $3+\frac{N}{3}$ | $3+\frac{2N}{3}$ | 4 | $4+\frac{N}{3}$ | $4+\frac{2N}{3}$ | ... | N | Whole area-interlaced scanning in 3 fields (selection with 2 lines apart) |
| | 1 | $1+\frac{N}{4}$ | $1+\frac{2N}{4}$ | $1+\frac{3N}{4}$ | 2 | $2+\frac{N}{4}$ | $2+\frac{2N}{4}$ | $2+\frac{3N}{4}$ | 3 | $3+\frac{N}{4}$ | $3+\frac{2N}{4}$ | $3+\frac{3N}{4}$ | ... | N | Whole area-interlaced scanning in 4 fields (selection with 3 lines apart) |
| | 1 | $1+\frac{N}{9}$ | $1+\frac{2N}{9}$ | $1+\frac{3N}{9}$ | $1+\frac{4N}{9}$ | $1+\frac{5N}{9}$ | $1+\frac{6N}{9}$ | $1+\frac{7N}{9}$ | $1+\frac{8N}{9}$ | 2 | $2+\frac{N}{9}$ | $2+\frac{2N}{9}$ | ... | N | Whole area-interlaced scanning in 9 fields (selection with 8 lines apart) |
| | — | — | — | — | 1 | 2 | 3 | 4 | 5 | 6 | 7 | — | — | — | Partial rewriting by non-interlaced scanning |

A preferred partial rewriting drive according to the present invention is performed by interrupting the whole display area scanning for refresh drive. Accordingly, some operation relationships between the partial scanning and whole area scanning may be determined as follows.

(1) When a demand of rewriting a part of the display picture occurs during a whole area scanning by refresh drive, the field scanning for the whole area scanning under way at the time of the occurrence is completed, and the partial scanning drive is started.

(2) Partial scanning drive is performed according a non-interlaced mode.

(3) The maximum number of scanning lines for the partial scanning of scanning electrodes is set equal to the number of the total scanning lines constituting the whole display picture area (the number of scanning lines for one frame scanning). In other words, at a point of time when the number of scanning lines for partial scanning exceeds the number of scanning lines for the whole area scanning, the partial scanning of scanning lines is interrupted to resume the whole area scanning.

(4) When a partial scanning of scanning lines is terminated while the number of scanning lines for the partial scanning is fewer than the maximum number of scanning lines for the partial scanning defined in the above paragraph (3), the field scanning drive is resumed from a first scanning line for a field scanning which is subsequent to the field scanning effected immediately before the partial scanning of scanning lines.

(5) Image data rewriting for the VRAM (memory for image data storage) does not depend on the rewriting speed of the display panel.

(6) Image data transferred to the display panel during the whole area scanning are those at the time of being transferred.

Figure 17:
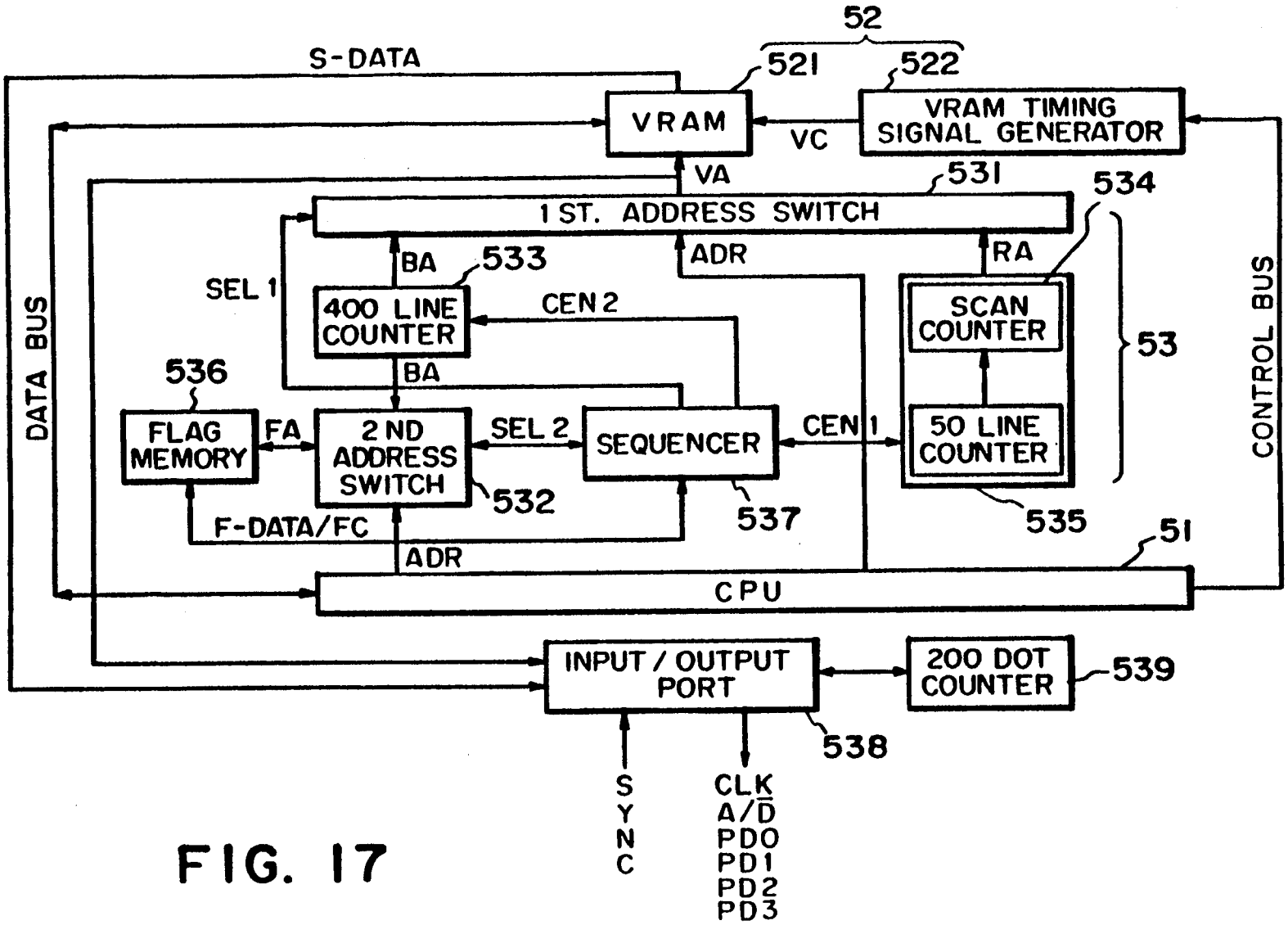
FIG. 17 is a detailed block diagram of a graphic controller used in the invention.

FIG. 17 shows a circuit structure for conducting a series of operations defined in the above paragraphs (1)–(6). More specifically, FIG. 17 shows a detailed structure of the graphic controller 102 shown in FIG. 1, which is functionally provided with a CPU unit 51, a VRAM unit 52 and a sequencer unit 53.

The CPU unit constitutes a control center of the graphic controller 102 and functions as the instruction source of image data generation.

The VRAM unit 52 comprises a VRAM 521 and a VRAM timing signal generator 522 and functions as a memory for storing image data.

The sequencer unit 53 comprises a first address switch 531, a second address switch 532, a 400-line counter 533, a scanning counter (8-line counter) 534, a 50-line counter 535, a flag memory 536, a sequencer 537, an input/output port 538, and a 800-dot counter 539. The sequencer unit 53 controls the access of the CPU unit 51 to the VRAM unit 52 and also the VRAM unit 52 with respect to image data transfer to the display panel 103.

A VA signal for access to an address in the VRAM 521 is an address signal selected from a BA signal, an ADR signal and an RA signal as follows:

(1) BA signal: A VRAM address signal for access to a partial rewriting drive of the display panel 103.

(2) ADR signal: A VRAM address signal at the time of image data generation from CPU 51.

(3) RA signal: A VRAM address signal for access to a whole area scanning drive of the display panel 103.

The above-mentioned BA signal, ADR signal and RA signal are subjected to selection by the first address switch 531 to be outputted as a VRAM address VA signal. The first address switch 531 is controlled by the sequencer circuit 537.

The scanning counter 534 is a counter for defining a scanning scheme and counts the number of scanning lines in jump-scanning for the refreshing drive. In this embodiment, the scanning lines are jump-scanned 7 lines apart.

The 50-line counter 535 defines the number of scanning lines in one field of the refreshing drive. In this embodiment, 400 scanning lines are Jump-scanned 7 lines apart and are frame-scanned in 8 fields, so that 50 scanning lines are counted to make one field. The 400-line counter 533 counts a prescribed number of scanning lines (set to 400 lines in this embodiment) and functions as a frame counter in the whole display picture scanning. In the partial rewriting drive, the 400-line counter 533 generates scanning line address data for the partial scanning of scanning lines and causes an access to the VRAM address.

The second address switch 532 is a circuit for selecting either one of the BA signal and ADR signal for access (FA) to the flag memory 536. The two kinds of the flag memory address signals are selected by the sequencer circuit 537.

The flag memory 536 is a memory for allocating one bit of data for each scanning electrode. The one bit of data is hereinafter called a "flag". Flags are generated by writing image data from the CPU 51 into the VRAM 521. VRAM address signals (ADR) generated at the time of rewriting by the CPU 51 into the VRAM 521 are sampled and converted into address signals (FA) each corresponding to one scanning electrode, based on which a flag of "0" or "1" is written in the flag memory 536. Thus, the location of scanning electrodes is detected based on the writing of image data by the CPU 51, and the detected data are written in the flag memory 536 as flags. Then, in the partial rewriting drive of the display panel 11, the flag data in the flat memory 536 and the BA signals from the 400-line counter 533 are compared, and the flag of "0" (="OFF") or "1" (="ON") is examined to designate only the scanning lines for the partial rewriting drive.

The 800-dot counter 539 is a circuit for counting the amount of image data to be transferred in one horizontal scanning and controlling the input/output port 538. In this embodiment, 800 dots of data are transferred in 4 bits (PD0, PD1, PD2, PD3), so that 200 (=800/4) counts is set.

The input/output port 538 transfers the image data PD0, PD1, PD2, PD3, CLK and A/D- (=AH/DL) comprising scanning electrode address data and image data to the control circuit 15 and receives the SYNC signal from the control circuit.

Figure 18:
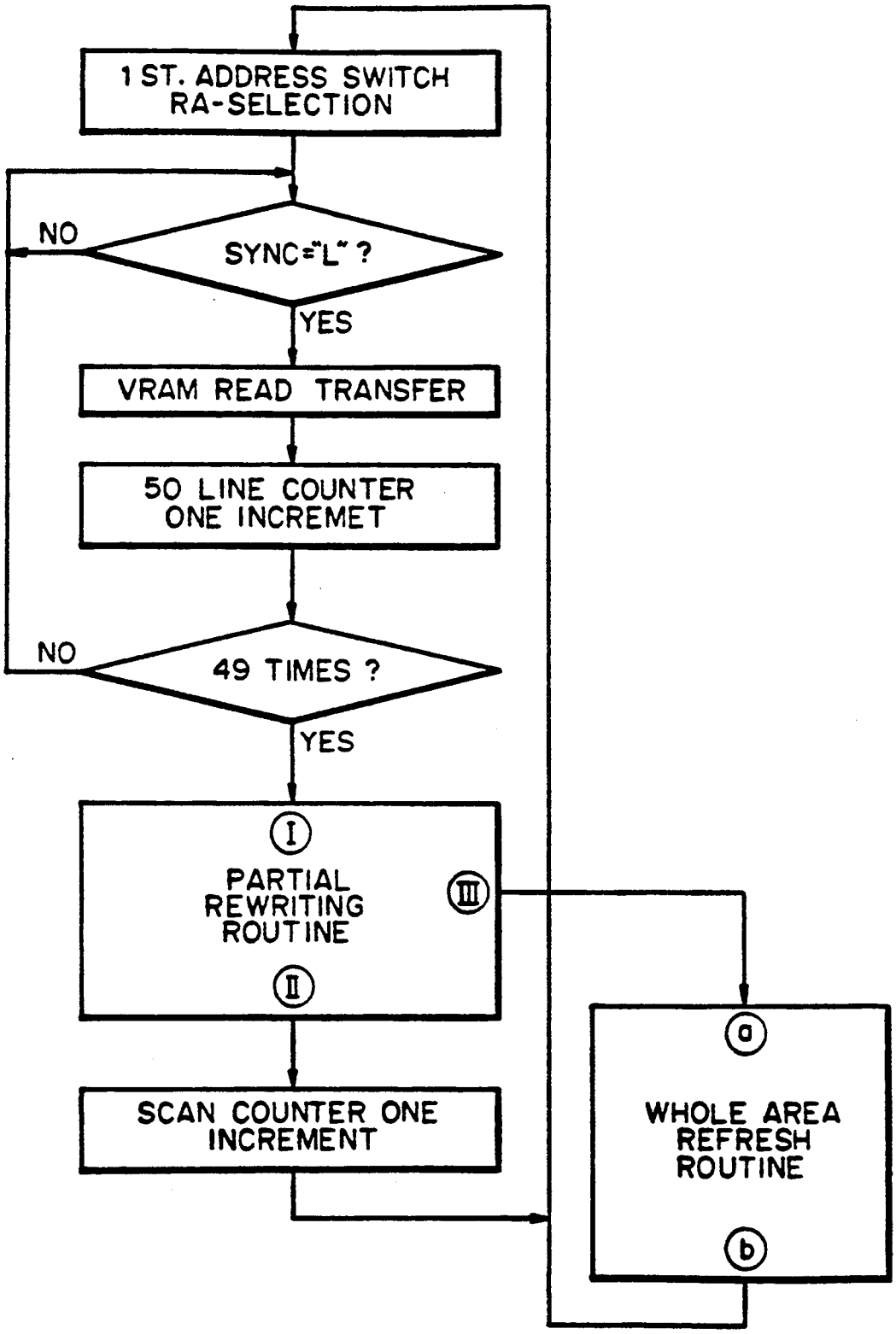
FIG. 18 is a flow chart showing an operation routine for whole area refresh drive and partial rewriting scanning drive.
Figure 19:
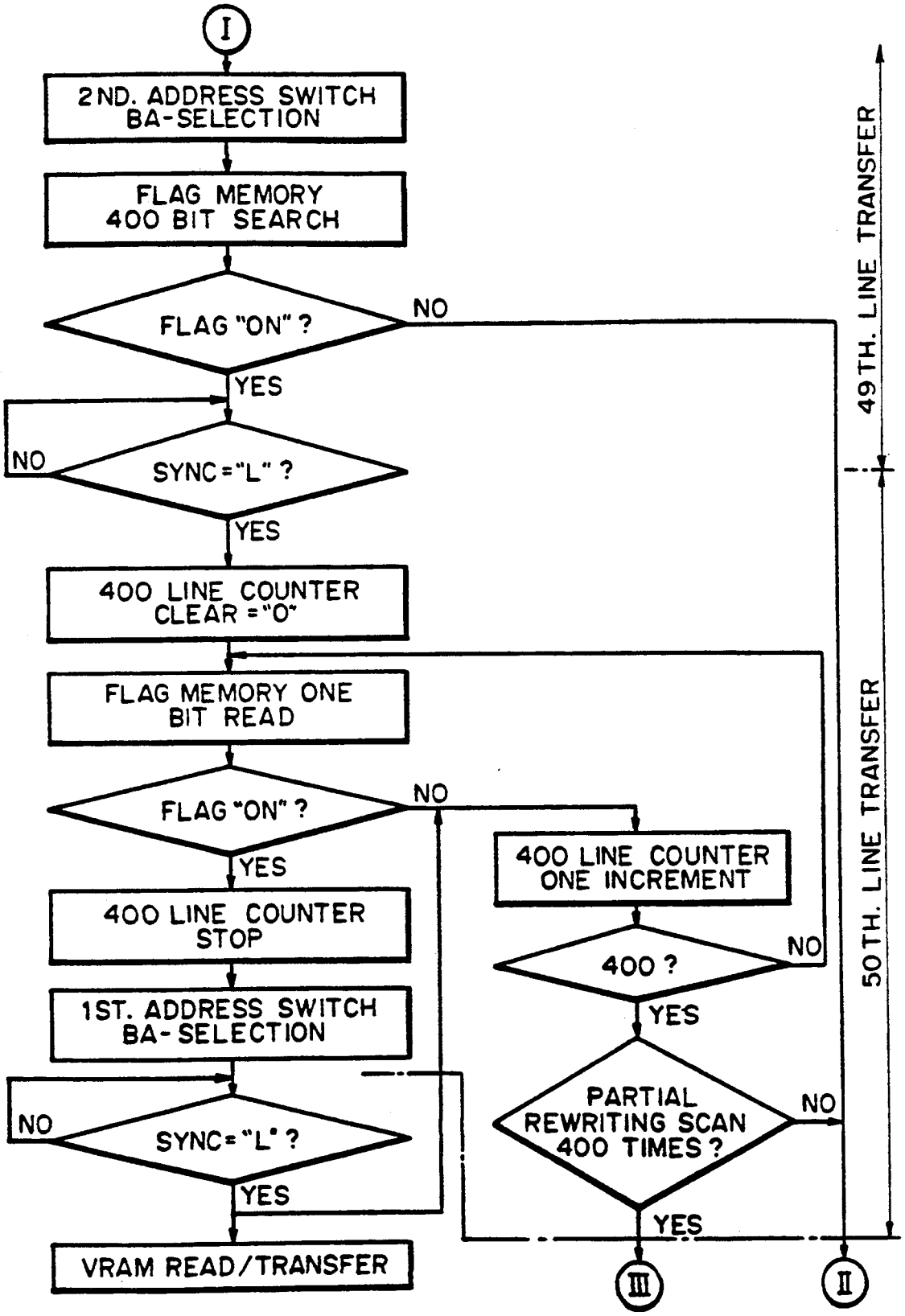
FIG. 19 is a flow chart showing an operation routine for partial rewriting scanning drive.
Figure 20:
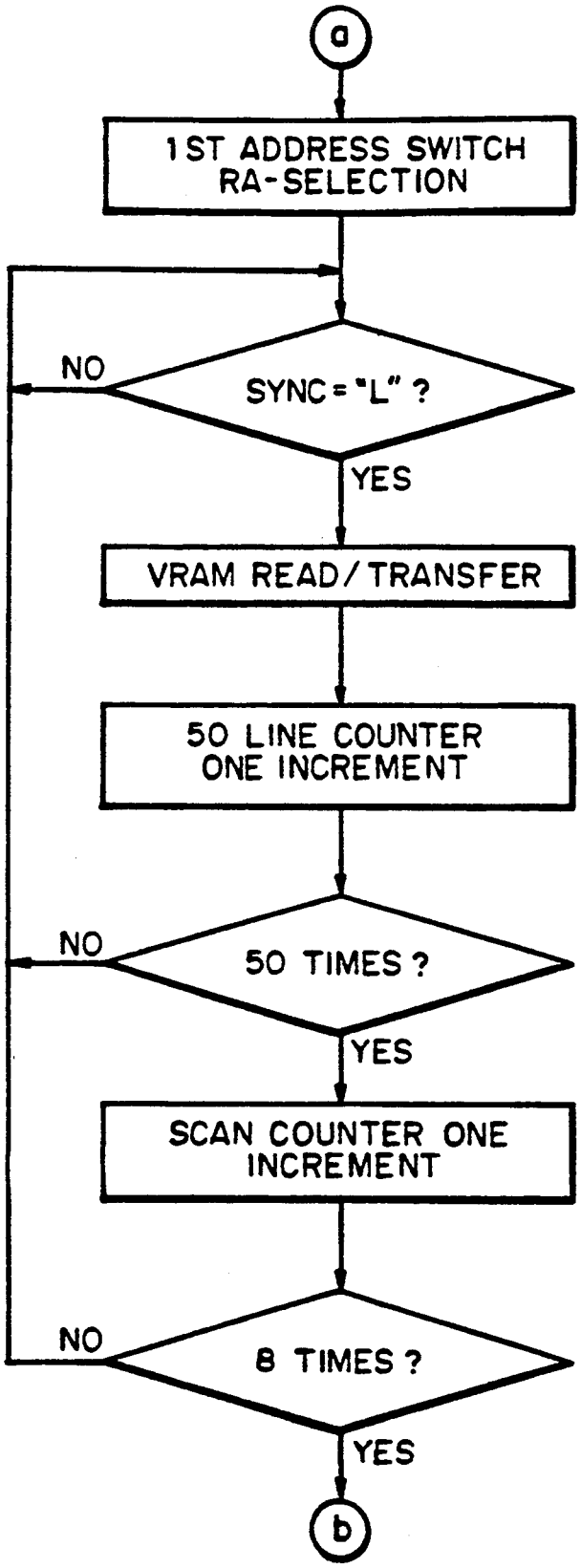
FIG. 20 is a flow chart showing one frame scanning drive.

C. Operational Relationship among the Display Data Generation, Transfer Timing and Display Panel FIG. 18 is a flow chart showing an operational relationship between the whole area refresh (scanning) drive and the partial rewriting (scanning) drive. FIG. 19 is a flow chart of the partial rewriting drive. FIG. 20 is a flow chart of the whole display picture scanning drive.

Referring to FIGS. 18 and 19, first of all, as indicated by "1st ADDRESS SWITCH, RA SELECTION", a VRAM address signal (RA) from the scanning counter 534 which is a counter for the whole area refresh drive and the 50-line counter 535 is supplied to the VRAM 521 as a scanning electrode address data VA. Then, on receiving the "L" level of the SYNC signal, the scanning electrode address data VA and image data in the VRAM designated by the VA signal are read out and transferred to the display panel 11. Then, one increment is given to the 50-line counter 535. If the count is 49 at the time of the increment, the partial rewriting routine is started, and if the count is not 49, the "L" level of the SYNC signal is again awaited. Up to now, the operation of a so-called one-field scanning drive has been explained.

Then, when the count reaches 49, the partial rewriting routine is started and operated in the following manner.

The count of 49 means that the display data to be subsequently sent are for a 49th-scanning electrode in one field, whereby the partial rewriting routine is started from terminal (I) shown in FIG. 19. Further, even while the partial rewriting routine is operated, one field scanning drive is operated on the display panel, so that the time relation between the partial rewriting routine and the one-field scanning drive is shown by the notes of 49th LINE TRANSFER and 50th LINE TRANSFER in FIG. 19. The transfer in the 49th LINE TRANSFER and 50th LINE TRANSFER refers to transfer of scanning electrode address data and image data from VRAM 521 in the one-field scanning drive.

As shown by "2nd ADDRESS SWITCH, BA-SELECTION", a flag memory address signal (FA) from the 400-line counter 533 is supplied to the flag memory 536, and according to 400 times of counting, 400 bits of data in the flag memory 536 are read out. If data with a flag "1" (="ON") is present among the data thus read out, the partial rewriting routine is started thereafter. If the flag is "0" (="OFF"), the operation proceeds to a terminal (II), i.e., returns to the whole area refresh drive. After the completion of the partial rewriting routine, one increment is given to the scanning counter 534, and another RA signal is set to again perform a one-field scanning drive.

Herein, the flag "1" means that rewriting is caused on a scanning electrode shown by a flag memory address (FA). In contrast thereto, no rewriting is indicated by the flag "0". The operation from the terminal (I) up to now is performed during the 49th-line transfer.

Then, the operation in case where a bit with a flag "1" is present, will now be explained. When the 50th line transfer is started on receiving SYNC="L", the 400-line counter is first cleared (into "0"), one bit is read out from the flag memory 536. The readout is effected from the first scanning electrode. Here, again the flag memory is checked whether "1" or "0". If "0", one increment is given to the 400-line counter, and another address signal (FA) is set for a subsequent 1-bit readout. At this time, when the count does not reach 400 as a result of the increment, one bit is read out from the flag memory 536. The operation up to now is repeated until a bit with a flag "1" is encountered.

When a bit with a flag "1" is read out, the operation of the 400-line counter 533 is interrupted, the address of the flag "1" bit is retained. Under the condition of the operation of the 400-line counter 533 being interrupted; the completion of one field scanning drive is waited for by awaiting a SYNC signal at "L" level.

On the other hand, the first address switch 531 is set to the position of BA-selection, and subsequent to the one-field scanning drive, the flag address held by the flag memory 536 is made the scanning electrode address for the partial rewriting scanning and image data in VRAM designated by the scanning electrode address is transferred. Further, simultaneously with the transfer, the above-mentioned operation after "400-LINE COUNTER ONE INCREMENT" is performed.

The above operation with a flag "1" bit is repeated 400 times. Then, at the 400 times of repetition, i.e., after evaluating the value due to the increment, and then it is Judged whether the 400 is given by the number of scanning for the partial rewriting scanning. When 400 is not reached, the operation goes to a terminal (II) to return to the partial rewriting routine, and when 400 is reached, the operation goes to a terminal (III) so as to proceed to the whole area refresh routine.

Next, the operation in the whole area refresh routine is explained.

Referring to FIG. 20, the operation is started from a terminal (a) and the RA signal is selected by the first address switch 531. Then, a SYNC signal at "L" level is awaited, and when it is satisfied, the scanning electrode address data defined by the scanning counter 534 and the 50-line counter 535 and image data designated thereby in VRAM are transferred. Then, one increment is given to the 50-line counter 535. Then, the count given by the increment is Judged to be whether it has reached 50, and if it is not 50, a subsequent transfer is performed. If the counter is 50, the one-field scanning drive is judged to be completed and one increment is given to the scanning counter 534 to set a next field. Then, the count in the counter 534 is judged whether it has reached 8. If it is not 8, another one-field scanning drive is started from the beginning of the next field. If the count in the scanning counter 534 is 8, one frame scanning comprising 8-field scanning drives is judged to be completed, and the operation proceeds to a terminal (b). Then, the whole area refresh routine and the partial rewriting routine are repeated as shown in FIG. 18.

The above operation corresponds to the driving of the display panel as follows. Thus, while the display panel is not rewritten, the whole area refresh drive is always repeated. Search for image rewriting is effected for each one-field scanning drive. In case of rewriting, partial rewriting is performed after the completion of one-field scanning drive. The scanning drive in the partial rewriting is performed according to a non-interlaced mode. When the number of partial rewriting exceeds 400 times before a subsequent one-field scanning, the system is automatically moved to one-field scanning drive according to an interlaced scanning mode. The display apparatus 101 is subjected to repetition of a series of operations as described above based on image data from the graphic controller 102.

As shown in FIGS. 18–20, while image data is generated, the BA signal and the RA signal are only temporarily selected by the first address switch 531, and otherwise the ADR signal from the CPU 51 is selected. In other words, the data in VRAM 521 is in a condition that the access thereto is always possible by the CPU 51.

Figure 21:
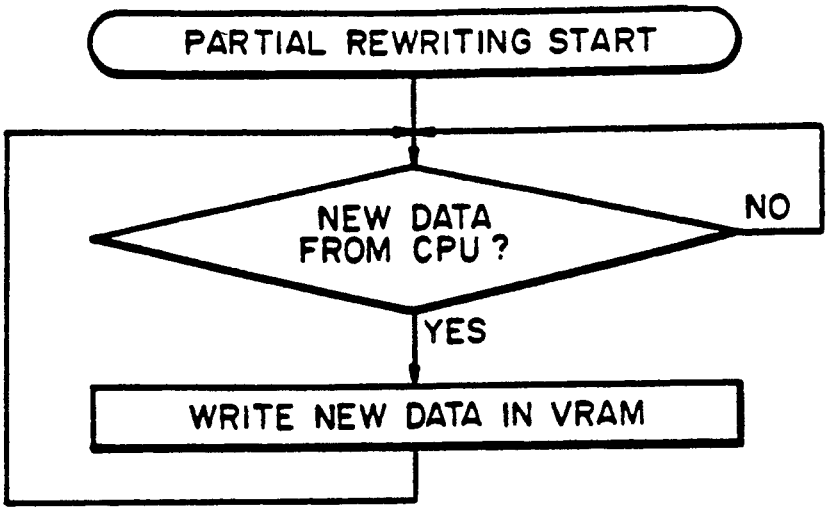
FIG. 21 is a flow chart showing a partial rewriting routine.
Figure 22:
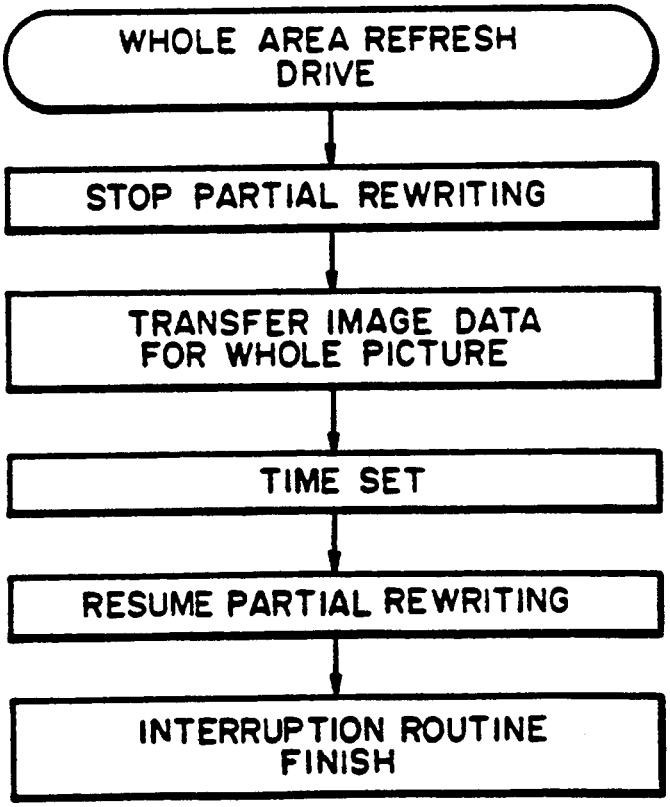
FIG. 22 is a whole area refresh drive routine.

FIG. 21 is a flow chart showing another partial rewriting routine used in the present invention, and FIG. 22 is a flow chart showing a display operation including the partial rewriting. In the operation, it is judged whether new data has come from CPU, and if not, this operation is repeated. When new data appears, the previous data in VRAM is rewritten. Thus, the graphic controller 102 adds scanning electrode address data to the image data from CPU and transfer the sum to the control circuit 111.

On the other hand, the whole area refresh drive is executed at definite intervals. For this purpose, the main program is interrupted on demand for the whole area refresh scanning drive, and the graphic controller 102 executes the routine shown in FIG. 22 at definite intervals according to the interruption demand. In the operation shown in FIG. 22, if the partial rewriting is under operation, it is interrupted to refuse new data from CPU. Then, image data for the whole picture is transferred to the control circuit 111. Then, a time until the subsequent whole display picture scanning drive is set (to 1 second in this embodiment). Then, new data from CPU are received.

The operation of the graphic controller 102 is defined in the above described manner to effect the driving method according to the present invention.

Figure 23A:
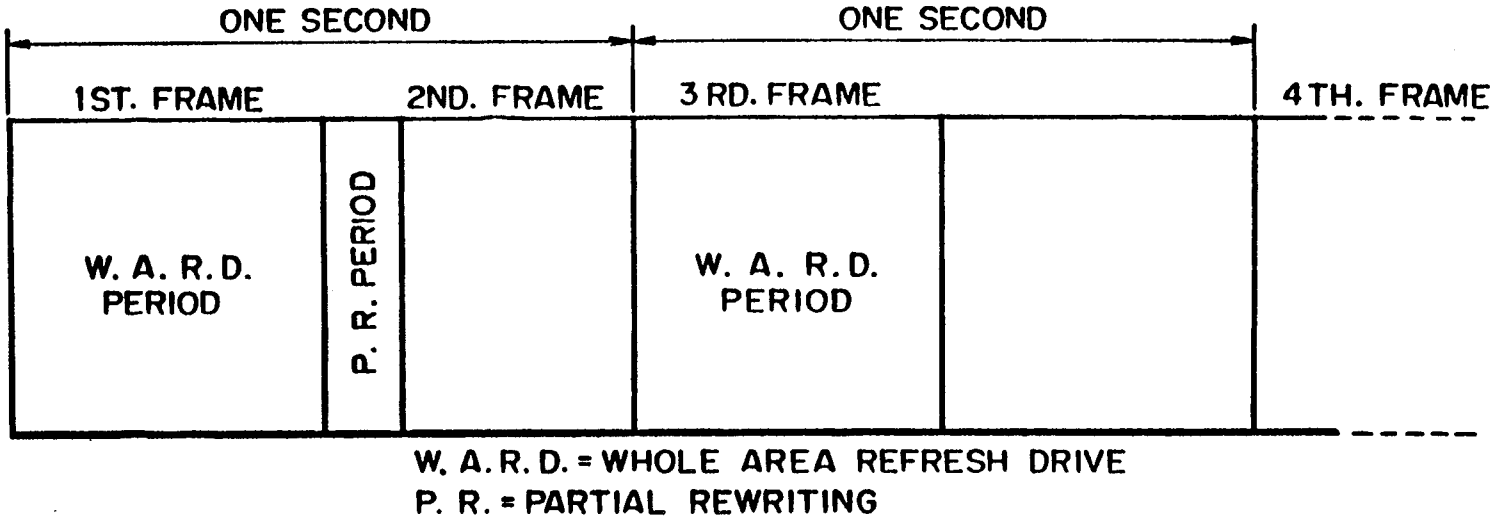
FIG. 23A is a time table for a case where the number of scanning electrodes for partial rewriting scanning $<$ the number of whole picture scanning electrodes.
Figure 23B:
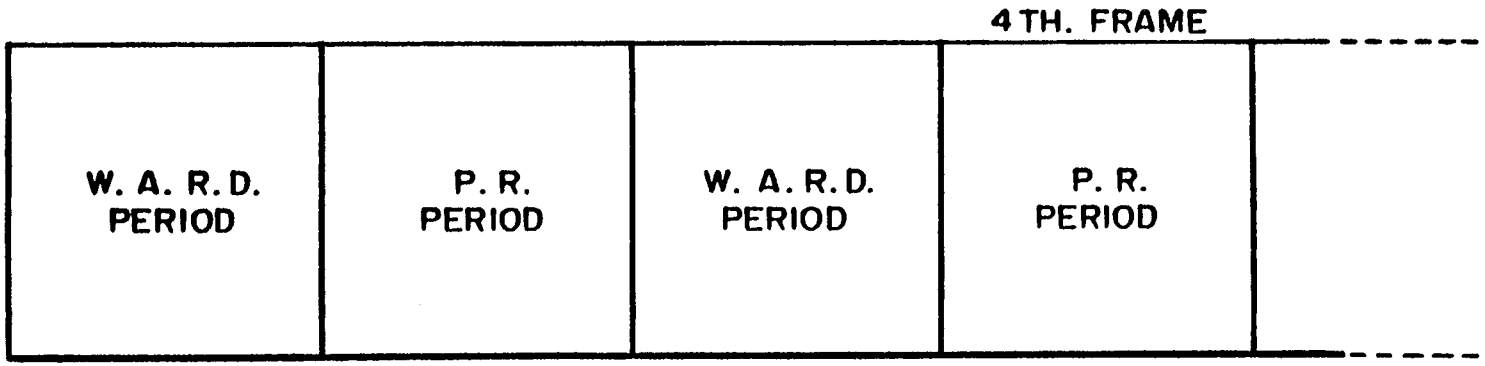
FIG. 23B is a time chart for a case where the number of scanning electrodes for partial rewriting scanning $\geqq$ the number of whole picture scanning electrodes.

FIGS. 23A and 23B show time charts for showing the display operation principle according to the above embodiment, wherein the first frame is a period for the whole area refresh drive. If rewriting data is generated during this period, the graphic controller 102 prepares rewriting data (generates scanning electrode address data and image data serially) in the above described manner. Then, at the beginning of the second frame, the partial rewriting is started according to the routine shown in FIGS. 21 and 22. After the completion of the partial rewriting and on reaching a prescribed definite time, the whole area refresh drive is resumed.

Herein, if the rewriting data does not span the whole area, i.e., in case of the number of scanning electrodes for the partial scanning < the number of scanning electrodes constituting the whole area, the whole area refresh drive is started as soon as the partial rewriting is completed and a definite time is reached as shown in FIG. 23A.

On the other hand, in case of the number of scanning for the partial rewriting ≧ the number of scanning electrodes constituting the whole area (e.g., 400 lines), the partial rewriting is interrupted to proceed to the subsequent whole area refresh drive when the number of scanning for the partial rewriting exceeds 400. In this embodiment, the whole area refresh drive cycle has been set to 1 second.

D. Display Operation Example

Figure 24:
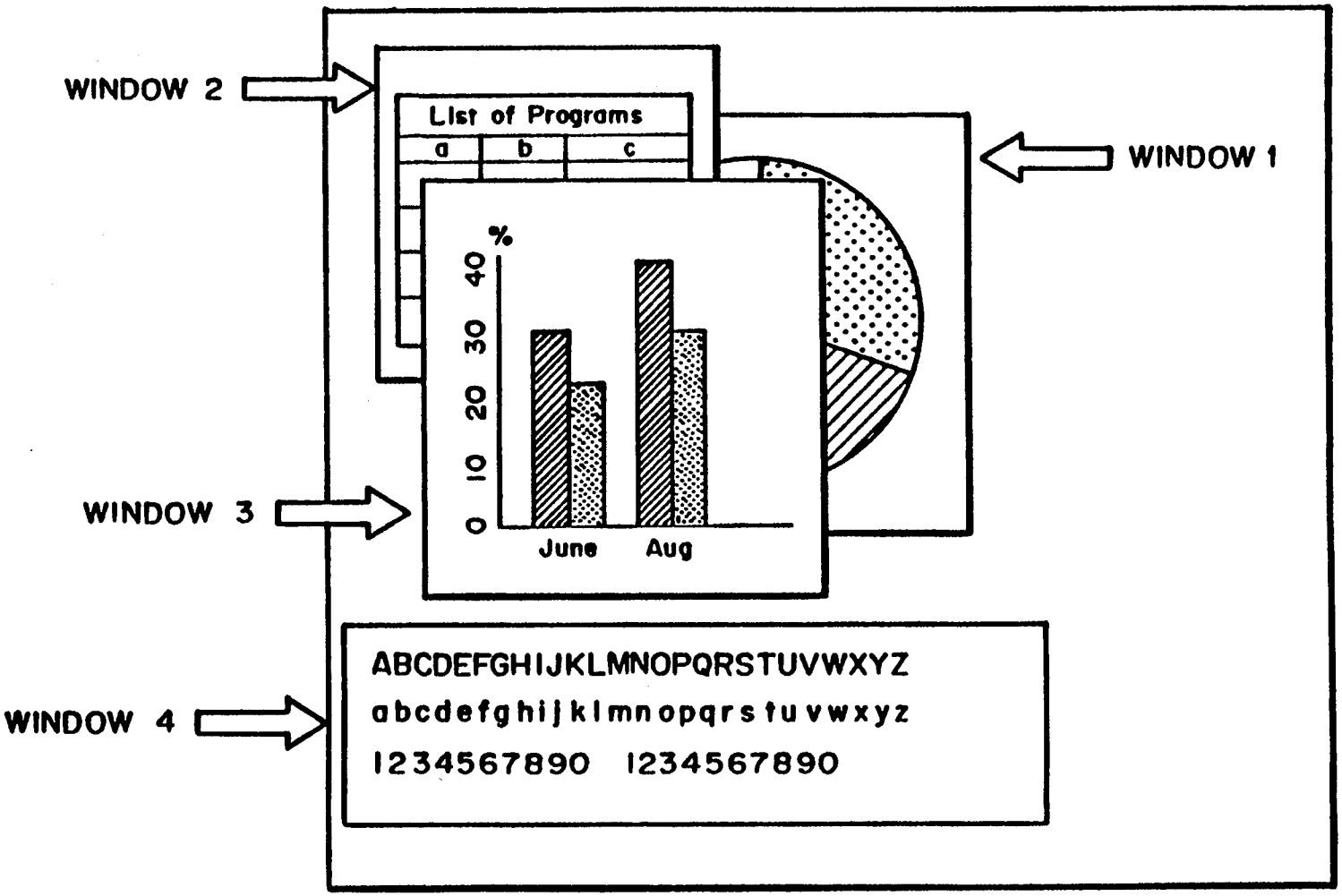
FIG. 24 is an illustration of an example of display image used in the invention.

FIG. 24 shows an example of a multi-window picture display. The whole display picture comprises respectively different pictures in various display regions. A window 1 shows a picture of a categorized total result expressed in a circle. A window 2 shows the categorized total at the window 1 expressed in a table. A window 3 shows the categorized total at the window 1 expressed in a bar graph. A window 4 shows characters relating to formation of sentences. The background is formed in plain white.

Herein, the window 4 constitutes a picture in operation and the other pictures are in a still picture state. In other words, the window 4 is under preparation of a sentence and in a motion picture state. The motion picture state may specifically include motions, such as scrolling; insertion, deletion and copying of words and paragraphs; and regional transfer. These motions generally require a quick movement. More specific display operation examples are given hereinbelow.

First example: One character is additionally displayed in an arbitrary row in the window 4.

A character font is assumed to be composed of 16×16 dots. The additional display of one character corresponds to rewriting of 16 scanning electrodes. According to the routine shown in FIGS. 17–20, only 16 scanning electrodes are rewritten as follows during the whole area scanning. First of all, search of the flag memory 536 is started from the 49th line in a field in which one character is additionally rewritten in VRAM 521 by CPU 51 and the search is continued until 16 bits of flags "ON" are detected to partially rewrite only 16 scanning electrodes after completing the field scanning drive under way. Then, a subsequent field scanning drive is sequentially effected from a leading scanning electrode. If one horizontal scanning time is assumed to be 250 μsec, the time required for rewriting 16 lines is 16×250 μsec=3.8 msec, so that a high-speed partial rewriting is performed. The time required for one field scanning drive is 50×250 μsec=12.5 msec, so that the time required for the rewriting of VRAM 521 by CPU 51 until the actual display of the additional character is 16.3 msec at the maximum, which corresponds to about 61 Hz in terms of frequency and provides a very quick response. As a result, a partial scanning drive of scanning electrodes corresponding to a font given by a cursor or mouse may be repeated cyclically for different scanning electrodes to afford a moving display by such a cursor or mouse at a very high speed.

Second example: The whole picture area is scrolled according to the routine shown in FIGS. 17–20.

The timing for switching from the whole area refresh drive to the partial rewriting scanning drive is the same as in the above-mentioned first example. Herein, the partial rewriting is replaced by a whole area scanning, so that the number of scanning electrodes to be scanned for rewriting amounts to 400. Corresponding thereto, in a first one frame, 400 scanning electrodes are scanned by the non-interlaced scanning mode to rewrite the whole picture, and in a subsequently frame, the whole area is scanned by the interlaced scanning mode. Thus, the display picture is rewritten alternately by the non-interlaced scanning mode and the interlaced scanning mode. Herein, image data transferred from VRAM comprises the newest image data even in the interlaced scanning mode. In this example, if one horizontal scanning time is assumed to be 250 μsec, the time required for rewriting one whole picture is 400×250 μsec=100 msec, which corresponds to a frame frequency of 10 Hz and provides a visually recognizable level of scrolling.

Third example: A window 4 is subjected to smooth scrolling according to the routine shown in FIGS. 21–23.

It is assumed that the window 4 occupies 200 scanning electrodes. The smooth scrolling display corresponds to rewriting of 200 scanning electrodes. The driving of 200 scanning electrodes during the whole area refresh drive is effected as shown in FIG. 23. In the first frame, the whole area refresh drive is performed, and the partial driving of 200 scanning electrodes in 200×250 μsec=50 msec is performed from the beginning of the second frame and repeated until the subsequent time for initiation of the whole area refresh drive.

Figure 11:
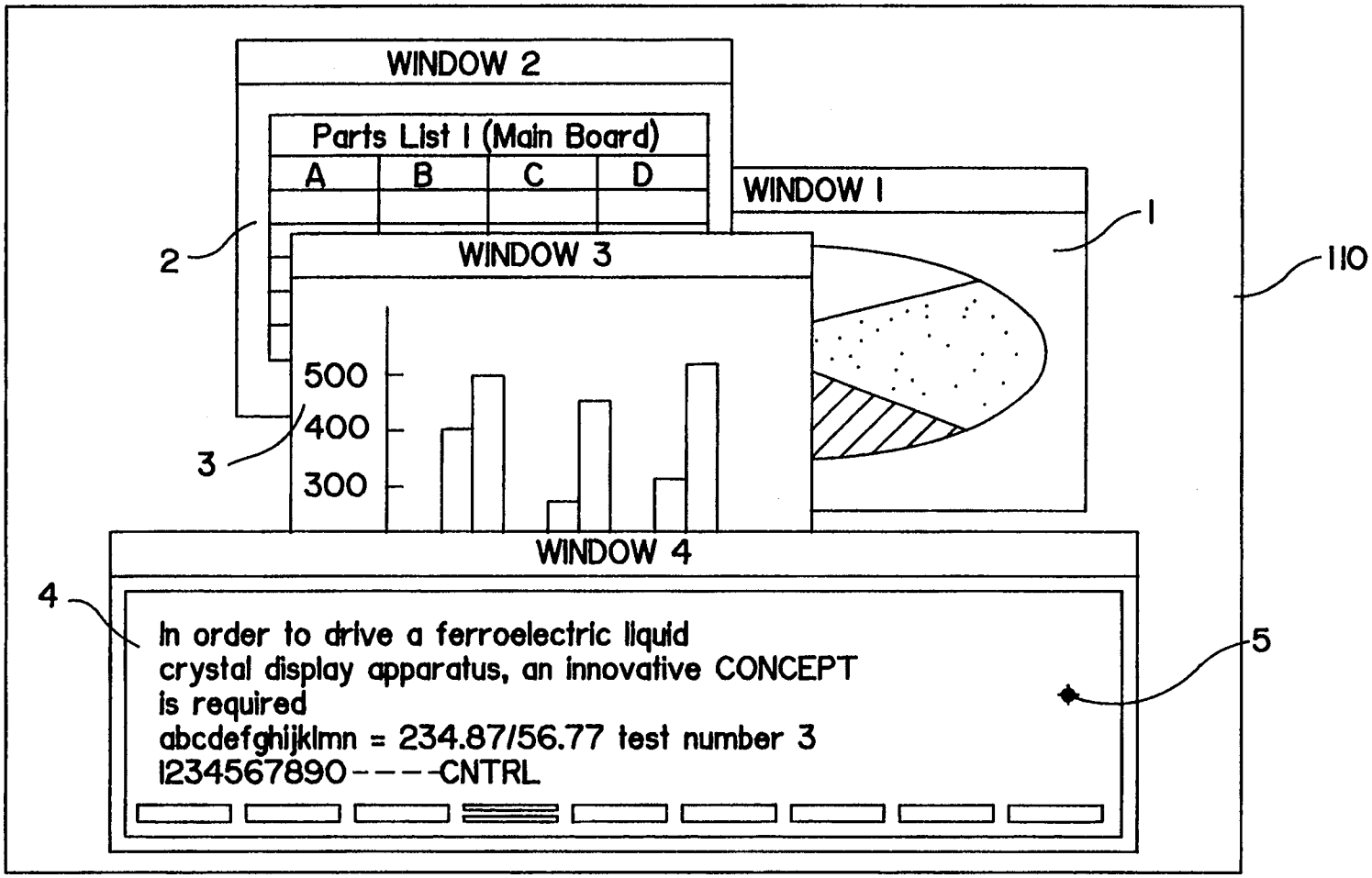
FIG. 11 is an illustration of a multi-window display picture according to an embodiment of the invention.

FIG. 11 shows another example of a multi-window display picture 110. A window 1 shows a picture of a categorized total expressed in a circle. A window 2 shows the categorized total at the window 1 expressed in a table. A window 3 shows the categorized total at the window 1 expressed in a bar graph. A window 4 shows a picture under preparation of sentences. A mouse font 5 given from a mouse as a pointing device is also shown. Herein, it is assumed that the pictures at the windows 1–3 are in a still picture state, the window 4 is used for an editorial display including smooth scrolling, insertion, deletion or regional transfer of words or paragraphs, and the mouse font 5 is moved therein. Then, the smooth scrolling and the mouse font movement constitute image data requiring partial rewriting scanning of a ferroelectric liquid crystal display apparatus 101. For example, if all of 1120 scanning lines constituting a whole picture area are scanned at a rate of one horizontal scanning time=80 μsec, the resultant frame frequency is lowered to about 10 Hz, so that it is impossible at all to follow an ordinary movement of a mouse font (≧30 Hz). By adopting the algorithm of the present invention to provide the partial rewriting by the mouse movement with a higher priority level than that of the editorial display in the window 4, it is possible to immediately start the partial rewriting routine by the mouse movement by branching even if the mouse is moved during the scrolling. In this instance, the time required for the branching into the mouse partial rewriting routine is within one horizontal scanning period at the longest. For example, as shown by [Eq. 1] above, the required time for writing a mouse font on the display panel 103 is 3.2 msec if the font size is composed of 32×32 dots. The scroll operation is stopped during the time, which however is sufficiently short and hardly affects the scroll speed. After the mouse font writing, the partial rewriting scanning in the window 4 is resumed, but if the mouse is moved again, the branching into the mouse partial rewriting routine is effected to start writing of the mouse font. Thus, in a low-frequency drive display having a memory characteristic like a ferroelectric liquid crystal display apparatus 101, it has become possible to realize a multi-window, multi-task display function by putting the most weight on the movement of a pointing device (mouse).

Figure 5:
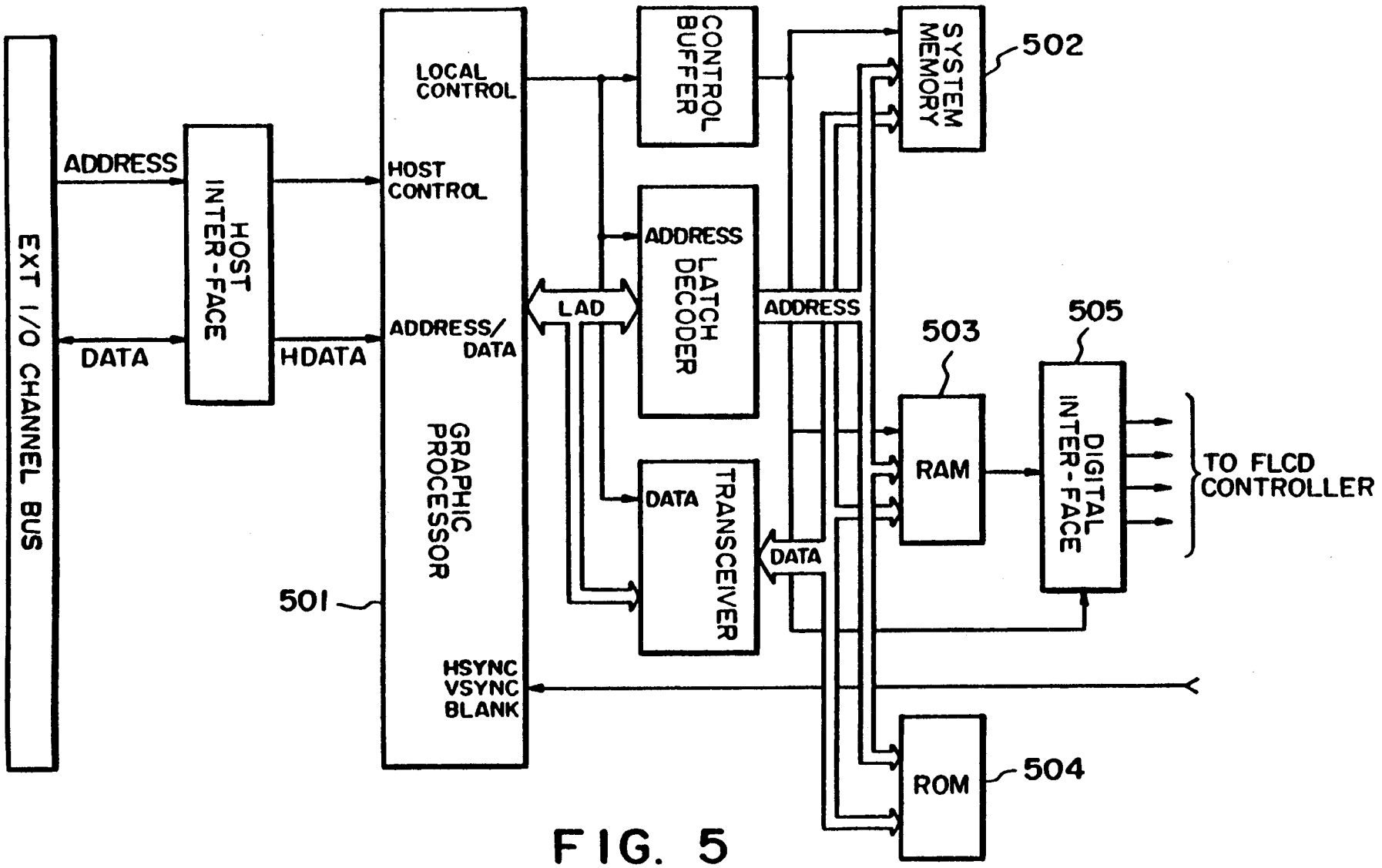
FIG. 5 is a block diagram of a graphic controller used in the invention.
Figure 6:
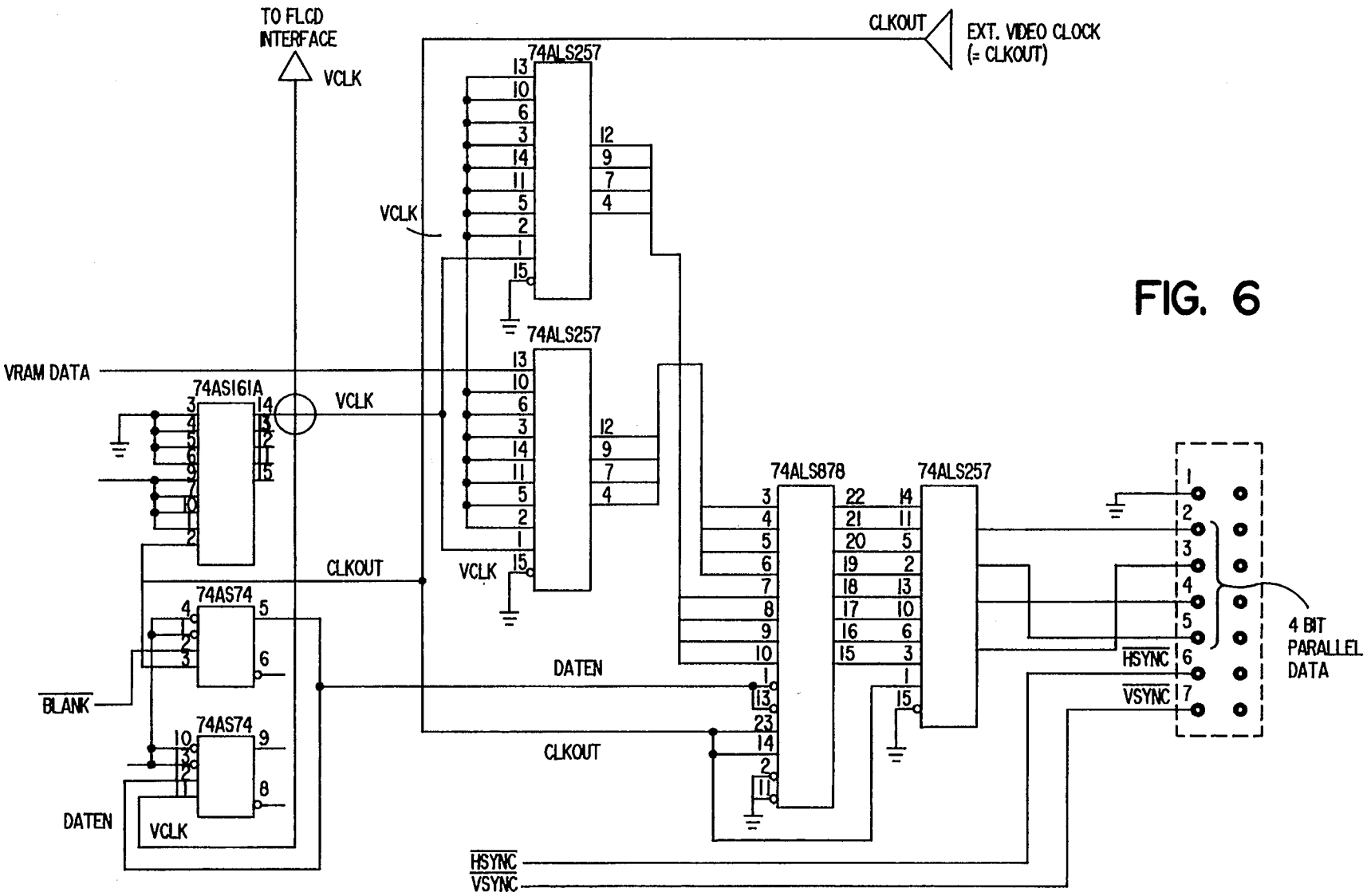
FIG. 6 is a block diagram of a digital interface.
Figure 7:
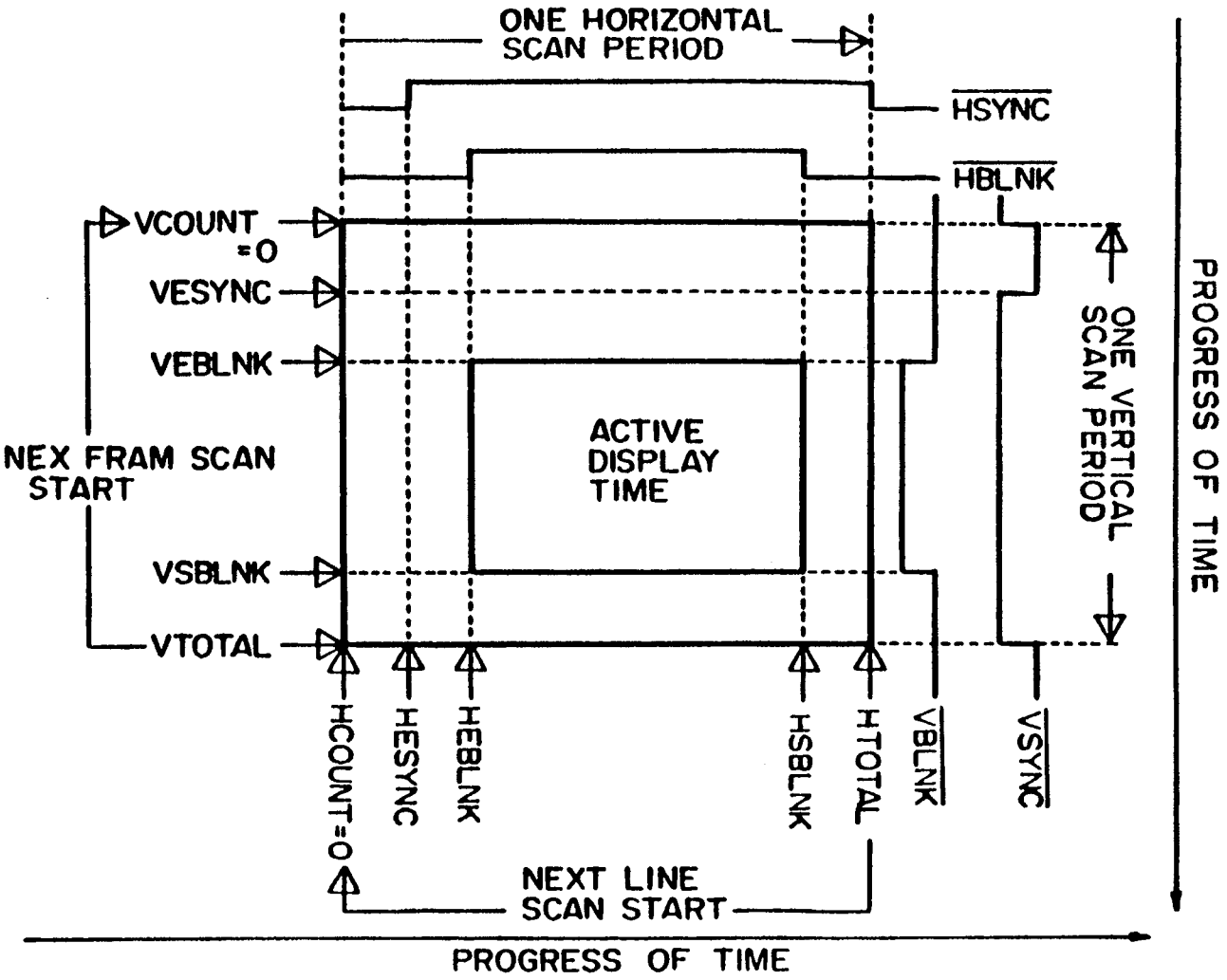
FIG. 7 is an interfacial time chart for a display drive apparatus used in the invention.
Figure 8:
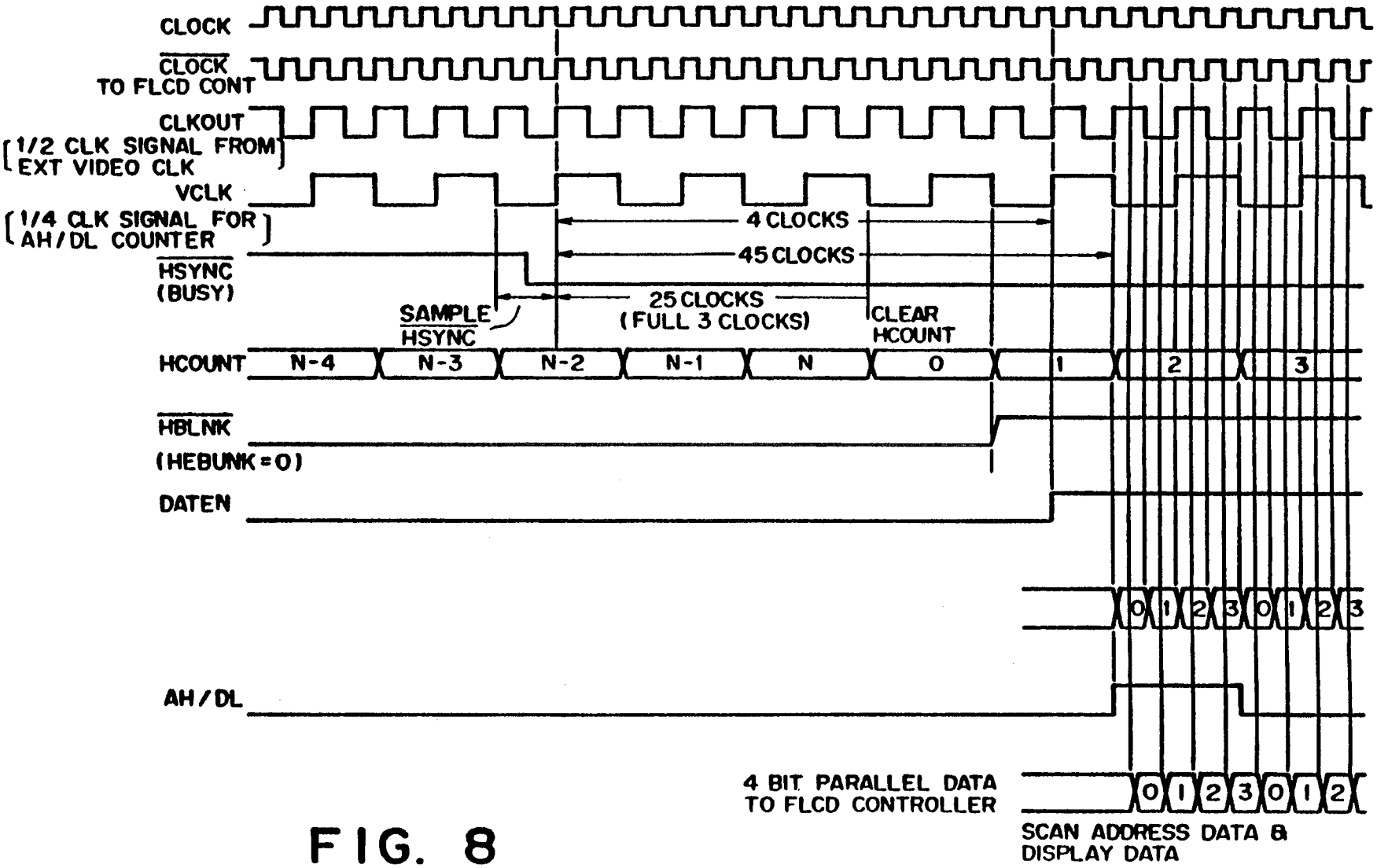
FIG. 8 is an interfacial time chart for an FLCD controller.

FIG. 5 is a block diagram of the graphic controller 102, FIG. 6 is a block diagram of the digital interface, and FIGS. 7 and 8 are time charts for internal data transfer.

A clear distinction of the graphic controller 102 used in the present invention is that the graphic processor 501 thereof has a system memory 502 for its exclusive use, and not only manages RAM 503 and RAM 504 but also effects the execution and management of writing instruction to RAM 503, and is further capable of independent programing with respect to data transfer from a digital interface 505 to the FLCD controller and management of driving FLCD.

The digital interface 505 shown in FIG. 6 takes a synchronization with the drive circuits 104 and 105 of the display panel 103 based on an external synchronizing signal HSYNC/VSYNC from FLCD controller 111 and in parallel therewith provides, at its final stage, 4 bits/clock pulses (data transfer clock signals) based on data in VRAM. FIG. 7 shows time relations for whole area rewriting of FLCD panel, and the parameters therein are the same as in FIG. 8 which is a time chart for data transfer.

First of all, the transfer of image data for one line is started when the signal $\overline{\text{HSYNC}}$ becomes active (low level in this case). The signal $\overline{\text{HSYNC}}$ is made low by FLCD controller 111 as data requirement from the panel 103 side. The data requirement from the panel 103 side is received by the graphic processor 501 shown in FIG. 5 and is processed therein according to the time chart shown in FIG. 8. Referring to FIG. 8, $\overline{\text{HSYNC}}$ representing the data requirement from the panel 103 is sampled for 1 cycle of an external video clock signal CLKOUT (in other words, the low period of VCLK which is actually supplied to the graphic processor 501 so that the processor 501 effects the sampling for the low period according the actual specification), and 2.5 pulses of VCLK thereafter, a horizontal counter HCOUNT is cleared. Then, parameters HEYSYN and HEBLNK in FIG. 7 are programmed to disable $\overline{\text{HBLNK}}$ (high) in FIGS. 7 and 8. A half pulse of VCLK thereafter, in the circuit shown in FIG. 6, DATEN is made active (high) as shown in FIG. 8, and a further half pulse thereafter (i.e., 4.5 pulses after the sampling of $\overline{\text{HSYNC}}$), data for a subsequent one line is transferred 4 bits by 4 bits from VRAM to FLCD controller 111.

As shown at the lower right corner of FIG. 8, the high data transferred in this way is such that the scanning line address data (corresponding to the scanning line number) is first sent 4 bits by 4 bits and then the display data for one line are transferred. Correspondingly, in the FLCD controller 111, a signal AH/DL is used for discriminating the scanning line address data and the display data in such a way that a high AH/DL signal indicates the scanning line address data and a low AH/DL signal indicates the display data. Accordingly, in the FLCD, a scanning line is selected by the scanning line address data and the display data is written correspondingly. As a result, the FLCD is driven according to the non-interlaced mode if the scanning line address data sent from the graphic controller shown in FIG. 5 is increased one by one, according to an alternately interlaced mode if the address data is increased two by two, and according to an m-line multi-interlaced mode if the address data is increased by m-by-m. In this way, the drive of FLCD is controlled.

FLCD ordinarily requires about 100 μsec as a drive time for one scanning line. Now, if it is assumed that one scanning line drive time is 100 μsec and a minimum frequency not causing flicker is 30 Hz, the number of scanning lines in FLCD which can be driven without causing flicker in a still image can be calculated as follows:

$$(1/30\ \text{Hz})/100\ \mu\text{sec} \approx 333\ \text{lines} \qquad \text{[Eq. 3]}$$

According to the non-interlaced mode $$(1/30\ \text{Hz}) \times 2/100\ \mu\text{sec} \approx 666\ \text{lines} \qquad \text{[Eq. 4]}$$

Alternately interlaced mode $$(1/30\ \text{Hz}) \times m/100\ \mu\text{sec} = 333 \times m\ \text{lines} \qquad \text{[Eq. 5]}$$

M-line multi-interlaced mode

According to our experiments, it has been confirmed that no flicker is observed even in a case of m=32.

$$\begin{aligned}(1/30\ \text{Hz}) \times 32/100\ \text{usec} &= 333 \times 32 \\ &= 10656\ \text{lines}\end{aligned} \qquad \text{[Eq. 6]}$$

This means that a display panel having 10656 scanning lines can be driven without flickering and a flat display panel having a high resolution not realized heretofore can be obtained though on the basis of calculation.

Incidentally, in FIG. 6, "74AS161A", "74AS74, "74ALS257", "74ALS878" and "74AS257" refer to IC members and the numerics in the figure refer to pin numbers.

E. Display Scanning Scheme

In the present invention, the refresh drive may be performed by an interlaced scanning mode as described below, and the partial rewriting drive may be performed by a non-interlaced scanning mode. The partial rewriting drive is performed by "partial scanning line scan" wherein, in order to rewrite a partial region of the whole display picture area, a scanning selection signal is applied to scanning lines constituting only the partial region (rewriting region). Now, some explanation is added to the interlaced scanning mode which is generally used for the whole area refresh drive.

[Interlaced Scanning Mode]

A scanning selection signal is sequentially applied to the scanning electrodes with jumping or skipping of N lines apart ($N \geqq 1$, preferably $4 \leqq N \leqq 20$), in one vertical scanning period (corresponding to one field period), and one picture scanning (corresponding to one frame scanning) is effected by $N+1$ times of field scanning. In the present invention, it is particularly preferred that one vertical scanning is effected two or more scanning electrodes apart and scanning electrodes not adjacent to each other are selected (scanned) in at least two consecutive times of vertical scanning.

Figure 12A:
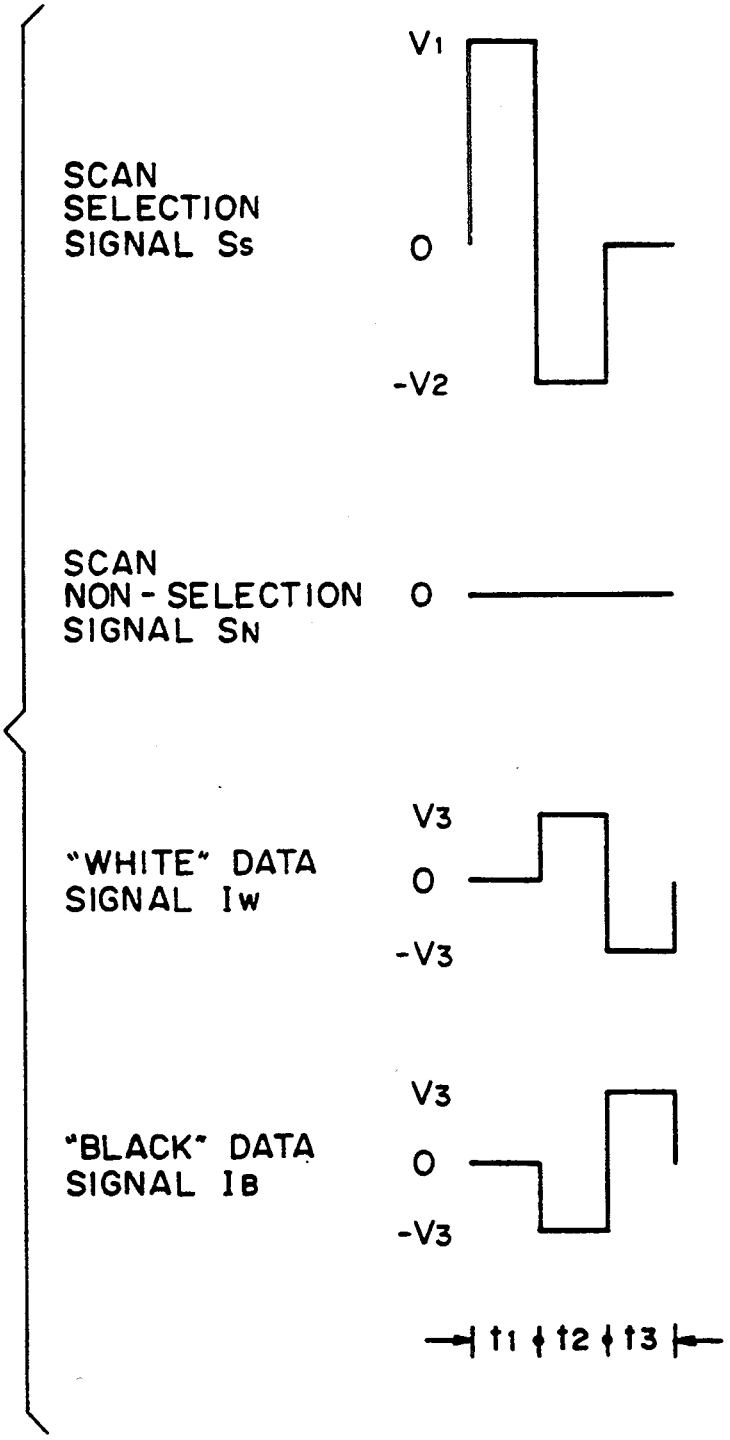
FIGS. 12A–12D and FIGS. 13A–13C respectively show a set of driving signal waveforms used in the invention.
Figure 12B:
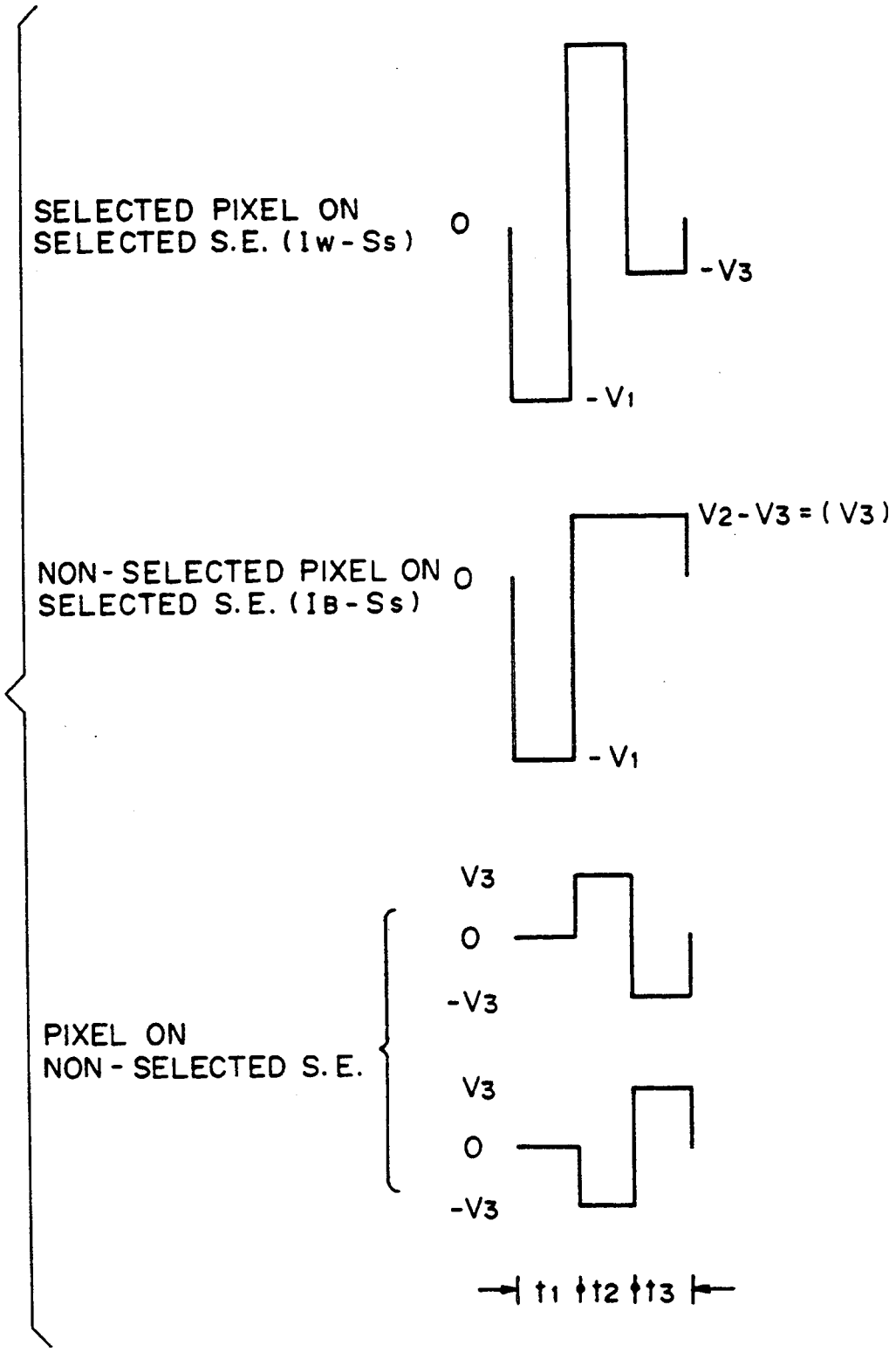

FIG. 12A shows a scanning selection signal $S_S$, a scanning non-selection signal $S_N$, a white data signal $I_W$ and a black data signal $I_B$. FIG. 12B shows a voltage waveform applied to a selected pixel among the pixels on a selected scanning electrode receiving a scanning selection signal (a voltage ($I_W$-$S_S$) applied to a pixel receiving a white data signal $I_W$), a voltage waveform applied to a non-selected pixel on the same selected scanning electrode (a voltage ($I_B$-$S_S$) applied to a pixel receiving a black data signal $I_B$), and voltage waveforms applied to two types of pixels on a non-selected scanning electrode receiving a scanning non-selection signal. According to FIGS. 12A and 12B, the pixels on a selected scanning electrode are simultaneously supplied with a voltage providing one orientation state of a ferroelectric liquid crystal to be erased into a black state based on such one orientation state of the ferroelectric liquid crystal (a pair of cross nicol polarizers are so arranged as to effect erasure into a black state in this embodiment, but it is also possible to arrange polarizers so as to cause erasure into a white state) in phase $t_1$ regardless of the kind of a data signal supplied. In a subsequent phase $t_2$, a selected pixel on the selected scanning electrode ($I_W$-$S_S$) is supplied with a voltage ($V_2+V_3$) providing a white state based on the other orientation state of the ferroelectric liquid crystal, and the other pixels on the selected scanning electrode ($I_B$-$S_S$) are supplied with a voltage ($V_2-V_3=V_3$) not changing the black state formed in the phase $t_1$. On the other hand, the pixels on a scanning electrode receiving the scanning non-selection signal are supplied with voltages $\pm V_3$ below the threshold voltage of the ferroelectric liquid crystal. As a result, in this embodiment, the pixels on the selected scanning electrode are written into either black or white through phases $t_1$ and $t_2$ and retain their states even when they are subsequently supplied with a scanning non-selection signal $S_N$.

Further, in this embodiment, in a phase $t_3$, a voltage of a polarity opposite to that of the data signal in the writing phase $t_2$ is supplied from a data electrode. As a result, a pixel at the time of scanning non-selection is supplied with an AC voltage to improve the threshold characteristic of the ferroelectric liquid crystal. Such a signal applied through a data electrode is called an auxiliary signal and is explained in detail in U.S. Pat. No. 4,655,561.

Figure 12C:
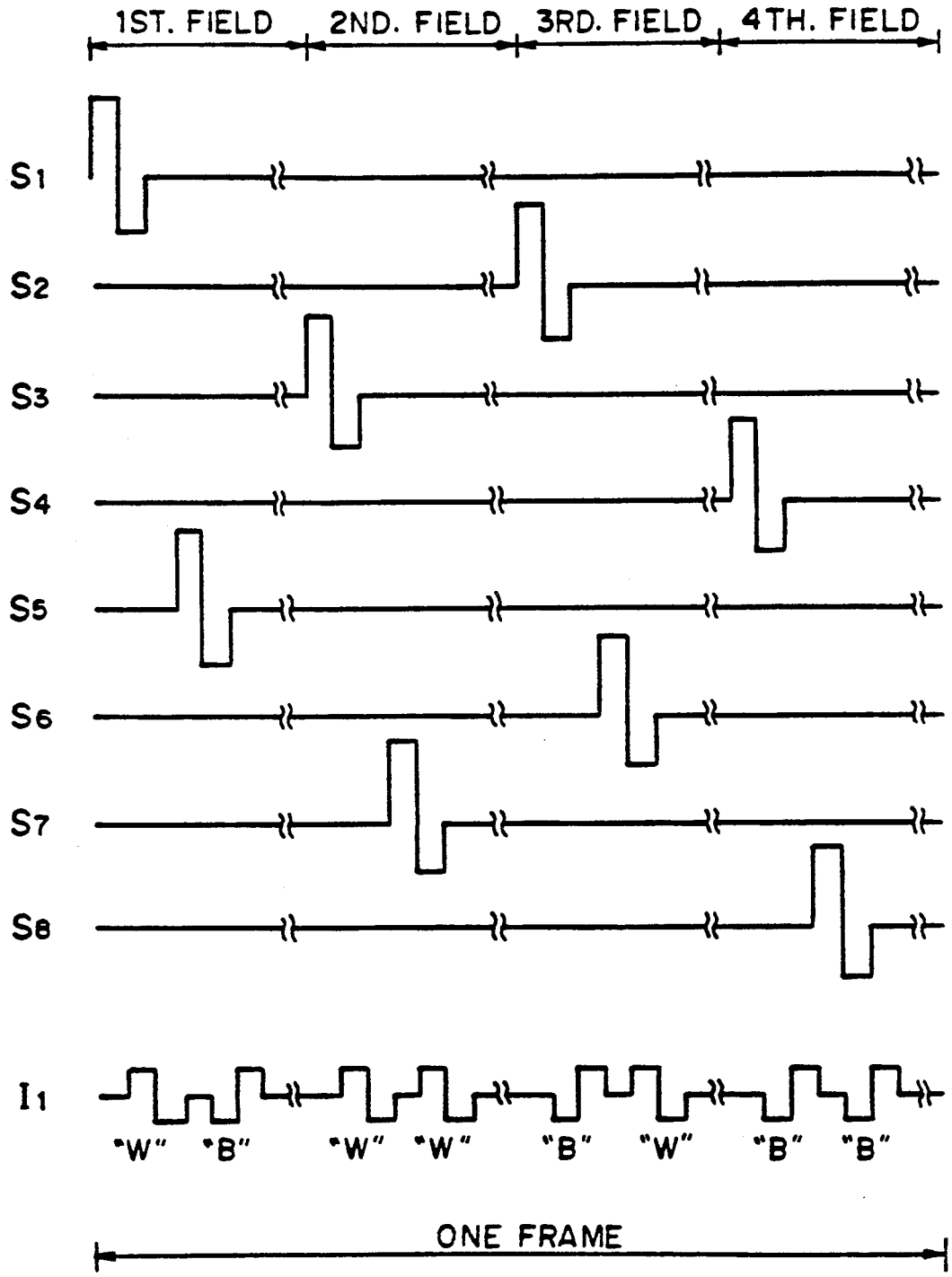

FIG. 12C is a time chart of voltage waveforms for providing a certain display state. In this embodiment, a scanning selection signal is applied to the scanning electrodes three lines apart in one field, and one frame scanning (one picture scanning) is effected by 4 consecutive times of field scanning so that no adjacent pair of scanning electrodes are supplied with a scanning selection signal together in 4 consecutive fields. As a result, a scanning selection period ($t_1+t_2+t_3$) can be set longer as required at a low temperature, so that occurrence of flickering attributable to scanning drive at a low frame frequency can be remarkably suppressed even at such a low frame frequency as 5–10 Hz, for example. Further, by applying a scanning selection signal so that non-adjacent scanning electrodes are selected in consecutive four field scannings, an image flow can be effectively solved.

Figure 12D:
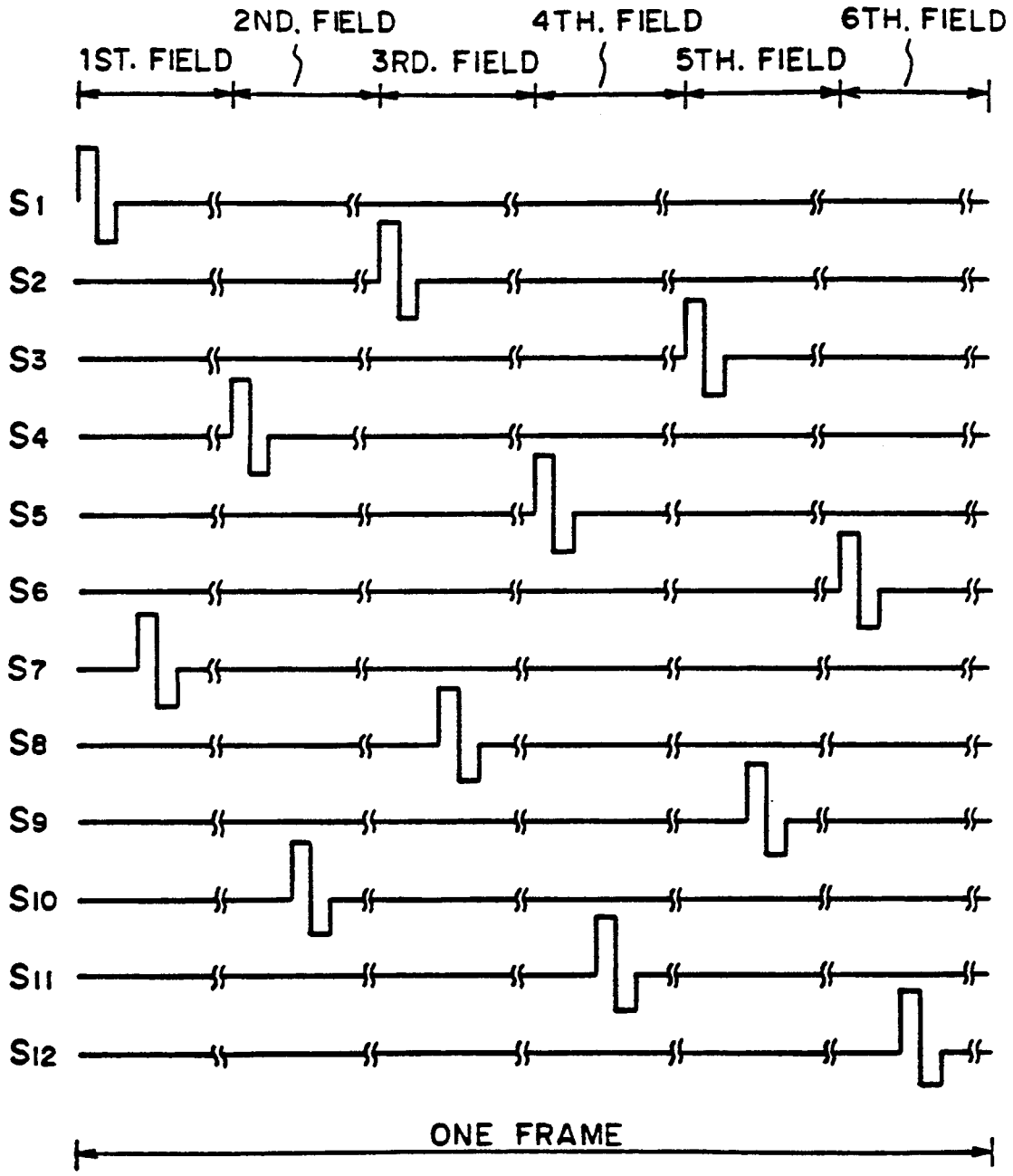

FIG. 12D shows an embodiment using driving waveforms shown in FIG. 12A. In this embodiment, the scanning electrodes are selected 5 lines (scanning electrodes) apart so that non-adjacent scanning electrodes are selected in 6 times of consecutive field scanning.

Figure 13A:
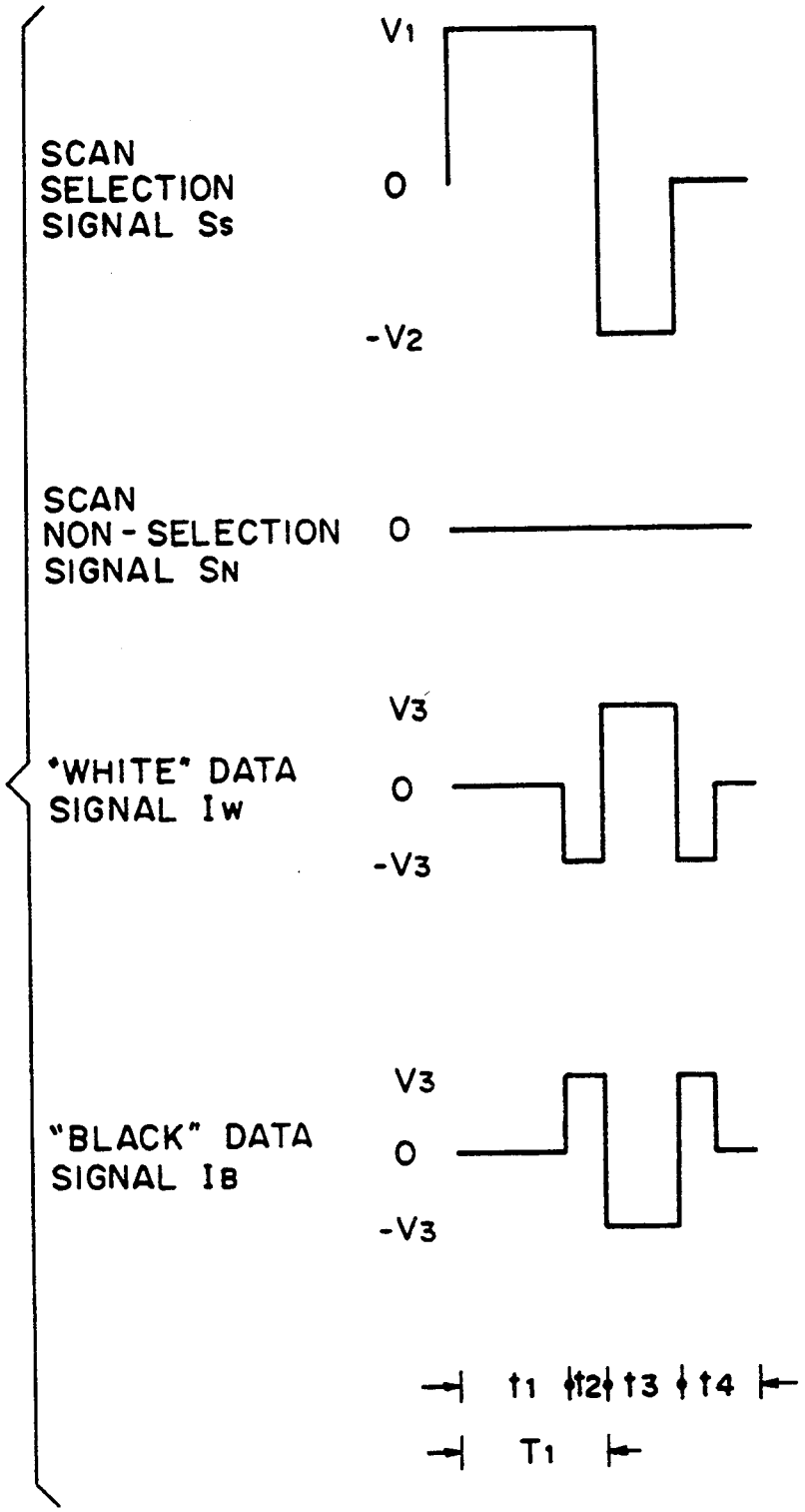
Figure 13B:
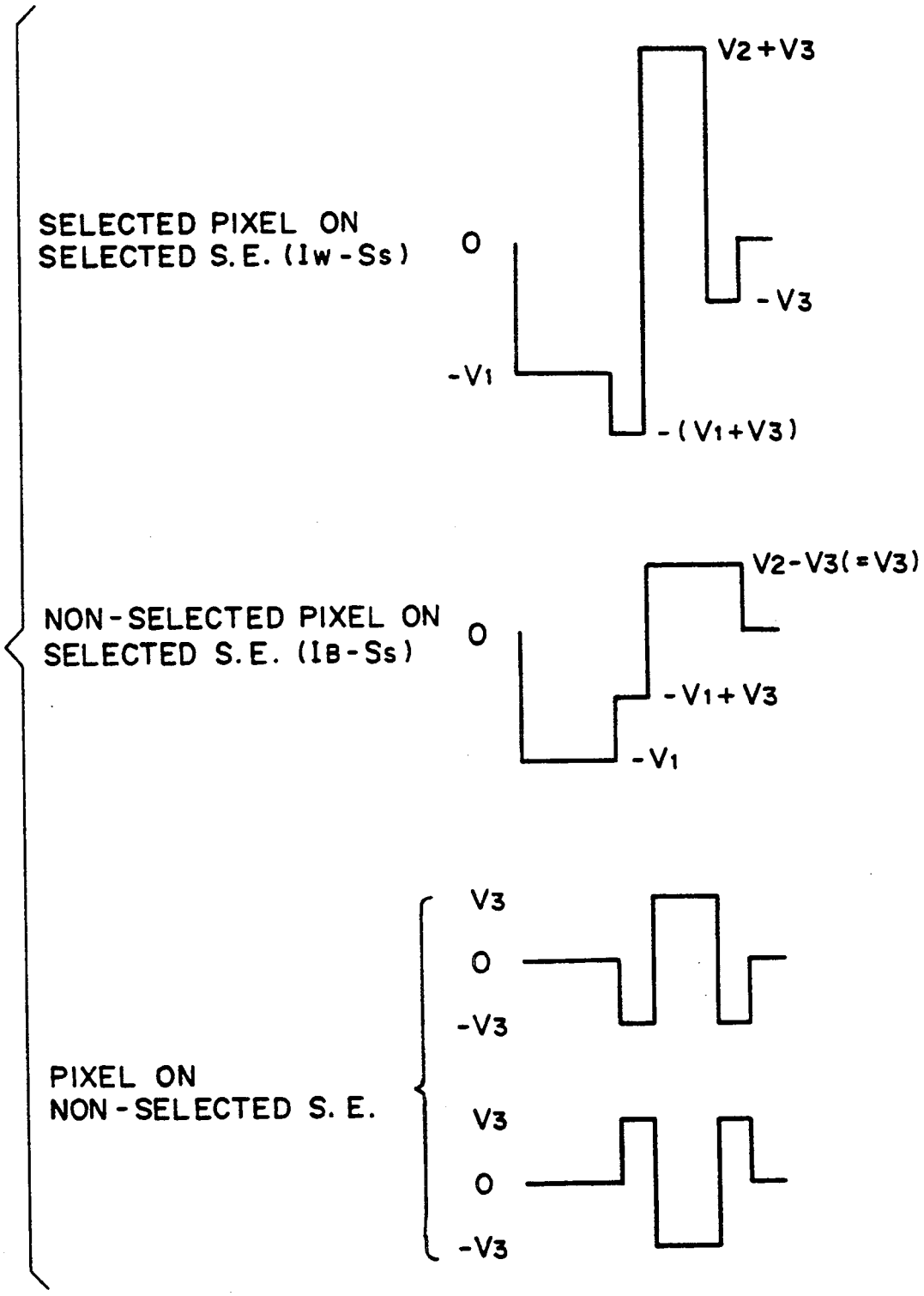

FIGS. 13A and 13B show another driving embodiment used in the present invention.

According to FIGS. 13A and 13B, on a scanning electrode receiving a scanning selection signal $S_S$, all or a prescribed part of the pixels are simultaneously supplied with a voltage for erasure into a black state in phase $T_1$ ($=t_1+t_2$) regardless of the types of data signals, and in phase $t_3$, a selected pixel ($I_W$-$S_S$) is supplied with a voltage ($V_2+V_3$) for inversion-writing into a white state and the other pixels ($I_B$-$S_S$) are supplied with a voltage ($V_2=V_3-V_3$) not changing the black state formed in the phase $T_1$. Further, phases $t_2$ and $t_4$ are provided for applying auxiliary signals so as to apply an AC voltage to the pixels at the time of non-selection, similarly as in the previous embodiment.

Figure 13C:
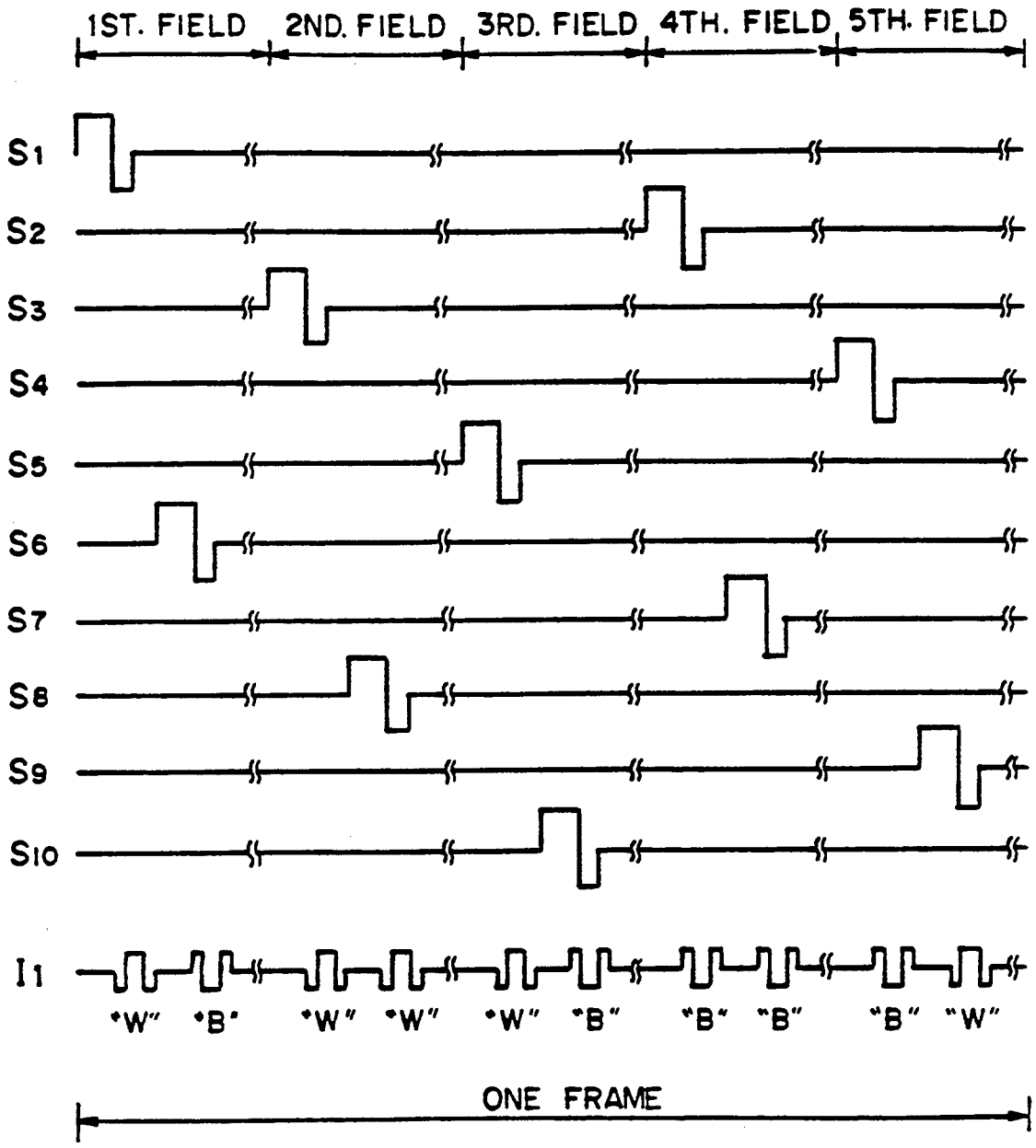

FIG. 13C is a time chart of voltage waveforms for providing a certain display state. According to the embodiment shown in FIG. 13C, a scanning selection signal is applied to the scanning electrodes with jumping of 4 lines apart in one field so as to complete one frame scanning in 5 fields. Also in this embodiment, non-adjacent scanning electrodes are supplied with a scanning selection signal in consecutive 5 times of field scanning.

The present invention is not restricted to the above-described embodiments but can be effected generally in such a manner that a scanning selection signal is applied to the scanning electrodes with jumping of one or more lines apart, preferably 4–20 lines apart. Further, in the present invention, the peak values of the voltages $V_1$, $-V_2$ and $\pm V_3$ may be set to satisfy the relation of $|V_1|=|-V_2|>|\pm V_3|$, preferably $|V_1|=|-V_2| \geqq 2|\pm V_3|$. Further, the pulse durations of these voltage signals may be set to generally 1 μsec–1 msec, preferably 10 μsec–100 μsec, and may preferably be set to be longer at a lower temperature and shorter at a higher temperature.

F. Ferroelectric Liquid Crystal Device

Figure 14:
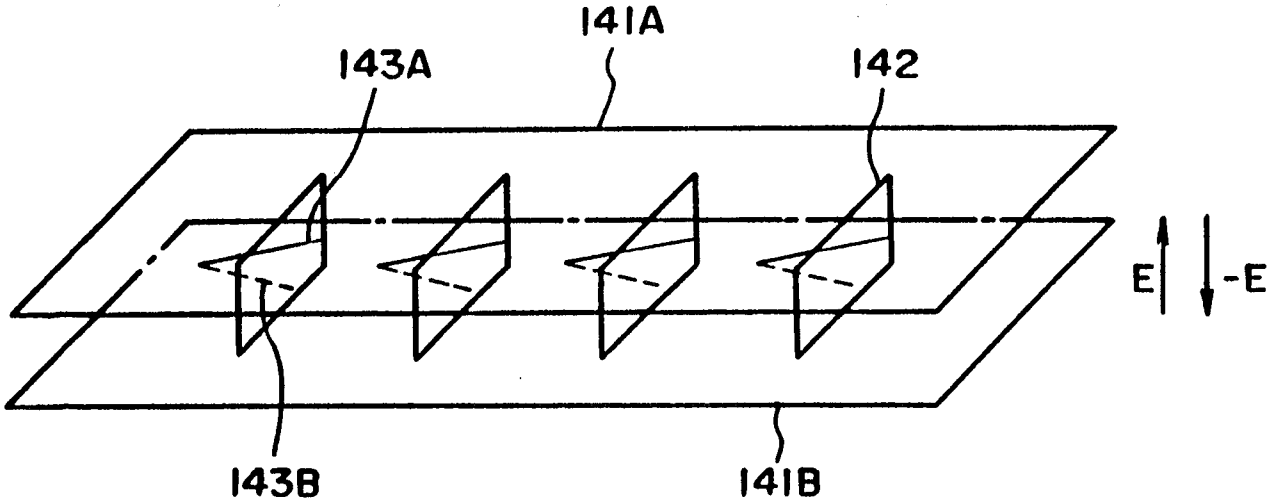
FIG. 14 is a schematic perspective view for illustrating an operation principle of a ferroelectric liquid crystal device.

FIG. 14 schematically illustrates an embodiment of a ferroelectric liquid crystal cell which comprises a pair of electrode plates (glass substrates coated with transparent electrodes) 141A and 141B and a layer of ferroelectric liquid crystal having molecular layers 142 disposed between and perpendicular to the electrode plates. The ferroelectric liquid crystal assumes chiral smectic C phase or H phase and is disposed in a thickness (e.g., 0.5–5 microns) thin enough to release the helical structure inherent to the chiral smectic phase.

When an electric field E (or −E) exceeding a certain threshold is applied between the upper and lower substrates 141A, 141B, liquid crystal molecules 133 are oriented to the electric field. A liquid crystal molecule has an elongated shape and shows a refractive anisotropy between the long axis and the short axis. Therefore, if the cell is sandwiched between a pair of cross nicol polarizers (not shown), there is provided a liquid crystal modulation device. When an electric field E exceeding a certain threshold is applied, a liquid crystal molecule 143 is oriented to a first orientation state 143A. Further, when a reverse electric field −E is applied, the liquid crystal molecule 143 is oriented to a second orientation state 143B to change its molecular direction. Further, the respective orientation states are retained as far as an electric field E or −E applied thereto does not exceed a certain threshold.

The ferroelectric liquid crystal device used in this embodiment may have a bistability or multi-stability so that the first stable state 143A and second stable state 143B may be symmetrical or unsymmetrical. As a result, the liquid crystal molecules tend to be oriented to either one of the orientation states or to another stabler third orientation state. The present invention is suitably applied to such a ferroelectric liquid crystal device having bistability or multistability and suitably applied to a ferroelectric liquid crystal device as disclosed by U.S. Pat. No. 4,367,924 or EP-A-91661.

Figure 15A:
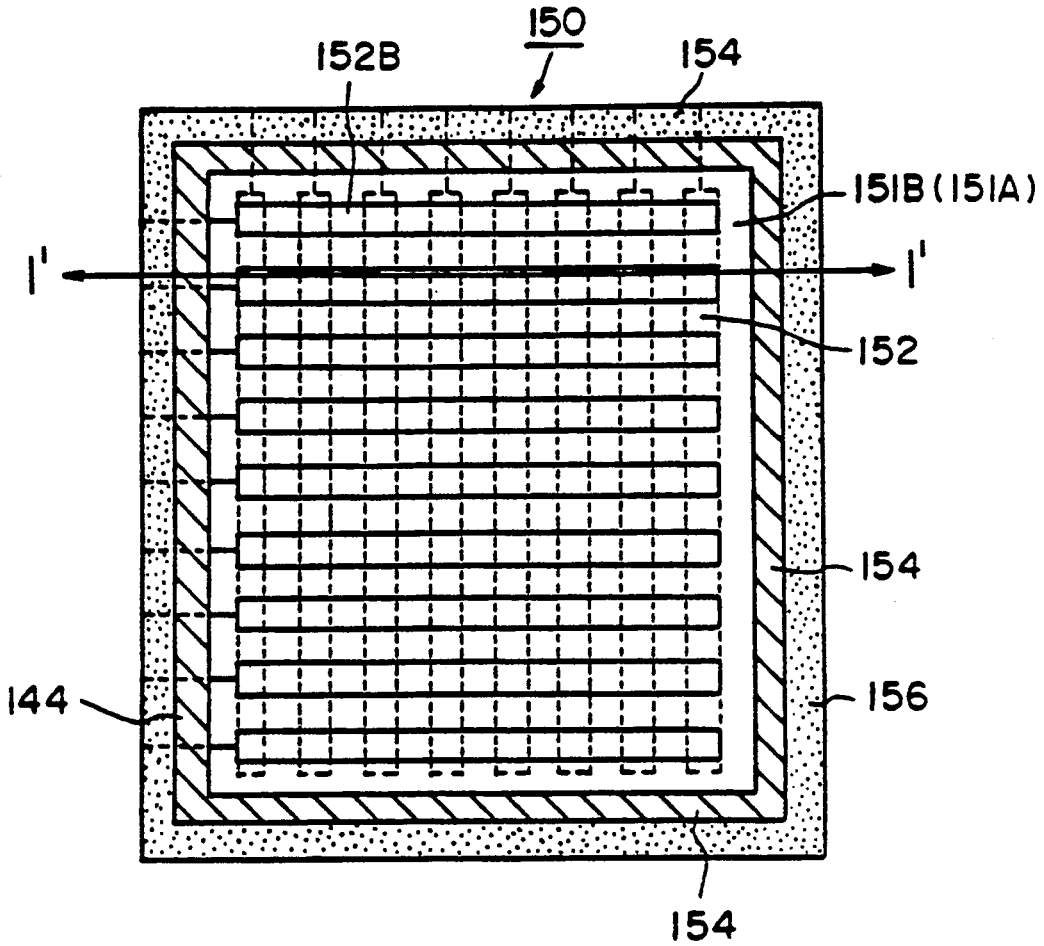
FIG. 15A is a schematic plan view of a ferroelectric liquid crystal device used in the invention.
Figure 15B:
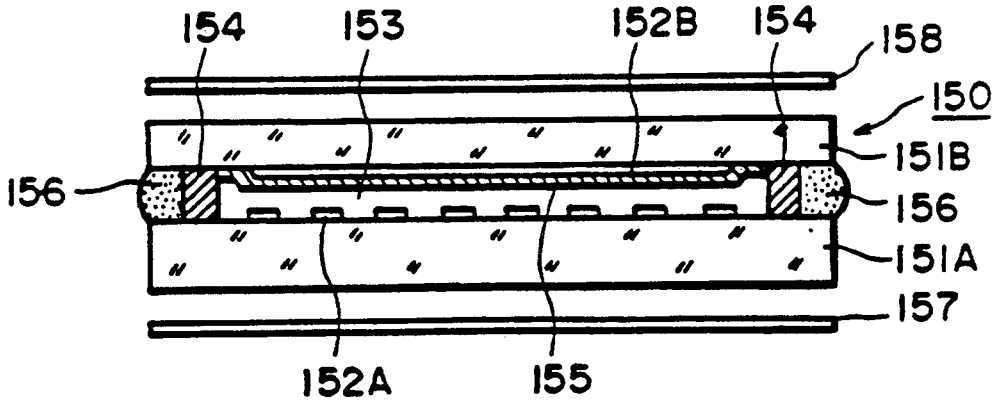
FIG. 15B is a sectional view taken along the line 1—1 therein.

FIG. 15A and 15B illustrate an embodiment of the liquid crystal device according to the present invention. FIG. 15A is a plan view of the embodiment and FIG. 15B is a sectional view taken along the line 1—1 in FIG. 15A.

A cell structure 150 shown in FIG. 15 comprises a pair of substrates 151A and 151B made of glass plates or plastic plates which are held with a predetermined gap with spacers 154 and sealed with an adhesive 156 to form a cell structure. On the substrate 151A is further formed an electrode group (e.g., an electrode group for applying scanning voltages of a matrix electrode structure) comprising a plurality of transparent electrodes 152A in a predetermined pattern, e.g., of a stripe pattern. On the substrate 151B is formed another electrode group (e.g., an electrode group for applying signal voltages of the matrix electrode structure) comprising a plurality of transparent electrodes 152B intersecting with the transparent electrodes 152A.

On the substrate 151B provided with such transparent electrodes 152B may be further formed an alignment control film 155 composed of an inorganic insulating material such as silicon monoxide, silicon dioxide, aluminum oxide, zirconia, magnesium fluoride, cerium oxide, cerium fluoride, silicon nitride, silicon carbide, and boron nitride, or an organic insulating material such as polyvinyl alcohol, polyimide, polyamide-imide, polyester-imide, polyparaxylylene, polyester, polycarbonate, polyvinyl acetal, polyvinyl chloride, polyamide, polystyrene, cellulose resin, melamine resin, urea resin and acrylic resin.

The alignment control film 155 may be formed by first forming a film of an inorganic insulating material or an organic insulating material as described above and then rubbing the surface thereof in one direction with velvet, cloth, paper, etc.

In another preferred embodiment according to the present invention, the alignment control film 155 may be formed as a film of an inorganic insulating material such as SiO or $SiO_2$ on the substrate 151B by the oblique or tilt vapor deposition.

In another embodiment, the surface of the substrate 151B of glass or plastic per se or a film of the above-mentioned inorganic material or organic material formed on the substrate 151B is subjected to oblique etching to provide the surface with an alignment control effect.

It is preferred that the alignment control film 155 also functions as an insulating film. For this purpose, the alignment control film may preferably have a thickness in the range of 100 Å to 1 micron, especially 500 to 5000 Å. The insulating film also has a function of preventing the occurrence of an electric current which is generally caused due to minor quantities of impurities contained in the liquid crystal layer 153, whereby deterioration of the liquid crystal compounds is prevented even on repeating operations.

As the ferroelectric liquid crystal 153, a liquid crystal compound or composition showing chiral smectic phase as disclosed in U.S. Pat. Nos. 4,561,726, 4,614,609, 4,589,996, 4,592,858, 4,596,667, 4,613,209, etc., may be used.

The device shown in FIGS. 15A and 15B further comprises polarizers 153 and 158 having polarizing axes crossing each other, preferably at 90 degrees.

As described above, according to the present invention, in partial rewriting scanning for a display apparatus having a memory characteristic such as a ferroelectric liquid crystal display apparatus, the partial rewriting region is defined by a rewriting start scanning line address and the number of rewriting scanning lines. Further, a means is provided for observing the scanning line address of image data transferred, and if another partial rewriting demand occurs during one partial rewriting process, priority levels of display data of demanded partial rewriting are judged to effect the partial rewriting operations in the order of from a higher priority level (e.g. movement of a pointing device) to a lower one. As a result, even in a display driven at a low frame frequency, there can be realized a display apparatus which is adapted to a highly developed display application program involving movement of a pointing device or cursor, a multi-window display and a multi-task display. Particularly, according to the present invention, the display quality of a moving font display such as that of a mouse cursor can be improved regardless of a moving font position and without causing a local display failure of a moving font.

What is claimed is:

1. A data processing apparatus, comprising:

(a) means for receiving image data having a plurality of graphic events;

(b) means for controlling an image data storage memory so that the received image data is stored in the memory in the order of from a higher display priority level of the graphic events based on prescribed display priority levels of the graphic events, with the storage of image data for higher priority graphic events occurring before the storage of image data for lower priority graphic events; and (c) means for controlling the image data storage memory so that the stored image data is transferred in the order of from a higher priority level of the graphic events to drive control means, with the transfer of stored image data corresponding to higher priority graphic events occurring before the transfer of stored image data corresponding to lower priority graphic events.

2. An apparatus according to claim 1, wherein said stored image data comprises scanning line address data for selecting a scanning line and display data for controlling display data signals applied to data lines associated with the selected scanning line, and the apparatus comprises means for serially transferring the image data.

3. An apparatus according to claim 2, which comprises means for memorizing the transferred scanning line address data.

4. An apparatus according to claim 1, wherein said plurality of graphic events include a moving display as an event of the first display priority level.

5. A data processing system comprising:

(a) means for receiving image data having a plurality of graphic events;

(b) means for controlling an image data storage memory so that the received image data is stored in the memory in the order of from a higher display priority level of the graphic events based on prescribed display priority levels of the graphic events, with the storage of image data for higher priority graphic events occurring before the storage of image data for lower priority graphic events;

(c) means for controlling the image data storage memory so that the stored image data is transferred in the order of from a higher priority level of the graphic events to drive control means, with the transfer of stored image data corresponding to higher priority graphic events occurring before the transfer of stored image data corresponding to lower priority graphic events; and (d) display means controlled by the drive control means.

6. A system according to claim 5, wherein said display means comprises an electrode matrix formed of scanning lines and data lines.

7. A system according to claim 5, wherein said display means has a memory characteristic.

8. A system according to claim 5, wherein said display means comprises a ferroelectric liquid crystal.

9. A system according to claim 5, wherein said stored image data comprises scanning line address data for selecting a scanning line and display data for controlling display data signals applied to data lines associated with the selected scanning line, and the apparatus comprises means for serially transferring the image data.

10. A system according to claim 9, which comprises means for memorizing the transferred scanning line address data.

11. A system according to claim 5, wherein said plurality of graphic events include a moving display as an event of the first display priority level.

* * * * *

UNITED STATES PATENT AND TRADEMARK OFFICE

CERTIFICATE OF CORRECTION

PATENT NO. : 5,359,344

DATED : October 25, 1994

INVENTOR(S) : Inoue et al.

It is certified that error appears in the above-indentified patent and that said Letters Patent is hereby corrected as shown below:

In the Drawings:

FIG. 18, "INCREMET" should read --INCREMENT--.

COLUMN 9:

Line 8, "data" should read --Data--.

COLUMN 10:

Line 9, "key bard" should read --keyboard--.

COLUMN 16:

Line 64, "is" should be deleted.

COLUMN 21:

Line 12, "according a" should read --according to a--.

UNITED STATES PATENT AND TRADEMARK OFFICE

CERTIFICATE OF CORRECTION

PATENT NO. : 5,359,344 Page 2 of 2

DATED : October 25, 1994

INVENTOR(S) : Inoue et al.

It is certified that error appears in the above-indentified patent and that said Letters Patent is hereby corrected as shown below:

COLUMN 22:

Line 44, "flat" should read --flag--.

COLUMN 29:

Line 51, "such one" should read --one such--.

COLUMN 30:

Line 45, "$(V_2 = V_3 - V_3)$" should read --$(V_2 - V_3 = V_3)$--.

Signed and Sealed this

Twenty-third Day of May, 1995

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,359,344

DATED : October 25, 1994

INVENTOR(S) : Inoue et al.

It is certified that error appears in the above-indentified patent and that said Letters Patent is hereby corrected as shown below:

COLUMN 6:

Between lines 7 and 8, insert the following:
--FIG. 16 is a flow chart of a data processing routine.--.

Signed and Sealed this

Twelfth Day of November, 1996

*Attest:*

Bruce Lehman

BRUCE LEHMAN

*Attesting Officer*

*Commissioner of Patents and Trademarks*